US009747875B2

(12) United States Patent
Ua-Aphithorn

(10) Patent No.: US 9,747,875 B2
(45) Date of Patent: Aug. 29, 2017

(54) ACCORDION AND ELECTRONIC ACCORDION

(71) Applicant: Tanate Ua-Aphithorn, Bangkok (TH)

(72) Inventor: Tanate Ua-Aphithorn, Bangkok (TH)

( * ) Notice: Subject to any disclaimer, the term of this patent is extended or adjusted under 35 U.S.C. 154(b) by 0 days.

(21) Appl. No.: 15/291,001

(22) Filed: Oct. 11, 2016

(65) Prior Publication Data

US 2017/0116970 A1 Apr. 27, 2017

Related U.S. Application Data

(63) Continuation-in-part of application No. 14/920,854, filed on Oct. 22, 2015, now Pat. No. 9,520,112.

(51) Int. Cl.
*G10D 11/00* (2006.01)
*G10H 1/34* (2006.01)

(52) U.S. Cl.
CPC ..... *G10D 11/00* (2013.01); *G10H 1/34* (2013.01); *G10H 1/344* (2013.01); *G10H 2220/251* (2013.01); *G10H 2230/245* (2013.01)

(58) Field of Classification Search
CPC ..... G10D 11/00
See application file for complete search history.

(56) References Cited

U.S. PATENT DOCUMENTS 826,661 A * 7/1906 Hofbauer ..... G10D 11/02 84/376 K
1,530,408 A * 3/1925 Rasmussen ..... G10D 11/02 84/376 K
2,136,112 A * 11/1938 Lindeberg ..... G10D 11/02 84/376 R (Continued)

FOREIGN PATENT DOCUMENTS

CN 2273036 Y 1/1998
DE 3534961 A1 4/1987

(Continued)

OTHER PUBLICATIONS

Extended European Search Report mailed Feb. 17, 2017 in corresponding European Patent Application No. 16195065.4, 12 pages.

(Continued)

*Primary Examiner* — Robert W Horn
(74) *Attorney, Agent, or Firm* — Masuvalley & Partners

(57) ABSTRACT

An accordion includes a right hand play side, a left hand play side, a bellow, four rows of buttons, and two rows of buttons. The four rows of buttons include a first column to which first continuous four pitches are assigned, a second column to which second continuous four pitches are assigned, and a third column to which third continuous four pitches are assigned. The two rows of buttons include a first column to which first continuous two pitches are assigned, the first continuous two pitches being continuous from or to the first continuous four pitches, a second column to which second continuous two pitches are assigned, the second continuous two pitches being continuous from or to the second continuous four pitches, and a third column to which third continuous two pitches are assigned, the third continuous two pitches being continuous from or to the third continuous four pitches.

9 Claims, 31 Drawing Sheets

(56) References Cited

U.S. PATENT DOCUMENTS

| | | | | | |
|---|---|---|---|---|---|
| 2,138,749 | A * | 11/1938 | Skudies | G10D 11/02 | 84/376 R |
| 2,203,393 | A * | 6/1940 | Reuther | G10C 3/12 | 84/376 R |
| 2,341,082 | A * | 2/1944 | Claude | G10D 11/02 | 84/376 K |
| 3,067,645 | A * | 12/1962 | Moschino | G10D 11/02 | 84/376 R |
| 3,311,011 | A * | 3/1967 | Kuehl | G10D 11/02 | 84/376 K |
| 3,776,089 | A * | 12/1973 | Cohen | G10D 11/00 | 84/376 R |
| 4,159,664 | A * | 7/1979 | Mastronardi | G10D 11/02 | 84/376 K |
| 5,741,990 | A | 4/1998 | Davies | | |
| 7,667,119 | B1 * | 2/2010 | Schlapkohl | G10C 3/12 | 84/376 R |
| 8,614,384 | B2 * | 12/2013 | Hotrique | G10C 3/12 | 84/376 R |
| 9,159,307 | B1 * | 10/2015 | Ludovici | G10H 1/0066 | |
| 9,520,112 | B1 * | 12/2016 | Ua-Aphithorn | G10D 11/00 | |
| 2008/0173163 | A1 * | 7/2008 | Pratt | G10H 1/20 | 84/645 |
| 2017/0116970 | A1 * | 4/2017 | Ua-Aphithorn | G10D 11/00 | |

FOREIGN PATENT DOCUMENTS

| | | | |
|---|---|---|---|
| EP | 1258861 | A2 | 11/2002 |
| EP | 1752966 | A2 | 2/2007 |
| FR | 2 724 253 | A1 | 3/1996 |
| WO | 90/09650 | A1 | 8/1990 |

OTHER PUBLICATIONS

"Shiverware Music Pro", Jul. 3, 2014, URL: http://web.archive.org/web/20140703014248/http://shiverware.com/musixpro/ , 6 pages.

* cited by examiner

ACCORDION AND ELECTRONIC ACCORDION

This application is a Continuation-In-Part of U.S. patent application Ser. No. 14/920,854, filed Oct. 22, 2015, which is hereby expressly incorporated by reference in its entirety for all purposes.

TECHNICAL FIELD

The present invention relates to an accordion and an electronic accordion.

BACKGROUND OF THE INVENTION

In an ideal world, a musical instrument such as an accordion is played very easily and friendly by the user. Unfortunately, this is not yet possible. For example, Staradella system cannot serve all purposes. So there are many inventions of the freebass system. Depending on the skill or level of an accordionist, in a performance by an accordionist it is very important to play very good music. However, sometime the performance of the accordionist is limited by the accordion.

The limitation in the accordion is note layout patterns. The note layout patterns have many layout patterns that the accordionist can be selected by accordionist's characteristic such as physiology of accordionist (left hand, fingers and wrist) and accordionist skill and/or song format such as speed of tempo, beats, key of the note and Scale. However, all of the note layout patterns cannot be a right answer for all accordionists. Because, this note layout pattern has been played for over 100 years. Old traditional accordion patterns have to be improved by changing from a mechanism accordion to an electronic accordion. However, the electronic accordion is still using a same note layout pattern of the mechanism accordion.

On the note layout Bass pattern of the accordion which has many different ways on note layout patterns in 4 main systems such as;

1. C system, which is mostly used in America and some parts of European countries. 2. B system, which is mostly used in Russia, Germany and some parts of European countries. 3. Standard Bass or Counter Bass or Quint System, which arranged in the Circle of fifth. 4. Stradella Bass.

C system is the most famous note layout pattern that has been played, because C system has three rows and can combine with in the Counter Bass System. To be solved the limitation, the accordion has both systems. The both systems can play with in many ways, because accordionist can select many notes or chords to play music. However, to a combination of both systems have many limitations such as cannot play the difference Scale, not easy to play crossover to another octave and the confliction on the speed of fingering.

FIG. 1 illustrates an exploded perspective view of a prior art of a left hand key note. As shown in the drawing, the prior art of a left hand key note includes a Counter Bass System and a C system in freebass style.

The Counter Bass System includes two rows buttons on the left hand side of the accordion. The Counter Bass System is arranged a pattern of note layout in a Perfect Fifth Scale. The Perfect Fifth Scale is the musical interval corresponding to a pair of pitches with a frequency ratio of 3:2, or very nearly so. In classical music from Western culture, a fifth is the interval from the first to the last of five consecutive notes in a diatonic Scale. The perfect fifth (often abbreviated P5) spans seven semitones, while the diminished fifth spans six and the augmented fifth spans eight semitones. For example, the interval from C to G is a perfect fifth, as the note G lays seven semitones above C. The perfect fifth may be derived from the harmonic series as the interval between the second and third harmonics. In a diatonic Scale, the dominant note is a perfect fifth above the tonic note. In other words, the Perfect Fifth is a note number fifth in a root major note such as a D major note, the root note is D and the note number fifth is A.

The C system is a type of accordion's button where the melody-side keyboard. The C system consists of three rows of buttons arranged chromatically. The bass-side keyboard is usually the Stradella system or one of the various freebass systems. The Russian Bayan and Schrammel accordion are included among chromatic button accordions. There can be 3 to 5 rows of horizontal treble buttons in C system. In a 4 row chromatic, one additional row repeats the first 1 row to facilitate options in fingering. In a 5 row chromatic, two additional rows repeat the first 2 rows to facilitate options in fingering.

The prior art of a left hand key note is a combination of The Counter Bass System and the C system. A result is that the prior art of a left hand key can play many ways of music such as play in a chromatic Scale and a Perfect Fifth Scale. However, the prior art of a left hand key has a problem with an issue how to play a different Scale and cross over to other octave. Because, the prior art of a left hand key cannot play crossover in many octave such as can play only one or two octave. In addition, if the accordionist wants to play note C, D, E, F, G, A, B in order using C system of FIG. 1, the accordionist had to twist or move the left hand wrist at the time of playing F to G and G to A. Thus, the accordionist cannot play the accordion very fast and cannot play the accordion easily.

Moreover, the prior art of a left hand key cannot play many Scales, because in the Counter Bass System is played in the Perfect Fifth note Scale. The Perfect Fifth note Scale has only the root note and the note number fifth. That is why the Perfect Fifth note is not easy to play with Chromatic Scale. Furthermore, C system has note layout pattern in Chromatic note which in three rows. A position of fingers (fingering) is close together, so can play Chromatic Scale very fast and easy on the C system. Playing in Diatonic Scales, a speed of fingering in the C system cannot be very fast, but in the Counter Bass system, the speed of fingering can be very fast. The prior art of a left hand key has a confliction and trade-off on the speed of fingering.

Thus, the prior art of a left hand key has many limitations such as cannot play the difference Scale, cannot play crossover to another octave and the confliction on the speed of fingering.

To solve the problem of accordion note layout, this invention has already invented an accordion note layout that the accordionist can play with many songs type or styles. Moreover, this invention can help accordionist to play the song without physical problems. The physical problems are limitation of how to move the left hand, the fingers and the wrist. When the accordionist has played the music song, the left hand or the fingers the wrist has to move all the time. However, some positions go against natural ergonomic of fingering when the accordionist has played the music song. The accordionist cannot move fingers cross over more than 1 octave from the prior art note layout in mechanism accordion and electronic accordion. Also, the accordionist cannot twist the wrist the accordionist is played the music song.

Furthermore, in the present world of accordions, many people are interested in playing the accordion. But the old traditional accordion pattern, it's quite difficult to learn for a new beginner. For example, it is sometimes difficult for the beginner to play chord because the notes belonging to the chord are provided away from each other. This invention can help the new beginner to play the accordion easier.

Thus, this invention is a next step to improve the accordion music instrument in the accordion note layout pattern for professional accordionist by eliminating the physiology issue and song format. Moreover, this invention can teach the beginner to learn the accordion easier than the Old traditional accordion patterns.

SUMMARY OF THE INVENTION

An aspect of the present invention is an accordion having a right hand play side, a left hand play side, a bellow provided between the right hand play side and the left hand play side, four rows of buttons provided on at least one of the right hand play side and the left hand play side, and two rows of buttons provided adjacent to the bellow side of the four rows of buttons or opposite bellow side of the four rows of buttons. The four rows of buttons include a first column to which first continuous four pitches are assigned, a second column, provided adjacent to the first column, to which second continuous four pitches are assigned, the second continuous four pitches being adjacent to the first continuous four pitches, and a third column, provided adjacent to the second column, to which third continuous four pitches are assigned, the third continuous four pitches being adjacent to the second continuous four pitches. The two rows of buttons include a first column, provided adjacent to the first column of the four rows of buttons, to which first continuous two pitches are assigned, the first continuous two pitches being continuous from or to the first continuous four pitches, a second column, provided adjacent to the second column of the four rows of buttons, to which second continuous two pitches are assigned, the second continuous two pitches being continuous from or to the second continuous four pitches, and a third column, provided adjacent to the third column of the four rows of buttons, to which third continuous two pitches are assigned, the third continuous two pitches being continuous from or to the third continuous four pitches.

Another aspect of the present invention is an accordion having a right hand play side, a left hand play side, a bellow provided between the right hand play side and the left hand play side, four rows of buttons provided on at least one of the right hand play side and the left hand play side, and one row of buttons provided adjacent to the bellow side of the four rows of buttons or opposite bellow side of the four rows of buttons. The four rows of buttons include a first column to which first continuous four pitches are assigned, a second column, provided adjacent to the first column, to which second continuous four pitches are assigned, the second continuous four pitches being adjacent to the first continuous four pitches, and a third column, provided adjacent to the second column, to which third continuous four pitches are assigned, the third continuous four pitches being adjacent to the second continuous four pitches. The one row of buttons include a first column, provided adjacent to the first column of the four rows of buttons, to which first pitch is assigned, the first pitch being continuous from or to the first continuous four pitches, a second column, provided adjacent to the second column of the four rows of buttons, to which second pitch is assigned, the second pitch being continuous from or to the second continuous four pitches, and a third column, provided adjacent to the third column of the four rows of buttons, to which third pitch is assigned, the third pitch being continuous from or to the third continuous four pitches.

Another aspect of the present invention is an electronic accordion having a right hand play side, a left hand play side, a bellow provided between the right hand play side and the left hand play side, four rows of buttons provided on at least one of the right hand play side and the left hand play side, two rows of buttons provided adjacent to the bellow side of the four rows of buttons or opposite bellow side of the four rows of buttons, and a controller. The controller is configured to execute assigning first continuous four pitches to a first column of the four rows of buttons, assigning second continuous four pitches to a second column of the four rows of buttons, the second continuous four pitches being adjacent to the first continuous four pitches, and the second column of the four rows of buttons being provided adjacent to the first column of the four rows of buttons, assigning third continuous four pitches to a third column of the four rows of buttons, third continuous four pitches being adjacent to the second continuous four pitches, and the third column of the four rows of buttons being provided adjacent to the second column of the four rows of buttons, assigning first continuous two pitches to a first column of the two rows of buttons, the first continuous two pitches being continuous from or to the first continuous four pitches, and the first column of the two rows of buttons being provided adjacent to the first column of the four rows of buttons, assigning second continuous two pitches to a second column of the two rows of buttons, the second continuous two pitches being continuous from or to the second continuous four pitches, and the second column of the two rows of buttons being provided adjacent to the second column of the four rows of buttons, and assigning third continuous two pitches to a third column of the two rows of buttons, the third continuous two pitches being continuous from or to the third continuous four pitches, and the third column of the two rows of buttons being provided adjacent to the third column of the four rows of buttons.

The most important result from this present invention can eliminate the problem of the physiology of the accordionist and the accordionist's skill. Moreover, this invention can decrease the limitation of a music format from a music instrument that can play the difference Scale and can play crossover to another octave without the conflict on the speed of fingering. Furthermore, embodiments can help a beginner to learn the accordion easier than the prior art.

DETAILED DESCRIPTION OF INVENTION

Figure 2:
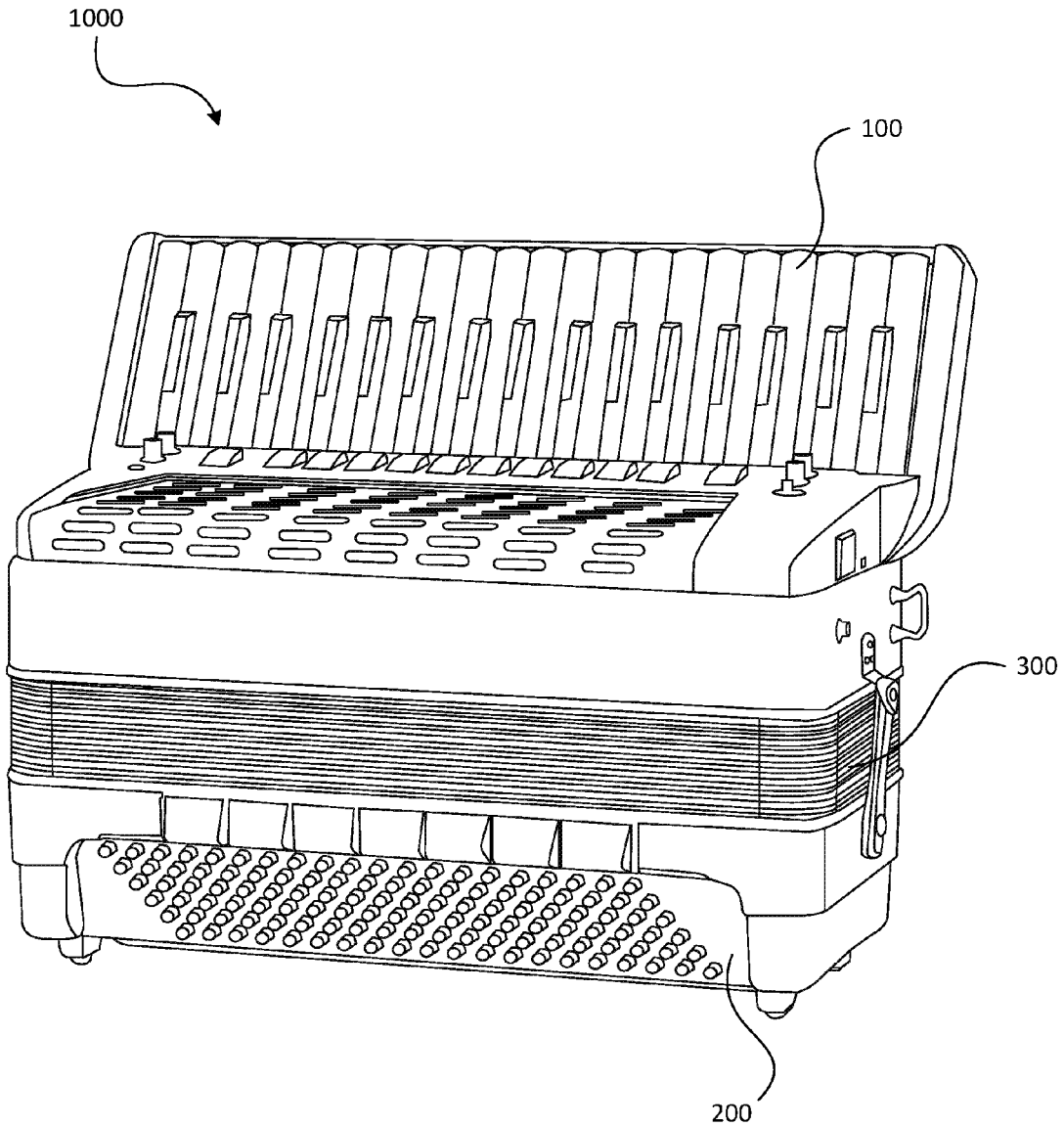
FIG. 2 is a diagram illustrating an overall configuration of accordion of the present invention.

An embodiment of present invention will be described in detail below with reference drawings. FIG. 2 illustrates a perspective view of an accordion 1000. The accordion has a right hand play side 100, a left hand play side 200, and a bellow 300.

The accordion 1000 is a music instrument that is played by compressing or expanding the bellow 300 while pressing buttons or keys in the right hand play side 100 and/or the left hand play side 200. The bellow 300 allows air to flow across strips of brass or steel, call reeds, which vibrate to produce sound inside the body.

The right hand play side 100 is used a musical keyboard similar to a piano-style keyboard and/or an organ-style keyboard by compressing or expanding the bellow 300 while pressing button or keys in the right hand play side 100. The right hand play side 100 is normally used for playing the melody. Some use a button layout arranged in one way or another, while others use the piano-style keyboard and/or the organ-style keyboard. Each system has different claimed benefits by those who prefer it.

The left hand play side 200 includes buttons or keys in the left hand play side 200. The left hand play side 200 is normally used for playing the accompaniment. These almost always use distinct bass buttons and often have buttons with concavities or studs to help an accordionist navigate the layout despite not being able to see the buttons while playing.

Figure 3:
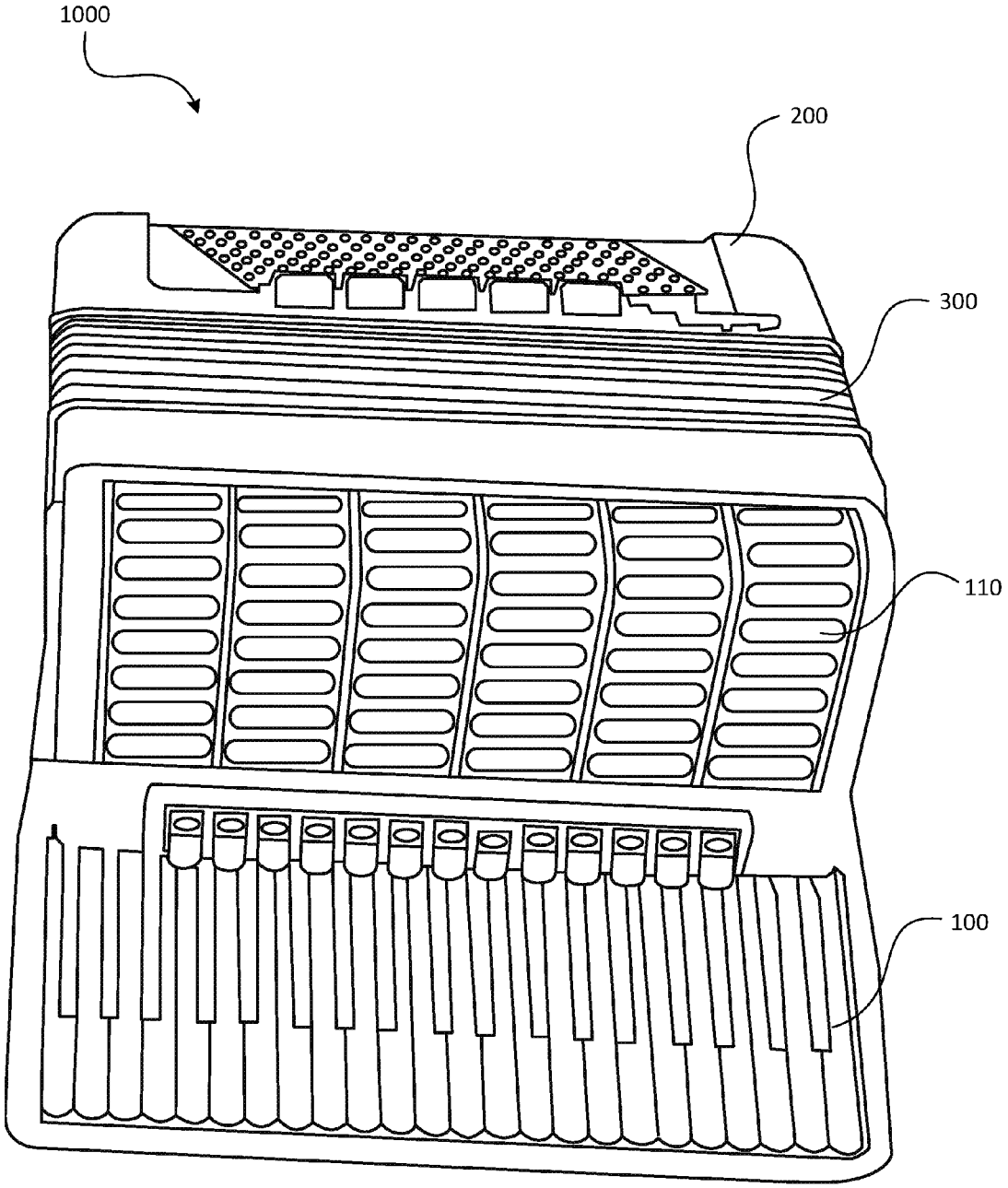
FIG. 3 is a diagram illustrating a right hand configuration of accordion of the present invention.

FIG. 3 illustrates a perspective view of the right hand play side 100. As shown in the drawing, the right hand play side 100 according to the embodiment includes a musical keyboard similar to a piano-style keyboard and/or an organstyle keyboard, and speaker 110.

The speaker 110 is a channel for a sound by compressing or expanding the bellow 300 while pressing button or keys in the right 100 and/or left hand play side 200.

Figure 4:
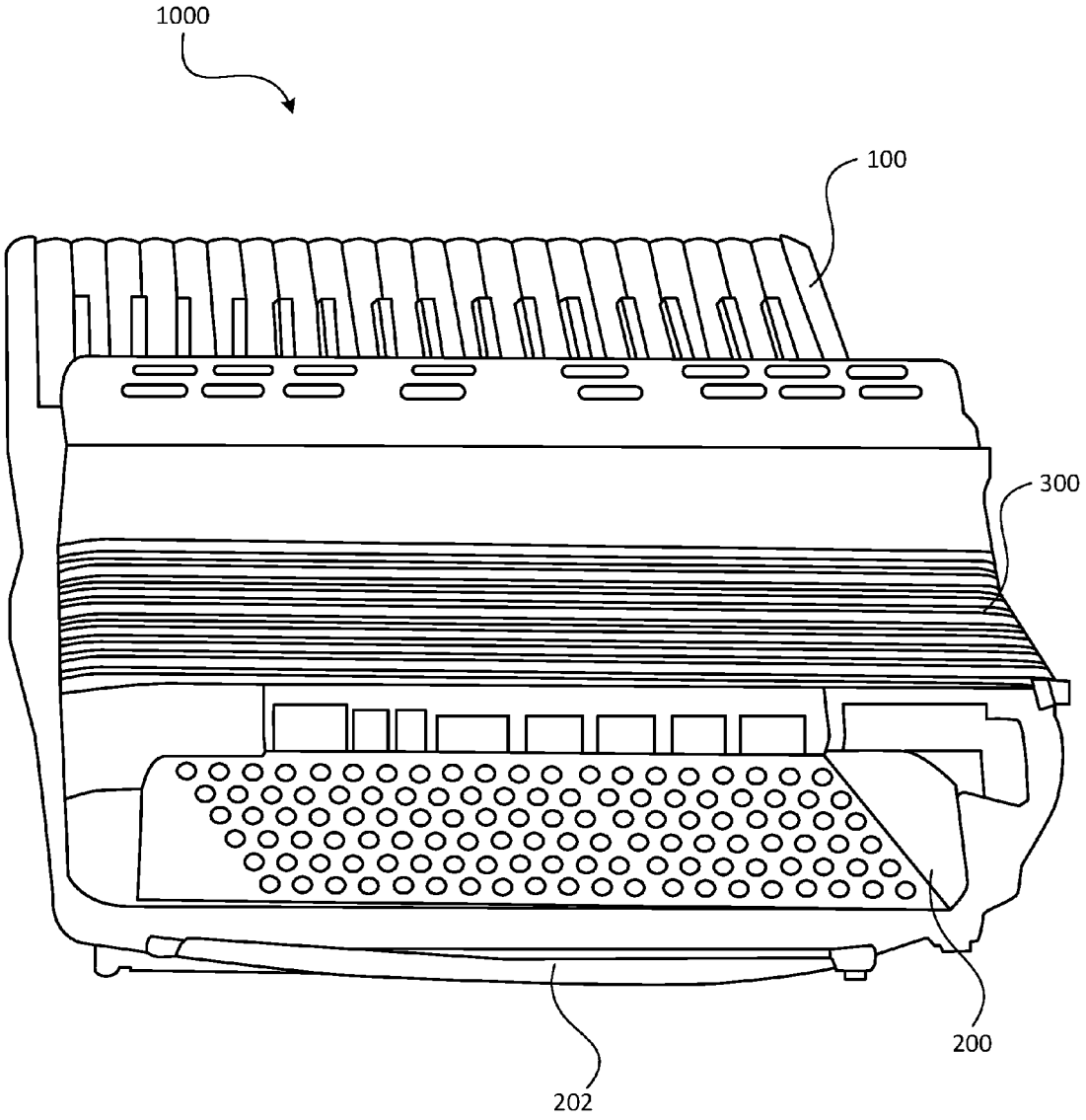
FIG. 4 is a diagram illustrating a left hand configuration of accordion of the present invention.

FIG. 4 illustrates a perspective view of the left hand play side 200. As shown in the drawing, the left hand play side 200 according to the embodiment includes buttons or keys in the left hand play side 200, and a strap 202.

The strap 202 is a leather strap on the left-hand manual to keep an accordionist's hand in position while drawing the bellows 300. The strap 202 makes it easier to balance the weight and increase bellows 300 control while sitting, and avoid dropping the instrument while standing.

Figure 5:
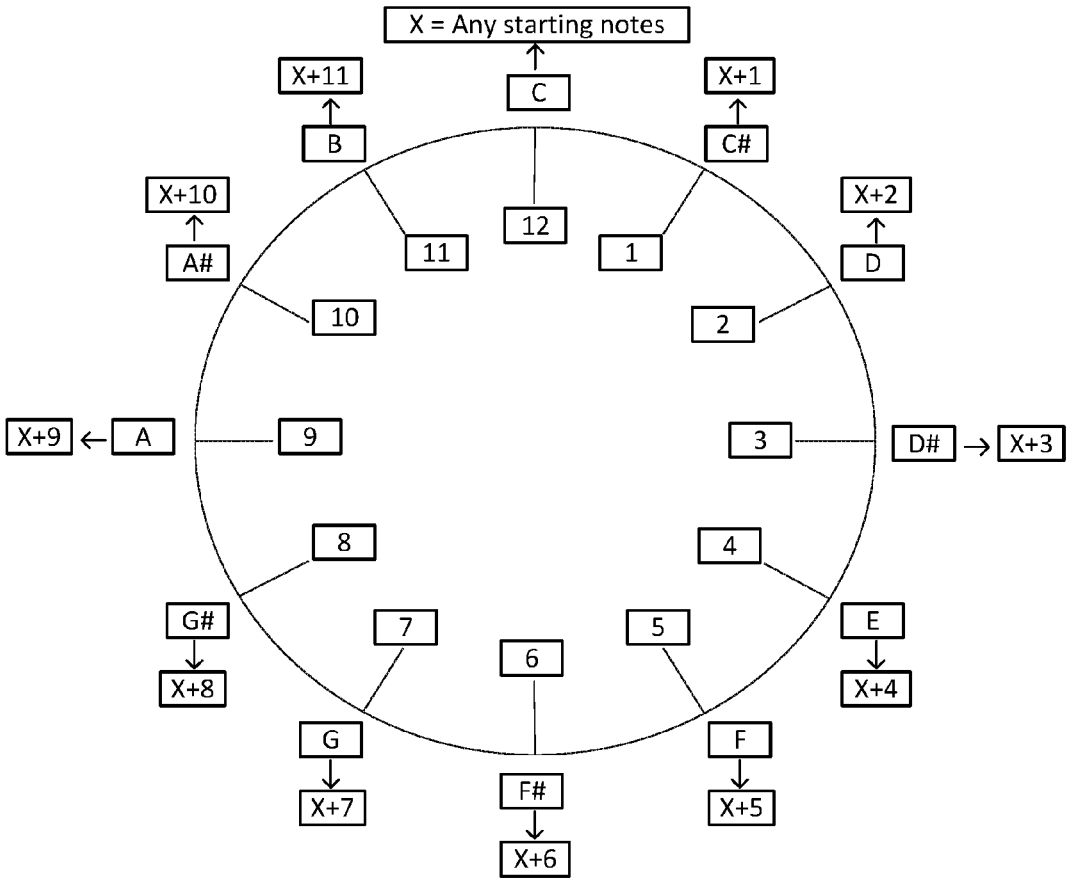
FIG. 5 is a diagram illustrating a functional equation of accordion of the present invention.

FIG. 5 illustrates an exploded perspective view of a functional equation. As shown in the drawing, the functional equation according to the embodiment includes a function to explain a method of this invention.

The functional equation is based on a clock that has a cycle and 12 numbers. The 12 numbers start from 1 to 12. Arrangements of the 12 numbers are clockwise. The 12 numbers are arranged inside the circle.

The functional equation has notes on the outside of the cycle. A first row outside of the cycle shows the 12 notes which are C note key (C chromatic Scale) in FIG. 5. The chromatic Scale has 12 notes, and uses every half-tone/semitone position. The C chromatic Scale as an example is C, C#, D, D#, E, F, F#, G, G#, A, A# and B. The arrangement of C chromatic Scale starts on the C note at a number 12 position. The direction of the C chromatic Scale is clockwise. Thus, a second note is a C# note at a number 1 position, a third note is a D note at a number 2 position, . . . a last note is a B note at a number 11 position. When the direction is reached one around or one loop, it will be counted as one octave.

The functional equation has a last explanation on the outside of the cycle. A second row outside of the cycle shows an X function. The X function has a method for arranging 12 notes. A direction of X function is clockwise by X, X+1, X+2, X+3, X+4, X+5, X+6, X+7, X+8, X+9, X+10 and X+11. The X is a starting note. The starting note X can be any note of this position.

Figure 6:
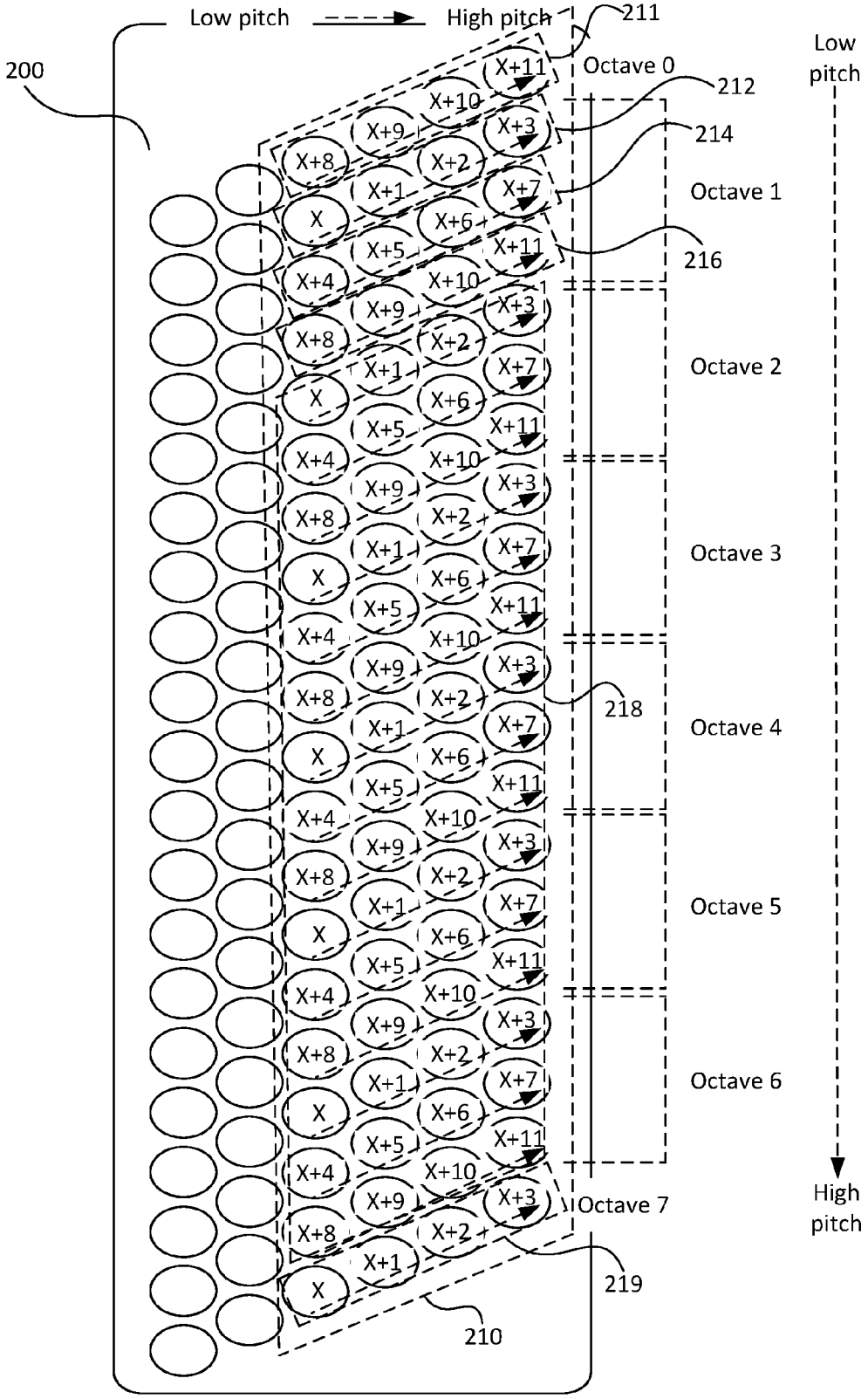
FIG. 6 is a diagram illustrating an example of left hand key note pattern T1 of the present invention.

FIG. 6 illustrates an exploded perspective view of a Note layout-T1. As shown in the drawing, the Note layout-T1 according to the embodiment includes four rows of buttons 210 provided on the left hand plays side 200. The four rows of buttons 210 are arranged in lines in a direction substantially orthogonal to an expansion and contraction direction of the bellow 300. The four rows of buttons 210 include a first column 212, a second column 214, and a third column 216. First continuous four pitches X, X+1, X+2 and X+3 are assigned to the first column 212. A second column 214 is provided adjacent to the first column 212. Second continuous four pitches X+4, X+5, X+6 and X+7 are assigned to the second column 214. The second continuous four pitches X+4, X+5, X+6 and X+7 are adjacent to the first continuous four pitches X, X+1, X+2 and X+3. Third column 216 is provided adjacent to the second column 214. Third continuous four pitches X+8, X+9, X+10 and X+11 are assigned to the third column 216. The third continuous four pitches X+8, X+9, X+10 and X+11 are adjacent to the second continuous four pitches X+4, X+5, X+6 and X+7. In this example, the twelve pitches X to X+11 of the first column 212, the second column 214, and the third column 216 form octave 1. The four rows of buttons 210 include 8 octaves (octave 0, octave 1, octave 2, octave 3, octave 4, octave 5, octave 6 and octave 7). These 8 octaves are arranged in lines in a direction from a top side of the accordion (low pitch) to a bottom side of the accordion (high pitch).

The four rows of buttons 210 include the first column 212 of octave 1. The first continuous four pitches X, X+1, X+2 and X+3 are assigned to the first column 212 of octave 1 such that the first continuous four pitches X, X+1, X+2 and X+3 become higher in order in a direction away from the bellow 300.

The four rows of buttons 210 include the second column 214 of octave 1. The second continuous four pitches X+4, X+5, X+6 and X+7 are assigned to the second column 214 of octave 1 such that the second continuous four pitches X+4, X+5, X+6 and X+7 become higher in order in a direction away from the bellow 300.

The four rows of buttons 210 include the second column 216 of octave 1. The third continuous four pitches X+8, X+9, X+10 and X+11 are assigned to the third column 216 of octave 1 such that the second continuous four pitches X+8, X+9, X+10 and X+11 become higher in order in a direction away from the bellow 300.

The four rows of buttons 210 further include other columns 218 such as octave 2, octave 3, octave 4, octave 5, and octave 6. That is, the four rows of buttons 210 include a plurality of columns 218 to which a plurality of octaves (octave 2 to octave 6) are assigned such that the plurality of octaves become gradually higher from a top side of the accordion (low pitch) to a bottom side of the accordion (high pitch). Each octave (octave 2 to octave 6) has twelve pitches X to X+11. The twelve pitches X to X+11 of the octave 2 to the octave 6 are assigned in the same manner as the first, second, and third continuous four pitches X to X+11 of the octave 1. However, the twelve pitches X to X+11 of the octave 2 to 6 have different octave from the first, second, and third continuous four pitches X to X+11 of the octave 1.

The four rows of buttons 210 further include other column 211. Continuous four pitches X+8, X+9, X+10 and X+11 are assigned to the column 211. The continuous four pitches X+8, X+9, X+10 and X+11 of the column 211 form octave 0. The octave 0 is provided a top side of the octave 1. The continuous four pitches X+8, X+9, X+10 and X+11 of the octave 0 are assigned to the column 211 such that the continuous four pitches X+8, X+9, X+10 and X+11 become higher in order in a direction away from the bellow 300.

The four rows of buttons 210 further include other column 219. Continuous four pitches X, X+1, X+2 and X+3 are assigned to the column 219. The continuous four pitches X, X+1, X+2 and X+3 of the column 219 form octave 7. The octave 7 is provided a bottom side of the octave 6. The continuous four pitches X, X+1, X+2 and X+3 of the octave 7 are assigned to the column 219 such that the continuous four pitches X, X+1, X+2 and X+3 become higher in order in a direction away from the bellow 300.

The Note layout-T1 according to the embodiment includes a mechanical accordion and an electronic accordion can adapt to use in the Note layout-T 1. According to this embodiment, if the accordionist wants to play note C, D, E, F, G, A, B or any music Scales or any phase of notes in order using the four rows of buttons 210, the accordionist does not have to twist or move the left hand wrist compared to the prior art. Thus, the accordionist can play the accordion very fast and can play the accordion easily.

Figure 7:
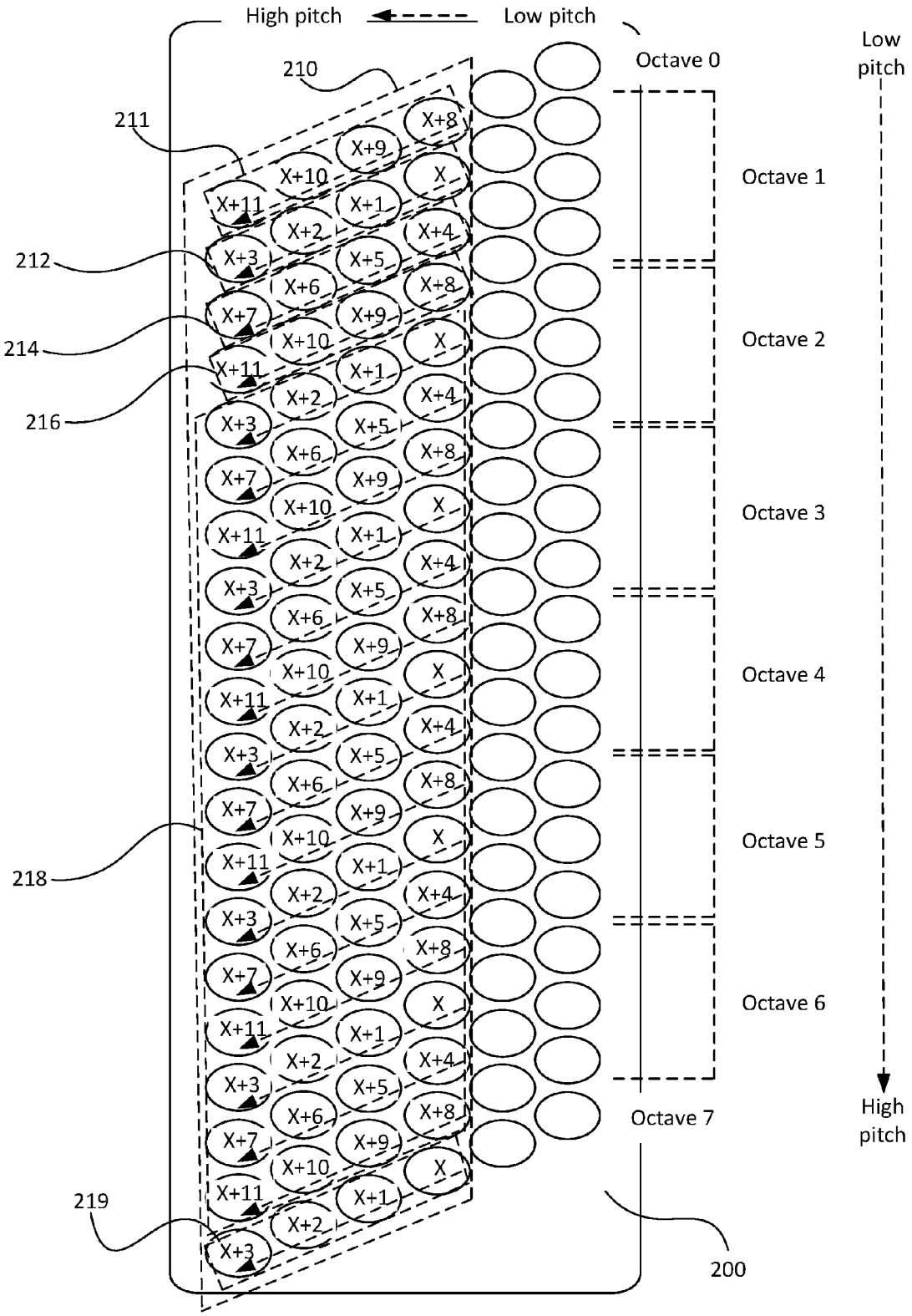
FIG. 7 is a diagram illustrating an example of left hand key note pattern T2 of the present invention

FIG. 7 illustrates an exploded perspective view of a Note layout-T2. As shown in the drawing, the Note layout-T2 according to the embodiment includes four rows of buttons 210 provided on the left hand play side 200. The four rows of buttons 210 are arranged in lines in a direction substantially orthogonal to an expansion and contraction direction of the bellow 300. The four rows of buttons 210 include a first column 212, a second column 214, and a third column 216. First continuous four pitches X, X+1, X+2 and X+3 are assigned to the first column 212. A second column 214 is provided adjacent to the first column 212. Second continuous four pitches X+4, X+5, X+6 and X+7 are assigned to the second column 214. The second continuous four pitches X+4, X+5, X+6 and X+7 are adjacent to the first continuous four pitches X, X+1, X+2 and X+3. Third column 216 is provided adjacent to the second column 214. Third continuous four pitches X+8, X+9, X+10 and X+11 are assigned to the third column 216. The third continuous four pitches X+8, X+9, X+10 and X+11 are adjacent to the second continuous four pitches X+4, X+5, X+6 and X+7. In this example, the twelve pitches X to X+11 of the first column 212, the second column 214, and the third column 216 form octave 1. The four rows of buttons 210 include 8 octaves (octave 0, octave 1, octave 2, octave 3, octave 4, octave 5, octave 6 and octave 7). These 8 octaves are arranged in lines in a direction from a top side of the accordion (low pitch) to a bottom side of the accordion (high pitch).

The four rows of buttons 210 include the first column 212 of octave 1. The first continuous four pitches X, X+1, X+2 and X+3 are assigned to the first column 212 of octave 1 such that the first continuous four pitches X, X+1, X+2 and X+3 become higher in order in a direction approaching to the bellow 300.

The four rows of buttons 210 include the second column 214 of octave 1. The second continuous four pitches X+4, X+5, X+6 and X+7 are assigned to the second column 214 of octave 1 such that the second continuous four pitches X+4, X+5, X+6 and X+7 become higher in order in a direction approaching to the bellow 300.

The four rows of buttons 210 include the third column 216 of octave 1. The third continuous four pitches X+8, X+9, X+10 and X+11 are assigned to the third column 216 of octave 1 such that the third continuous four pitches X+8, X+9, X+10 and X+11 become higher in order in a direction approaching to the bellow 300.

The four rows of buttons 210 further include other columns 218 such as octave 2, octave 3, octave 4, octave 5, and octave 6. That is, the four rows of buttons 210 include a plurality of columns 218 to which a plurality of octaves (octave 2 to octave 6) are assigned such that the plurality of octaves become gradually higher from a top side of the accordion (low pitch) to a bottom side of the accordion (high pitch). Each octave (octave 2 to octave 6) has twelve pitches X to X+11. The twelve pitches X to X+11 of the octave 2 to the octave 6 are assigned in the same manner as the first, second, and third continuous four pitches X to X+11 of the octave 1. However, the twelve pitches X to X+11 of the octave 2 to 6 have different octave from the first, second, and third continuous four pitches X to X+11 of the octave 1.

The four rows of buttons 210 further include other column 211. Continuous four pitches X+8, X+9, X+10 and X+11 are assigned to the column 211. The continuous four pitches X+8, X+9, X+10 and X+11 of the column 211 form octave 0. The octave 0 is provided a top side of the octave 1. The continuous four pitches X+8, X+9, X+10 and X+11 of the octave 0 are assigned to the column 211 such that the continuous four pitches X+8, X+9, X+10 and X+11 become higher in order in a direction approaching to the bellow 300.

The four rows of buttons 210 further include other column 219. Continuous four pitches X, X+1, X+2 and X+3 are assigned to the column 219. The continuous four pitches X, X+1, X+2 and X+3 of the column 219 form octave 7. The octave 7 is provided a bottom side of the octave 6. The continuous four pitches X, X+1, X+2 and X+3 of the octave 7 are assigned to the column 219 such that the continuous four pitches X, X+1, X+2 and X+3 become higher in order in a direction approaching to the bellow 300.

The Note layout-T2 according to the embodiment includes a mechanical accordion and an electronic accordion can adapt to use in the Note layout-T2. According to this embodiment, if the accordionist wants to play note C, D, E, F, G, A, B or any music Scales or any phase of notes in order using the four rows of buttons 210, the accordionist does not have to twist or move the left hand wrist compare to the prior art. Thus, the accordionist can play the accordion very fast and can play the accordion easily.

Figure 8:
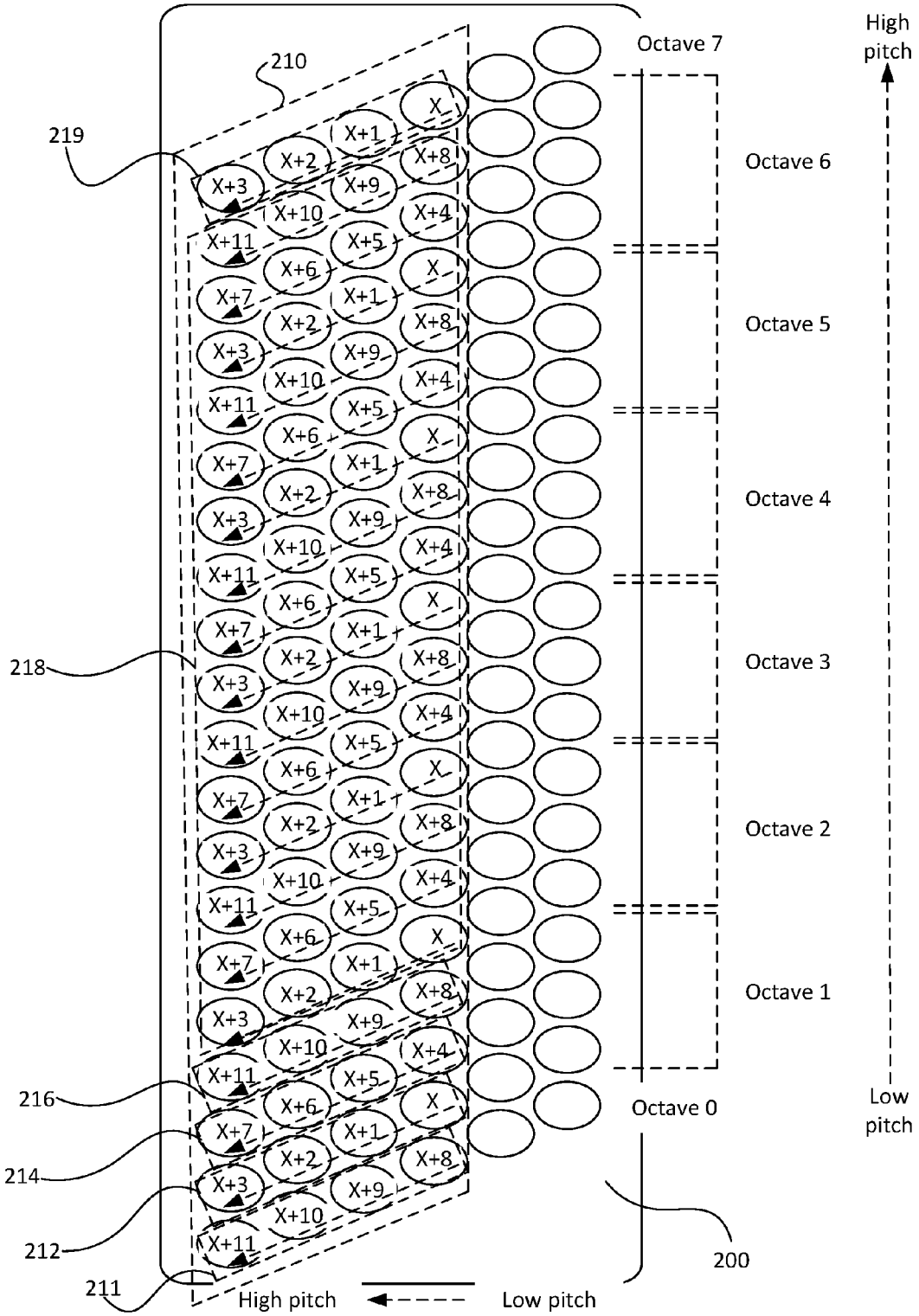
FIG. 8 is a diagram illustrating an example of left hand key note pattern T3 of the present invention

FIG. 8 illustrates an exploded perspective view of a Note layout-T3. As shown in the drawing, the Note layout-T3 according to the embodiment includes four rows of buttons 210 provided on the left hand plays side 200. The four rows of buttons 210 are arranged in lines in a direction substantially orthogonal to an expansion and contraction direction of the bellow 300. The four rows of buttons 210 include a first column 212, a second column 214, and a third column 216. First continuous four pitches X, X+1, X+2 and X+3 are assigned to the first column 212. A second column is provided adjacent to the first column 212. Second continuous four pitches X+4, X+5, X+6 and X+7 are assigned to the second column 214. The second continuous four pitches X+4, X+5, X+6 and X+7 are adjacent to the first continuous four pitches X, X+1, X+2 and X+3. Third column 216 is provided adjacent to the second column 214. Third continuous four pitches X+8, X+9, X+10 and X+11 are assigned to the third column 216. The third continuous four pitches X+8, X+9, X+10 and X+11 are adjacent to the second continuous four pitches X+4, X+5, X+6 and X+7. In this example, the twelve pitches X to X+11 of the first column 212, the second column 214, and the third column 216 form octave 1. The four rows of buttons 210 include 8 octaves (octave 0, octave 1, octave 2, octave 3, octave 4, octave 5, octave 6 and octave 7). These 8 octaves are arranged in lines in a direction from a bottom side of the accordion (low pitch) to a top side of the accordion (high pitch).

The four rows of buttons 210 include the first column 212 of octave 1. The first continuous four pitches X, X+1, X+2 and X+3 are assigned to the first column 212 of octave 1 such that the first continuous four pitches X, X+1, X+2 and X+3 become higher in order in a direction approaching to the bellow 300.

The four rows of buttons 210 include the second column 214 of octave 1. The second continuous four pitches X+4, X+5, X+6 and X+7 are assigned to the second column 214 of octave 1 such that the second continuous four pitches X+4, X+5, X+6 and X+7 become higher in order in a direction approaching to the bellow 300.

The four rows of buttons 210 include the third column 216 of octave 1. The third continuous four pitches X+8, X+9, X+10 and X+11 are assigned to the third column 216 of octave 1 such that the third continuous four pitches X+8, X+9, X+10 and X+11 become higher in order in a direction approaching to the bellow 300.

The four rows of buttons 210 further include other columns 218 such as octave 2, octave 3, octave 4, octave 5, and octave 6. That is, the four rows of buttons 210 include a plurality of columns 218 to which a plurality of octaves (octave 2 to octave 6) are assigned such that the plurality of octaves become gradually higher from a bottom side of the accordion (low pitch) to a top side of the accordion (high pitch). Each octave (octave 2 to octave 6) has twelve pitches X to X+11. The twelve pitches X to X+11 of the octave 2 to the octave 6 are assigned in the same manner as the first, second, and third continuous four pitches X to X+11 of the octave 1. However, the twelve pitches X to X+11 of the octave 2 to 6 have different octave from the first, second, and third continuous four pitches X to X+11 of the octave 1.

The four rows of buttons 210 further include other column 211. Continuous four pitches X+8, X+9, X+10 and X+11 are assigned to the column 211. The continuous four pitches X+8, X+9, X+10 and X+11 of the column 211 form octave 0. The octave 0 is provided a top side of the octave 1. The continuous four pitches X+8, X+9, X+10 and X+11 of the octave 0 are assigned to the column 211 such that the continuous four pitches X+8, X+9, X+10 and X+11 become higher in order in a direction approaching to the bellow 300.

The four rows of buttons 210 further include other column 219. Continuous four pitches X, X+1, X+2 and X+3 are assigned to the column 219. The continuous four pitches X, X+1, X+2 and X+3 of the column 219 form octave 7. The octave 7 is provided a bottom side of the octave 6. The continuous four pitches X, X+1, X+2 and X+3 of the octave 7 are assigned to the column 219 such that the continuous four pitches X, X+1, X+2 and X+3 become higher in order in a direction approaching to the bellow 300.

The Note layout-T3 according to the embodiment includes a mechanical accordion and an electronic accordion can adapt to use in the Note layout-T3. According to this embodiment, if the accordionist wants to play note C, D, E, F, G, A, B or any music Scales or any phase of notes in order using the four rows of buttons 210, the accordionist does not have to twist or move the left hand wrist compared to the prior art. Thus, the accordionist can play the accordion very fast and can play the accordion easily.

Figure 9:
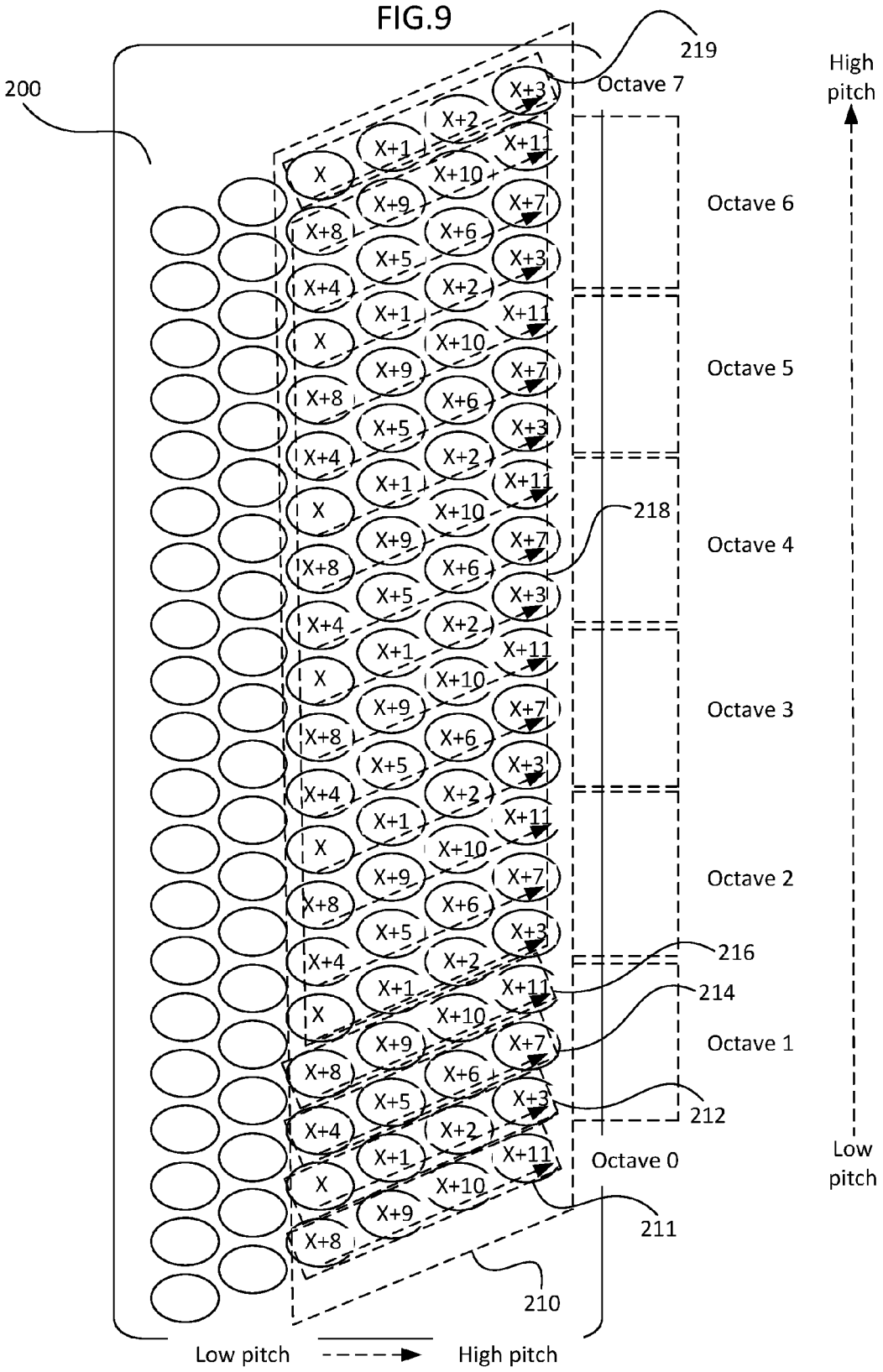
FIG. 9 is a diagram illustrating an example of left hand key note pattern T4 of the present invention

FIG. 9 illustrates an exploded perspective view of a Note layout-T4. As shown in the drawing, the Note layout-T4 according to the embodiment includes four rows of buttons 210 provided on the left hand plays side 200. The four rows of buttons 210 are arranged in lines in a direction substantially orthogonal to an expansion and contraction direction of the bellow 300. The four rows of buttons 210 include a first column 212, a second column 214, and a third column 216. First continuous four pitches X, X+1, X+2 and X+3 are assigned to the first column 212. A second column 214 is provided adjacent to the first column 212. Second continuous four pitches X+4, X+5, X+6 and X+7 are assigned to the second column 214. The second continuous four pitches X+4, X+5, X+6 and X+7 are adjacent to the first continuous four pitches X, X+1, X+2 and X+3. Third column 216 is provided adjacent to the second column 214. Third continuous four pitches X+8, X+9, X+10 and X+11 are assigned to the third column 216. The third continuous four pitches X+8, X+9, X+10 and X+11 are adjacent to the second continuous four pitches X+4, X+5, X+6 and X+7. In this example, the twelve pitches X to X+11 of the first column 212, the second column 214, and the third column 216 form octave 1. The four rows of buttons 210 include 8 octaves (octave 0, octave 1, octave 2, octave 3, octave 4, octave 5, octave 6 and octave 7). These 8 octaves are arranged in lines in a direction from a bottom side of the accordion (low pitch) to a top side of the accordion (high pitch).

The four rows of buttons 210 include the first column 212 of octave 1. The first continuous four pitches X, X+1, X+2 and X+3 are assigned to the first column 212 of octave 1 such that the first continuous four pitches X, X+1, X+2 and X+3 become higher in order in a direction away from the bellow 300.

The four rows of buttons 210 include the second column 214 of octave 1. The second continuous four pitches X+4, X+5, X+6 and X+7 are assigned to the second column 214 of octave 1 such that the second continuous four pitches X+4, X+5, X+6 and X+7 become higher in order in a direction away from the bellow 300.

The four rows of buttons 210 include the third column 216 of octave 1. The third continuous four pitches X+8, X+9, X+10 and X+11 are assigned to the third column 216 of octave 1 such that the third continuous four pitches X+8, X+9, X+10 and X+11 become higher in order in a direction away from the bellow 300.

The four rows of buttons 210 further include other columns 218 such as octave 2, octave 3, octave 4, octave 5, and octave 6. That is, the four rows of buttons 210 include a plurality of columns 218 to which a plurality of octaves (octave 2 to octave 6) are assigned such that the plurality of octaves become gradually higher from a bottom side of the accordion (low pitch) to a top side of the accordion (high pitch). Each octave (octave 2 to octave 6) has twelve pitches X to X+11. The twelve pitches X to X+11 of the octave 2 to the octave 6 are assigned in the same manner as the first, second, and third continuous four pitches X to X+11 of the octave 1. However, the twelve pitches X to X+11 of the octave 2 to 6 have different octave from the first, second, and third continuous four pitches X to X+11 of the octave 1.

The four rows of buttons 210 further include other column 211. Continuous four pitches X+8, X+9, X+10 and X+11 are assigned to the column 211. The continuous four pitches X+8, X+9, X+10 and X+11 of the column 211 form octave 0. The octave 0 is provided a top side of the octave 1. The continuous four pitches X+8, X+9, X+10 and X+11 of the octave 0 are assigned to the column 211 such that the continuous four pitches X+8, X+9, X+10 and X+11 become higher in order in a direction away from the bellow 300.

The four rows of buttons 210 further include other column 219. Continuous four pitches X, X+1, X+2 and X+3 are assigned to the column 219. The continuous four pitches X, X+1, X+2 and X+3 of the column 219 form octave 7. The octave 7 is provided a bottom side of the octave 6. The continuous four pitches X, X+1, X+2 and X+3 of the octave 7 are assigned to the column 219 such that the continuous four pitches X, X+1, X+2 and X+3 become higher in order in a direction away from the bellow 300.

The Note layout-T4 according to the embodiment includes a mechanical accordion and an electronic accordion can adapt to use in the Note layout-T4. According to this embodiment, if the accordionist wants to play note C, D, E, F, G, A, B or any music Scales or any phase of notes in order using the four rows of buttons 210, the accordionist does not have to twist or move the left hand wrist compared to the prior art. Thus, the accordionist can play the accordion very fast and can play the accordion easily.

Figure 10:
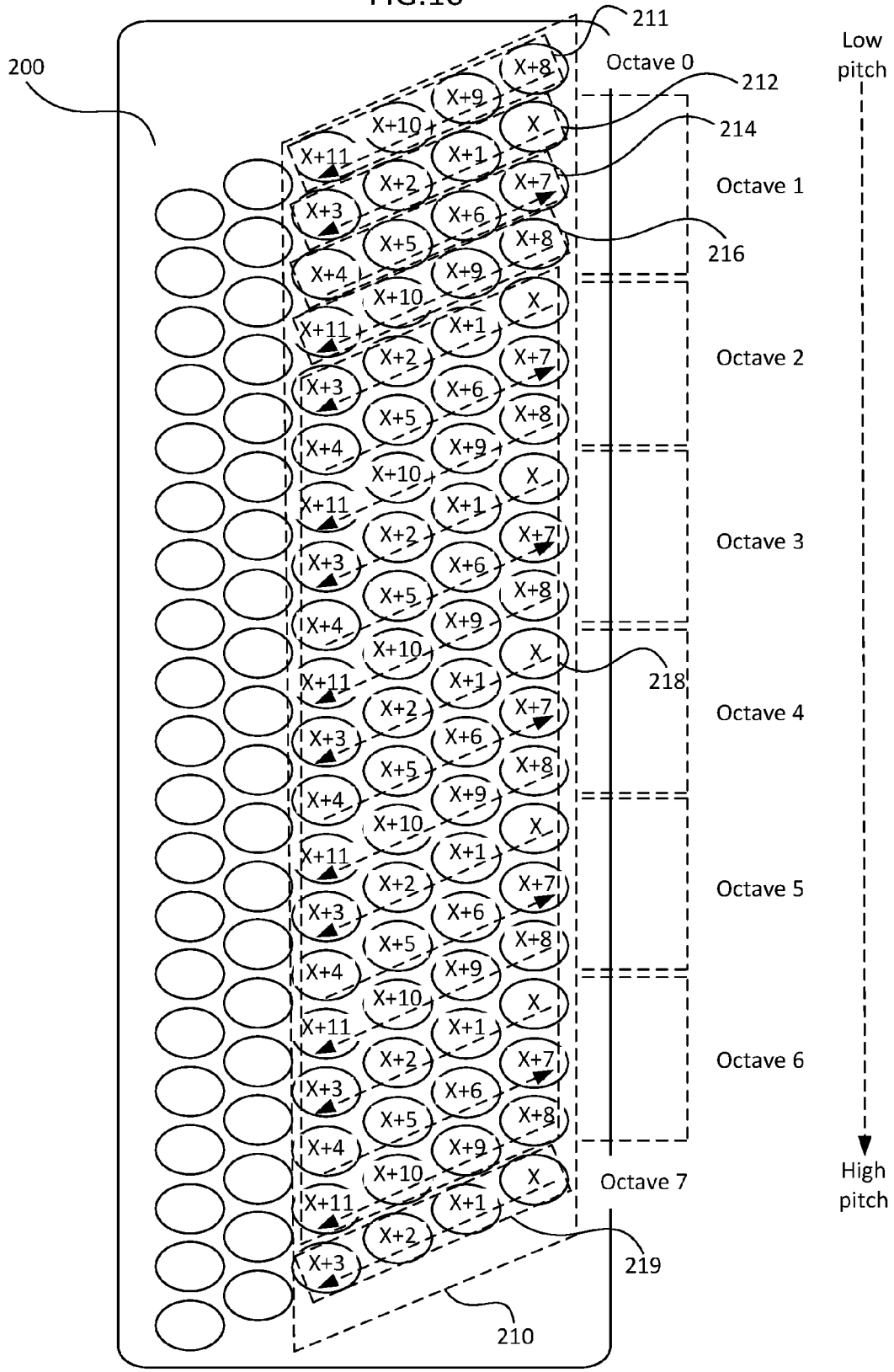
FIG. 10 is a diagram illustrating an example of left hand key note pattern A of the present invention

FIG. 10 illustrates an exploded perspective view of a Note layout-A. As shown in the drawing, the Note layout-A according to the embodiment includes four rows of buttons 210 provided on the left hand plays side 200. The four rows of buttons 210 are arranged in lines in a direction substantially orthogonal to an expansion and contraction direction of the bellow 300. The four rows of buttons 210 include a first column 212, a second column 214, and a third column 216. First continuous four pitches X+8, X+9, X+10 and X+11 are assigned to the first column 212. A second column is provided adjacent to the first column 212. Second continuous four pitches X+4, X+5, X+6 and X+7 are assigned to the second column 214. The second continuous four pitches are X+4, X+5, X+6 and X+7 adjacent to the first continuous four pitches X, X+1, X+2 and X+3. Third column 216 is provided adjacent to the second column 214. Third continuous four pitches X+8, X+9, X+10 and X+11 are assigned to the third column 216. The third continuous four pitches X+8, X+9, X+10 and X+11 are adjacent to the second continuous four pitches X+4, X+5, X+6 and X+7. In this example, the twelve pitches X to X+11 of the first column 212, the second column 214, and the third column 216 form octave 1. The four rows of buttons 210 include 8 octaves (octave 0, octave 1, octave 2, octave 3, octave 4, octave 5, octave 6 and octave 7). These 8 octaves are arranged in lines in a direction from a top side of the accordion (low pitch) to a bottom side of the accordion (high pitch).

The four rows of buttons 210 include the first column 212 of octave 1. The first continuous four pitches X, X+1, X+2 and X+3 are assigned to the first column 212 of octave 1 such that the first continuous four pitches X, X+1, X+2 and X+3 become higher in order in a direction approaching to the bellow 300.

The four rows of buttons 210 include the second column 214 of octave 1. The second continuous four pitches X+4, X+5, X+6 and X+7 are assigned to the second column 214 of octave 1 such that the second continuous four pitches X+4, X+5, X+6 and X+7 become higher in order in a direction away from the bellow 300.

The four rows of buttons 210 include the third column 216 of octave 1. The third continuous four pitches X+8, X+9, X+10 and X+11 are assigned to the third column 216 of octave 1 such that the third continuous four pitches X+8, X+9, X+10 and X+11 become higher in order in a direction approaching to the bellow 300.

The four rows of buttons 210 further include other columns 218 such as octave 2, octave 3, octave 4, octave 5, and octave 6. That is, the four rows of buttons 210 include a plurality of columns 218 to which a plurality of octaves (octave 2 to octave 6) are assigned such that the plurality of octaves become gradually higher from a top side of the accordion (low pitch) to a bottom side of the accordion (high pitch). Each octave (octave 2 to octave 6) has twelve pitches X to X+11. The twelve pitches X to X+11 of the octave 2 to the octave 6 are assigned in the same manner as the first, second, and third continuous four pitches X to X+11 of the octave 1. However, the twelve pitches X to X+11 of the octave 2 to 6 have different octave from the first, second, and third continuous four pitches X to X+11 of the octave 1.

The four rows of buttons 210 further include other column 211. Continuous four pitches X+8, X+9, X+10 and X+11 are assigned to the column 211. The continuous four pitches X+8, X+9, X+10 and X+11 of the column 211 form octave 0. The octave 0 is provided a top side of the octave 1. The continuous four pitches X+8, X+9, X+10 and X+11 of the octave 0 are assigned to the column 211 such that the continuous four pitches X+8, X+9, X+10 and X+11 become higher in order in a direction approaching to the bellow 300.

The four rows of buttons 210 further include other column 219. Continuous four pitches X, X+1, X+2 and X+3 are assigned to the column 219. The continuous four pitches X, X+1, X+2 and X+3 of the column 219 form octave 7. The continuous four pitches X, X+1, X+2 and X+3 of the octave 7 are assigned to the column 219 such that the continuous four pitches X, X+1, X+2 and X+3 become higher in order in a direction approaching to the bellow 300.

The Note layout-A according to the embodiment includes a mechanical accordion and an electronic accordion can adapt to use in the Note layout-A. According to this embodiment, if the accordionist wants to play note C, D, E, F, G, A, B or any music Scales or any phase of notes in order using the four rows of buttons 210, the accordionist does not have to twist or move the left hand wrist compared to the prior art. Thus, the accordionist can play the accordion very fast and can play the accordion easily.

Figure 11:
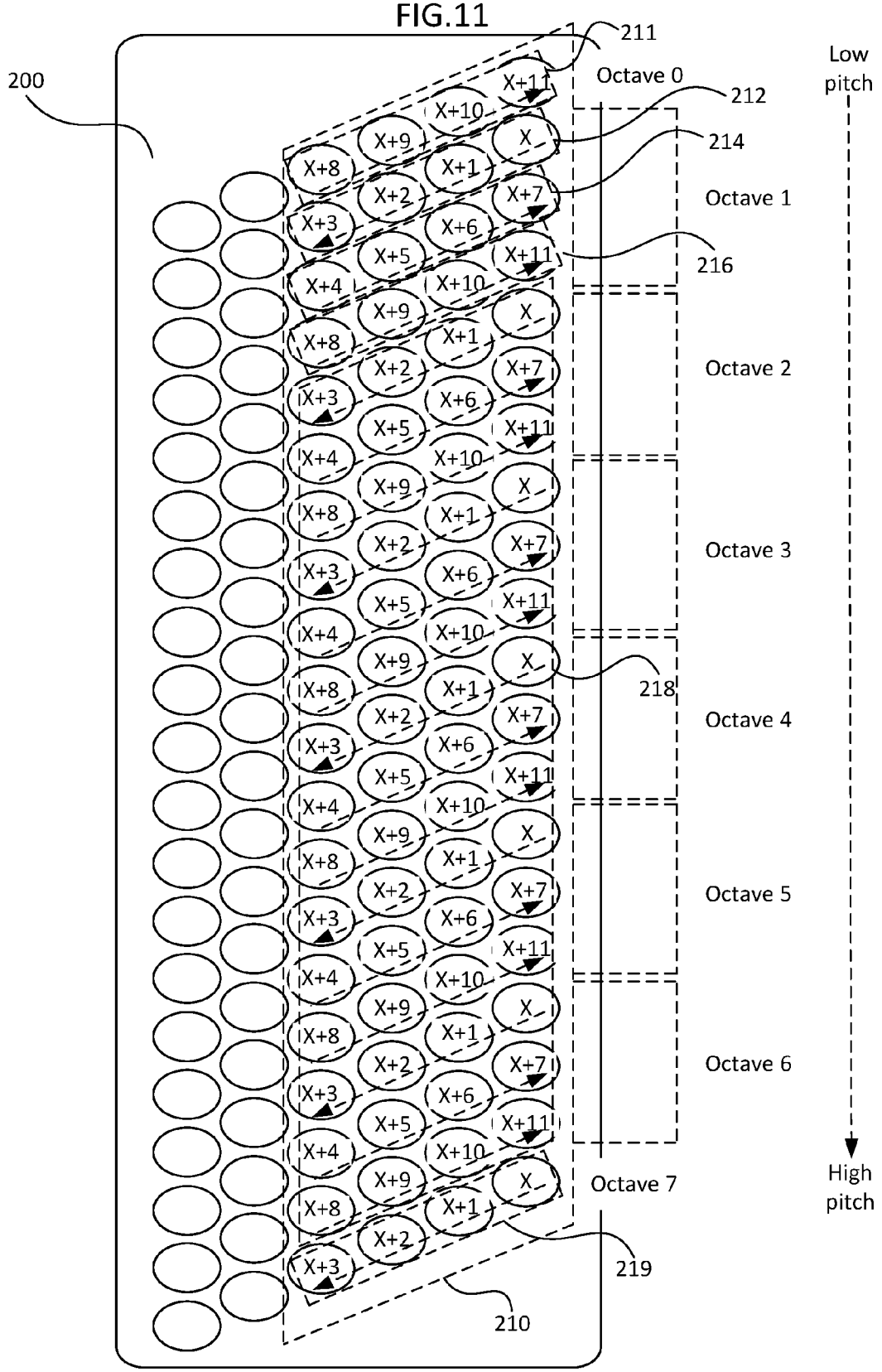
FIG. 11 is a diagram illustrating an example of left hand key note pattern B of the present invention

FIG. 11 illustrates an exploded perspective view of a Note layout-B. As shown in the drawing, the Note layout-B according to the embodiment includes four rows of buttons 210 provided on the left hand plays side 200. The four rows of buttons 210 are arranged in lines in a direction substantially orthogonal to an expansion and contraction direction of the bellow 300. The four rows of buttons 210 include a first column 212, a second column 214, and a third column 216. First continuous four pitches X, X+1, X+2 and X+3 are assigned to the first column 212. A second column is provided adjacent to the first column 212. Second continuous four pitches X+4, X+5, X+6 and X+7 are assigned to the second column 214. The second continuous four pitches are X+4, X+5, X+6 and X+7 adjacent to the first continuous four pitches X, X+1, X+2 and X+3. Third column 216 is provided adjacent to the second column 214. Third continuous four pitches X+8, X+9, X+10 and X+11 are assigned to the third column 216. The third continuous four pitches X+8, X+9, X+10 and X+11 are adjacent to the second continuous four pitches X+4, X+5, X+6 and X+7. In this example, the twelve pitches X to X+11 of the first column 212, the second column 214, and the third column 216 form octave 1. The four rows of buttons 210 include 8 octaves (octave 0, octave 1, octave 2, octave 3, octave 4, octave 5, octave 6 and octave 7). These 8 octaves are arranged in lines in a direction from a top side of the accordion (low pitch) to a bottom side of the accordion (high pitch).

The four rows of buttons 210 include the first column 212 of octave 1. The first continuous four pitches X, X+1, X+2 and X+3 are assigned to the first column 212 of octave 1 such that the first continuous four pitches X, X+1, X+2 and X+3 become higher in order in a direction approaching to the bellow 300.

The four rows of buttons 210 include the second column 214 of octave 1. The second continuous four pitches X+4, X+5, X+6 and X+7 are assigned to the second column 214 of octave 1 such that the second continuous four pitches X+4, X+5, X+6 and X+7 become higher in order in a direction away from the bellow 300.

The four rows of buttons 210 include the third column 216 of octave 1. The third continuous four pitches X+8, X+9, X+10 and X+11 are assigned to the third column 216 of octave 1 such that the third continuous four pitches X+8, X+9, X+10 and X+11 become higher in order in a direction away from the bellow 300.

The four rows of buttons 210 further include other columns 218 such as octave 2, octave 3, octave 4, octave 5, and octave 6. That is, the four rows of buttons 210 include a plurality of columns 218 to which a plurality of octaves (octave 2 to octave 6) are assigned such that the plurality of octaves become gradually higher from a top side of the accordion (low pitch) to a bottom side of the accordion (high pitch). Each octave (octave 2 to octave 6) has twelve pitches X to X+11. The twelve pitches X to X+11 of the octave 2 to the octave 6 are assigned in the same manner as the first, second, and third continuous four pitches X to X+11 of the octave 1. However, the twelve pitches X to X+11 of the octave 2 to 6 have different octave from the first, second, and third continuous four pitches X to X+11 of the octave 1.

The four rows of buttons 210 further include other column 211. Continuous four pitches X+8, X+9, X+10 and X+11 are assigned to the column 211. The continuous four pitches X+8, X+9, X+10 and X+11 of the column 211 form octave 0. The octave 0 is provided a top side of the octave 1. The continuous four pitches X+8, X+9, X+10 and X+11 of the octave 0 are assigned to the column 211 such that the continuous four pitches X+8, X+9, X+10 and X+11 become higher in order in a direction away from the bellow 300.

The four rows of buttons 210 further include other column 219. Continuous four pitches X, X+1, X+2 and X+3 are assigned to the column 219. The continuous four pitches X, X+1, X+2 and X+3 of the column 219 form octave 7. The octave 7 is provided a bottom side of the octave 6. The continuous four pitches X, X+1, X+2 and X+3 of the octave 7 are assigned to the column 219 such that the continuous four pitches X, X+1, X+2 and X+3 become higher in order in a direction approaching to the bellow 300.

The Note layout-B according to the embodiment includes a mechanical accordion and an electronic accordion can adapt to use in the Note layout-B. According to this embodiment, if the accordionist wants to play note C, D, E, F, G, A, B or any music Scales or any phase of notes in order using the four rows of buttons 210, the accordionist does not have to twist or move the left hand wrist compared to the prior art. Thus, the accordionist can play the accordion very fast and can play the accordion easily.

Figure 12:
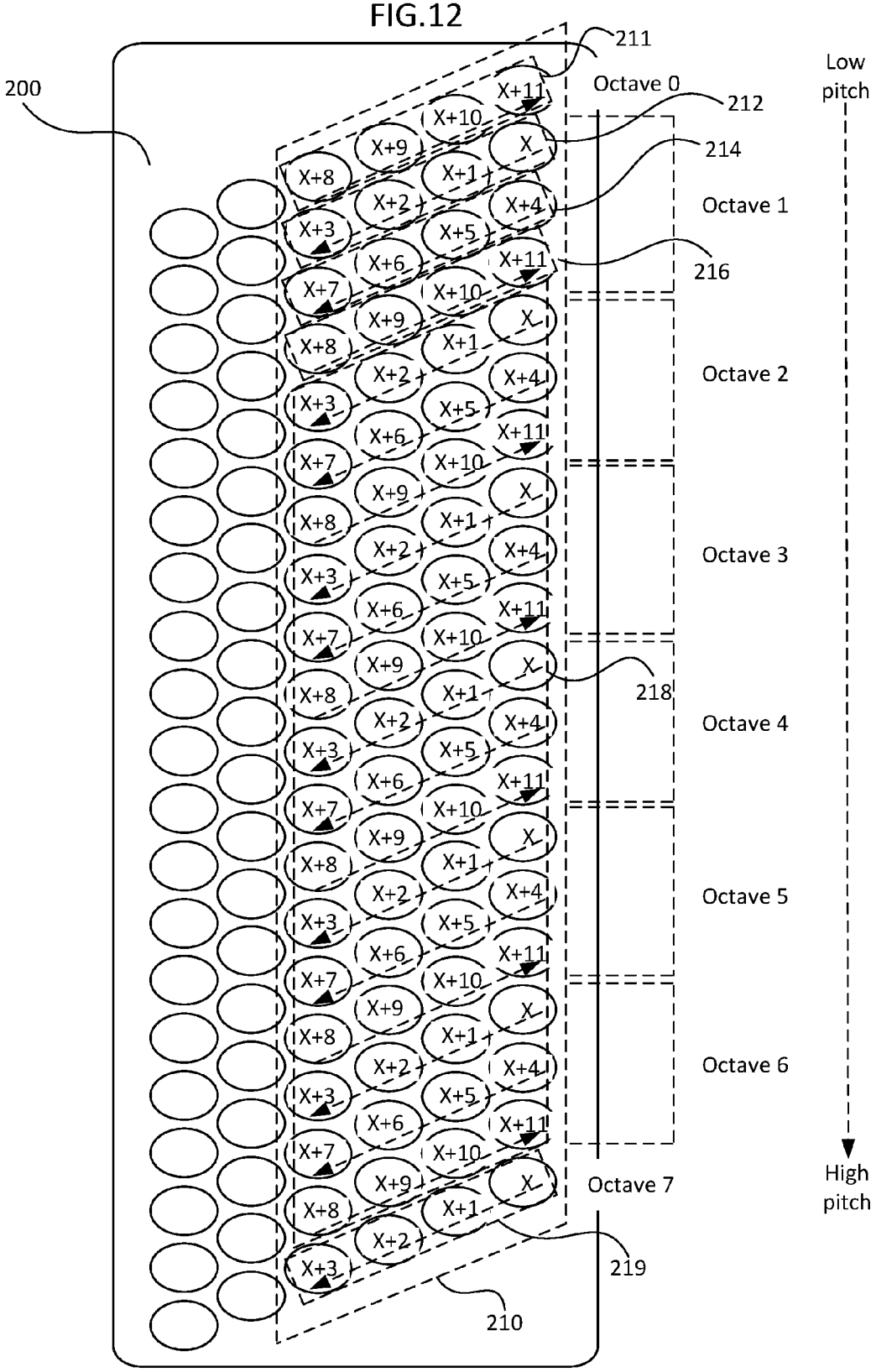
FIG. 12 is a diagram illustrating an example of left hand key note pattern C of the present invention

FIG. 12 illustrates an exploded perspective view of a Note layout-C. As shown in the drawing, the Note layout-C according to the embodiment includes four rows of buttons 210 provided on the left hand plays side 200. The four rows of buttons 210 are arranged in lines in a direction substantially orthogonal to an expansion and contraction direction of the bellow 300. The four rows of buttons 210 include a first column 212, a second column 214, and a third column 216. First continuous four pitches X, X+1, X+2 and X+3 are assigned to the first column 212. A second column is provided adjacent to the first column 212. Second continuous four pitches X+4, X+5, X+6 and X+7 are assigned to the second column 214. The second continuous four pitches are X+4, X+5, X+6 and X+7 adjacent to the first continuous four pitches X, X+1, X+2 and X+3. Third column 216 is provided adjacent to the second column 214. Third continuous four pitches X+8, X+9, X+10 and X+11 are assigned to the third column 216. The third continuous four pitches X+8, X+9, X+10 and X+11 are adjacent to the second continuous four pitches X+4, X+5, X+6 and X+7. In this example, the twelve pitches X to X+11 of the first column 212, the second column 214, and the third column 216 form octave 1. The four rows of buttons 210 include 8 octaves (octave 0, octave 1, octave 2, octave 3, octave 4, octave 5, octave 6 and octave 7). These 8 octaves are arranged in lines in a direction from a top side of the accordion (low pitch) to a bottom side of the accordion (high pitch).

The four rows of buttons 210 include the first column 212 of octave 1. The first continuous four pitches X, X+1, X+2 and X+3 are assigned to the first column 212 of octave 1 such that the first continuous four pitches X, X+1, X+2 and X+3 become higher in order in a direction approaching to the bellow 300.

The four rows of buttons 210 include the second column 214 of octave 1. The second continuous four pitches X+4, X+5, X+6 and X+7 are assigned to the second column 214 of octave 1 such that the second continuous four pitches X+4, X+5, X+6 and X+7 become higher in order in a direction approaching to the bellow 300.

The four rows of buttons 210 include the third column 216 of octave 1. The third continuous four pitches X+8, X+9, X+10 and X+11 are assigned to the third column 216 of octave 1 such that the third continuous four pitches X+8, X+9, X+10 and X+11 become higher in order in a direction away from the bellow 300.

The four rows of buttons 210 further include other columns 218 such as octave 2, octave 3, octave 4, octave 5, and octave 6. That is, the four rows of buttons 210 include a plurality of columns 218 to which a plurality of octaves (octave 2 to octave 6) are assigned such that the plurality of octaves become gradually higher from a top side of the accordion (low pitch) to a bottom side of the accordion (high pitch). Each octave (octave 2 to octave 6) has twelve pitches X to X+11. The twelve pitches X to X+11 of the octave 2 to the octave 6 are assigned in the same manner as the first, second, and third continuous four pitches X to X+11 of the octave 1. However, the twelve pitches X to X+11 of the octave 2 to 6 have different octave from the first, second, and third continuous four pitches X to X+11 of the octave 1.

The four rows of buttons 210 further include other column 211. Continuous four pitches X+8, X+9, X+10 and X+11 are assigned to the column 211. The continuous four pitches X+8, X+9, X+10 and X+11 of the column 211 form octave 0. The octave 0 is provided a top side of the octave 1. The continuous four pitches X+8, X+9, X+10 and X+11 of the octave 0 are assigned to the column 211 such that the third continuous four pitches X+8, X+9, X+10 and X+11 become higher in order in a direction away from the bellow 300.

The four rows of buttons 210 further include other column 219. Continuous four pitches X, X+1, X+2 and X+3 are assigned to the column 219. The continuous four pitches X, X+1, X+2 and X+3 of the column 219 form octave 7. The octave 7 is provided a bottom side of the octave 6. The continuous four pitches X, X+1, X+2 and X+3 of the octave 7 are assigned to the column 219 such that the continuous four pitches X, X+1, X+2 and X+3 become higher in order in a direction approaching to the bellow 300.

The Note layout-C according to the embodiment includes a mechanical accordion and an electronic accordion can adapt to use in the Note layout-C. According to this embodiment, if the accordionist wants to play note C, D, E, F, G, A, B or any music Scales or any phase of notes in order using the four rows of buttons 210, the accordionist does not have to twist or move the left hand wrist compared to the prior art. Thus, the accordionist can play the accordion very fast and can play the accordion easily.

Figure 13:
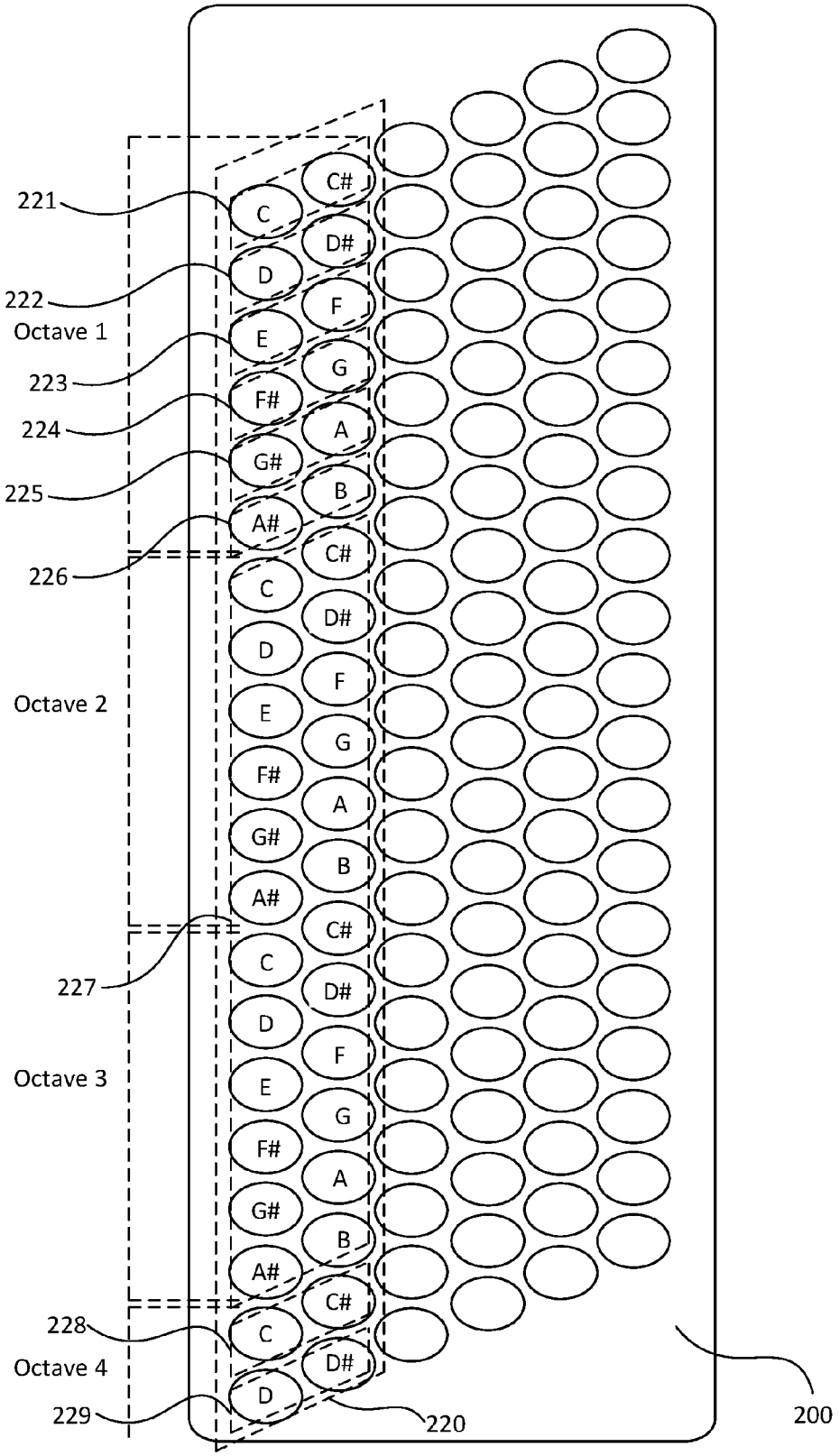
FIG. 13 is a diagram illustrating an example of left hand key note pattern N of the present invention

FIG. 13 illustrate an exploded perspective view of a Note layout-N. As shown in the drawing, the Note layout-N according to the embodiment includes two rows of buttons 220. The two rows of buttons 220 are arranged in lines in a direction substantially orthogonal to an expansion and contraction direction of the bellow 330. The two rows of buttons 220 are provided adjacent to the bellow 300 side of the four rows of buttons 210. However, the two rows of buttons 220 can be provided opposite bellow 300 side of the four rows of buttons 210. The two rows of buttons 220 include a first column 221, a second column 222, a third column 223, a forth column 224, a fifth column 225, and a sixth column 226. First continuous two pitches C and C# are assigned to the first column 221. The second column 222 is provided adjacent to the first column 221 of the two rows of buttons 220. Second continuous two pitches D and D# are assigned to the second column 222. The second continuous two pitches D and D# are adjacent to the first continuous two pitches C and C#. The third column 223 is provided adjacent to the second column 222 of the two rows of buttons 220. Third continuous two pitches E and F are assigned to the third column 223. The third continuous two pitches E and F are adjacent to the second continuous two pitches D and D#. The fourth column 224 is provided adjacent to the third column 223 of the two rows of buttons 220. Fourth continuous two pitches F# and G are assigned to the fourth column 224. The fourth continuous two pitches F# and G are adjacent to the third continuous two pitches E and F. The fifth column 225 is provided adjacent to the fourth column 224 of the two rows of buttons 220. Fifth continuous two pitches G# and A are assigned to the fifth column 225. The fifth continuous two pitches G# and A are adjacent to the fourth continuous two pitches F# and G. The sixth column 226 is provided adjacent to the fifth column 225 of the two rows of buttons 220. Sixth continuous two pitches A# and B are assigned to the sixth column 226. The sixth continuous two pitches A# and B are adjacent to the fifth continuous two pitches G# and A. The two rows of buttons 220 include 4 octaves (octave 1, octave 2, octave 3 and octave 4). These 4 octaves are arranged in lines in a direction from a top side of the accordion (low pitch) to a bottom side of the accordion (high pitch). The two rows of buttons 220 include a C chromatic Scale. The C chromatic Scale has 12 notes, and uses every half-tone/semitone position. The C chromatic Scale as an example is C, C#, D, D#, E, F, F#, G, 0#, A, A# and B.

The two rows of buttons 220 include the first column 221 of octave 1. The first continuous two pitches C and C# are assigned to the first column 221 of octave 1 such that the first continuous two pitches C and C# become higher in order in a direction away from the bellow 300.

The two rows of buttons 220 include the second column 222 of octave 1. The second continuous two pitches D and D# are assigned such that the second continuous two pitches D and D# become higher in order in a direction away from the bellow 300.

The two rows of buttons 220 include the third column 223 of octave 1. The third continuous two pitches E and F are assigned such that the third continuous two pitches E and F become higher in order in a direction away from the bellow 300.

The two rows of buttons 220 include the fourth column 224 of octave 1. The fourth continuous two pitches F# and G are assigned such that the fourth continuous two pitches F# and G become higher in order in a direction away from the bellow 300.

The two rows of buttons 220 include the fifth column 225 of octave 1. The fifth continuous two pitches G# and A are assigned such that the fifth continuous two pitches G# and A become higher in order in a direction away from the bellow 300.

The two rows of buttons 220 include the sixth column 226 of octave 1. The sixth continuous two pitches A# and B are assigned such that the sixth continuous two pitches A# and B become higher in order in a direction away from the bellow 300.

The two rows of buttons 220 further include other columns 227 such as octave 2, and octave 3. That is, the two rows of buttons 220 include a plurality of columns 227 to which a plurality of octaves (octave 2 and octave 3) are assigned such that the plurality of octaves become gradually higher from a top side of the accordion to a bottom side of the accordion. Each octave (octave 2 and octave 3) has twelve pitches X to X+11. The twelve pitches X to X+11 of the octave 2 and the octave 3 are assigned in the same manner as the first, second, third, fourth, fifth, and sixth continuous two pitches X to X+11 of the octave 1. However, the twelve pitches X to X+11 of the octave 2 and the octave 3 have different octave from the first, second, third, fourth, fifth, and sixth continuous two pitches X to X+11 of the octave 1.

The two rows of buttons 220 further include other columns 228 and 229. Continuous two pitches C and C# are assigned to the column 228. Continuous two pitches D and D# are assigned to the column 229. The continuous two pitches C and C# of the column 228 and the continuous two pitches D and D# of the column 219 form octave 4. The octave 4 is provided a bottom side of the octave 3. The continuous two pitches C and D# are assigned to the column 228 of octave 4 such that the continuous two pitches C and C# become higher in order in a direction away from the bellow 300. The continuous two pitches D and D# are assigned such that the second continuous two pitches D and D# become higher in order in a direction away from the bellow 300.

The Note layout-N according to the embodiment includes a mechanical accordion and an electronic accordion can adapt to use in the Note layout-N. According to this embodiment, if the accordionist wants to play Chromatic Scale (play by haft tone note) in order using the two rows and six columns of buttons 220, the accordionist can play all of 12 notes (C, C#, D, D#, E, F, F#, G, 0#, A, A# and B) in Chromatic Scale compared to the prior art. Thus, the accordionist can play the accordion very fast and can play the accordion easily.

Figure 14:
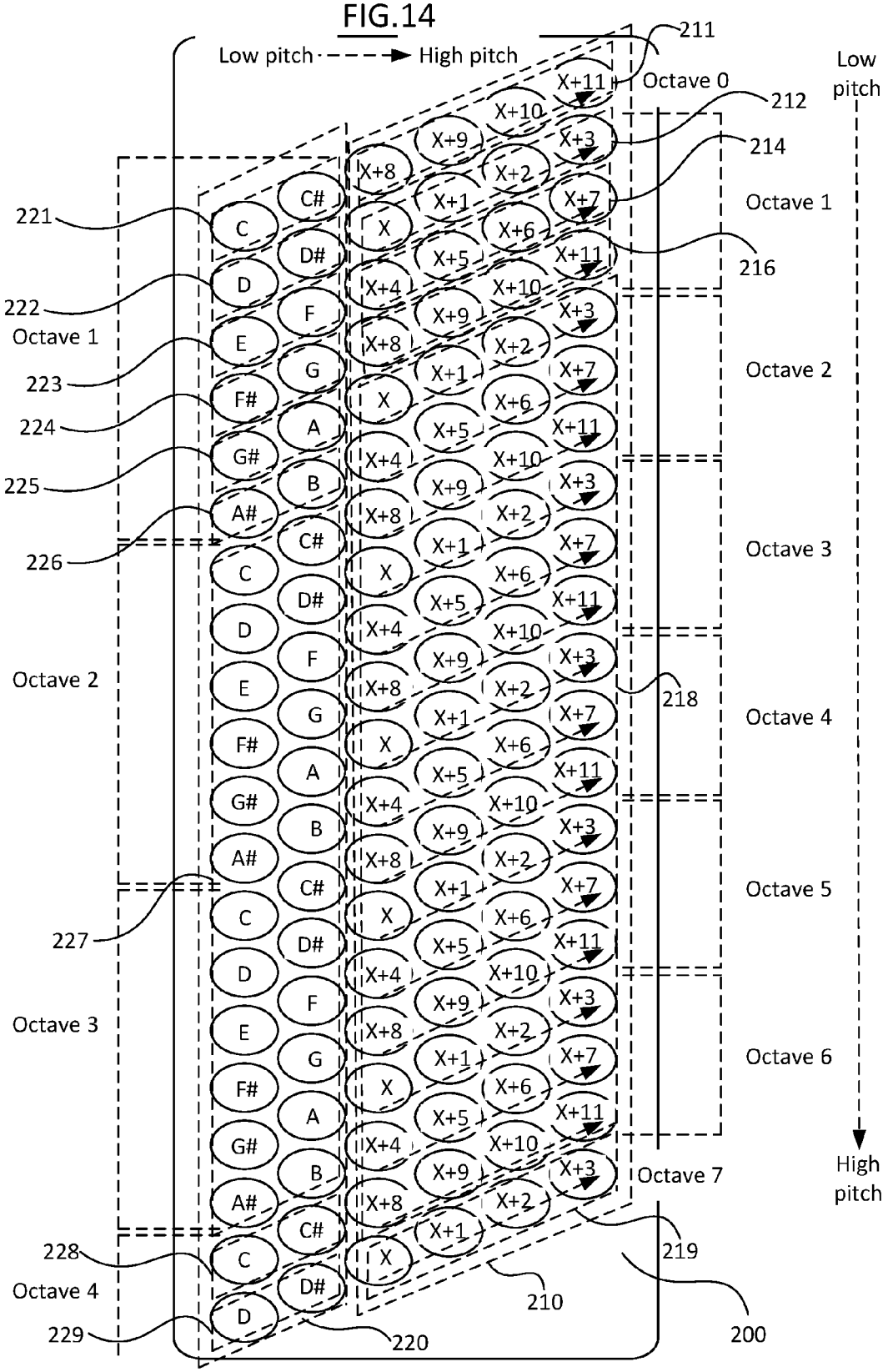
FIG. 14 is a diagram illustrating an example of left hand key note pattern N and T1 of the present invention

FIG. 14 illustrates an exploded perspective view of a Note layout-T1+N. As shown in the drawing, the Note layout-T1+N according to the embodiment include the four rows of buttons 210 and the two rows of buttons 220. The four rows of buttons 210 of FIG. 14 are the same as the four rows of buttons 210 of FIG. 6. The two rows of buttons 220 of FIG. 14 are the same as the four rows of buttons 210 of FIG. 13.

In this embodiment, the Note layout-T1+N can help an accordionist to play a music by play crossover to another octave more easily than the prior art. Moreover, the Note layout-T1+N can play all of many Scales such as Chromatic Scale, Major Scale, Minor Scale, Perfect Fifth Scale and other Scales. Also, Note layout-T1+N can play with many speeds of music such as high tempo music and/or low tempo music. The Note layout-T1+N can solve the problem in the prior art in how to change the speed of music. Furthermore, this embodiment can help the accordionist to move fingers (fingering), better than the prior art. Because, the Note layout-T1+N has a good position of pattern or buttons that can help the accordionist to move finger easily such as the accordionist can move the finger from octave 2 to octave 4 or play a different Scale, such as play in the Perfect Fifth move to Chromatic Scale without stopping or changing a finger's speed.

Thus, this embodiment can solve the limitation of music instrument such as can play the difference Scale and can play crossover to another octave without the conflict on the speed of fingering. Furthermore, in this embodiment can help a beginner learn the accordion easier than the prior art.

The Note layout-T+N according to the embodiment include a mechanical accordion and an electronic accordion can adapt to use in the Note layout-T+N. According to this embodiment, if the accordionist wants to play crossover between two octaves or moreover in order using the two rows and six columns of buttons 220 and the four rows of buttons 210, the accordionist can play crossover between other octaves compared to the prior art. Furthermore, if the accordionist wants to play note C, D, E, F, G, A, B or any music Scales or any phase of notes in order using the four rows of buttons 210, the accordionist does not have to twist or move the left hand wrist compared to the prior art. Thus, the accordionist can play the accordion very fast and can play the accordion easily.

Figure 15:
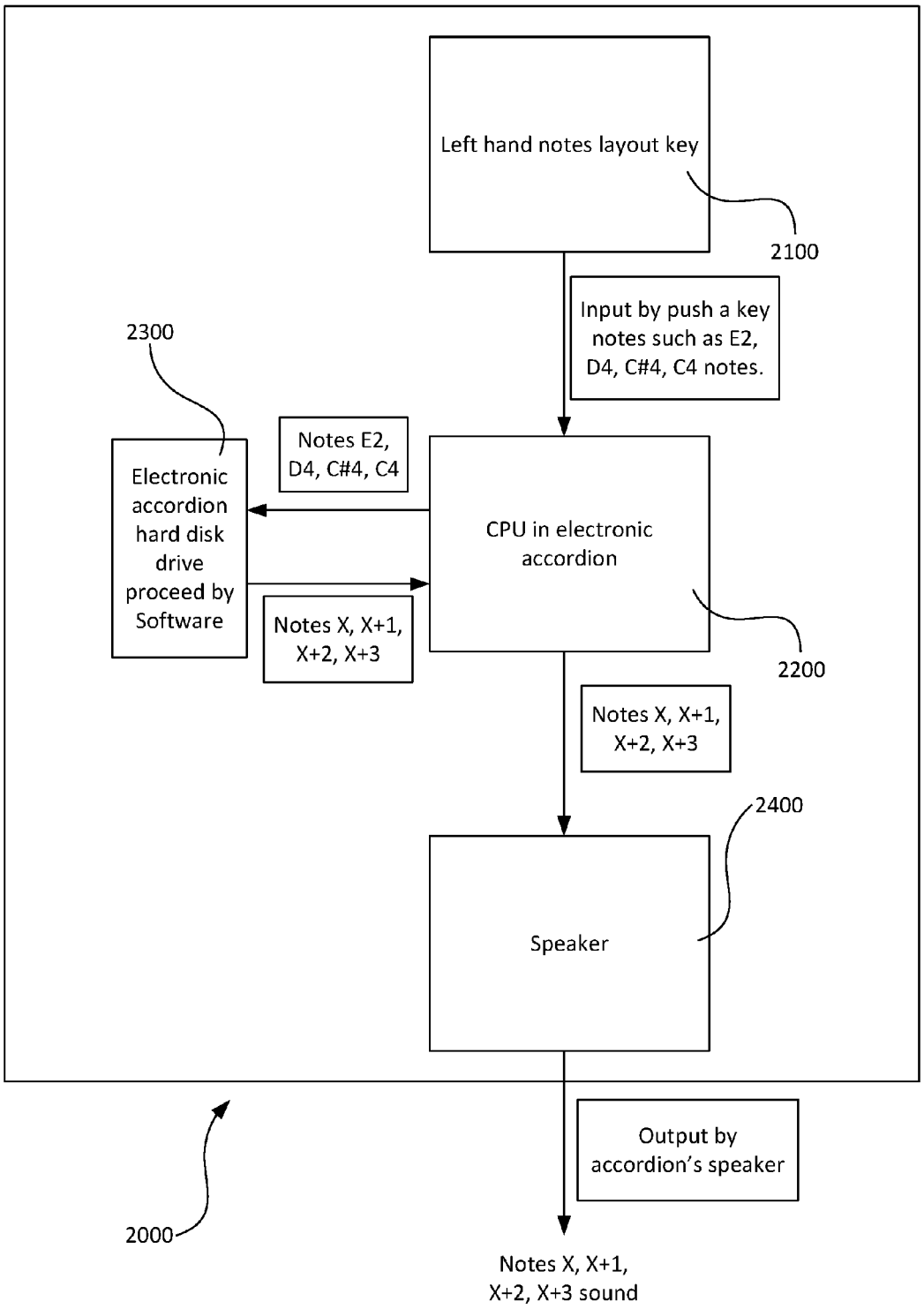
FIG. 15 is a diagram illustrating an example of an electronic accordion process without external device.

FIG. 15 illustrates a block diagram of an electronic accordion 2000 without external device. As shown in the drawing, the electronic accordion 2000 without external device according to the embodiment includes a left hand notes layout key 2100, a central processing unit (CPU) 2200, a memory 2300 in which a Software is stored, and a speaker 2400.

The left hand notes layout key 2100 includes four to six rows of buttons and/or two rows of buttons. The input of the CPU 2200 is a channel to import a data from the left hand notes layout key 2100 by a wire or a cable or circuit on board (main board or mother board) to the CPU (controller) 2200.

The CPU (controller) 2200 and the Software 2300 are a core of the electronic accordion 2000 to process the data input from the left hand notes layout key 2100. The CPU (controller) 2200 will process the data by the Software 2300 to analyze the data from the left hand notes layout key 2100.

The CPU (controller) 2200 is configured to execute assigning a plurality of pitches to the buttons of left hand play side such that a note layout pattern of the electronic accordion 2000 becomes as the note layout pattern of FIG. 6 to FIG. 14. That is, the CPU (controller) 2200 is configured to execute assigning first continuous four pitches (for example X, X+1, X+2, X+3) to a first column of the four rows of buttons. The CPU (controller) 2200 is configured to further execute assigning second continuous four pitches (for example X+4, X+5, X+6, X+7) to a second column of the four rows of buttons. The second continuous four pitches are adjacent to the first continuous four pitches. The second column is provided adjacent to the first column. The CPU (controller) 2200 is configured to further execute assigning third continuous four pitches (for example X+8, X+9, X+10, X+11) to a third column of the four rows of buttons. Third continuous four pitches are adjacent to the second continuous pitches. The third column is provided adjacent to the second column.

In addition, the CPU (controller) 2200 is configured to execute assigning the first continuous four pitches such that the first continuous four pitches become higher in order in a direction approaching to the bellow 300 or away from the bellow 300. The CPU (controller) 2200 is configured to further execute assigning the second continuous four pitches such that the second continuous four pitches become higher in order in a direction approaching to the bellow 300 or away from the bellow 300. The CPU (controller) 2200 is configured to further execute assigning the third continuous four pitches such that the third continuous four pitches become higher in order in a direction approaching to the bellow or away from the bellow 300.

In addition, the CPU (controller) 2200 is further configured to execute assigning a plurality of octaves (for example, octave 2 to octave 6) to a plurality of columns of the four rows of buttons such that the plurality of octaves become gradually higher or lower from a top side of the electronic accordion 2000 to a bottom side of the electronic accordion 2000. The plurality of octaves each has twelve pitches. The twelve pitches are assigned in the same manner as the first, second, and third continuous four pitches. However, the twelve pitches have different octave from the first, second, and third continuous four pitches.

In addition, the CPU (controller) 2200 is further configured to execute assigning first continuous two pitches to a first column of the two rows of buttons. The CPU (controller) 2200 is configured to execute assigning second continuous two pitches to a second column of the two rows of buttons. The second continuous two pitches are adjacent to the first continuous two pitches. The second column of the two rows of buttons is provided adjacent to the first column of the two rows of buttons. The CPU (controller) 2200 is configured to execute assigning third continuous two pitches to a third column of the two rows of buttons. The third continuous two pitches are adjacent to the second continuous two pitches. The third column of the two rows of buttons is provided adjacent to the second column of the two rows of buttons. The CPU (controller) 2200 is configured to execute assigning fourth continuous two pitches to a fourth column of the two rows of buttons. The fourth continuous two pitches are adjacent to the third continuous two pitches. The fourth column of the two rows of buttons is provided adjacent to the third column of the two rows of buttons. The CPU (controller) 2200 is configured to assigning fifth continuous two pitches to a fifth column of the two rows of buttons. The fifth continuous two pitches are adjacent to the fourth continuous two pitches. The fifth column of the two rows of buttons is provided adjacent to the fourth column of the two rows of buttons. The CPU (controller) 2200 is configured to execute assigning sixth continuous two pitches to a sixth column of the two rows of buttons. The sixth continuous two pitches are adjacent to the fifth continuous two pitches. The sixth column of the two rows of buttons is provided adjacent to the fifth column of the two rows of buttons.

In addition, the CPU (controller) 2200 is further configured to execute assigning a plurality of octaves to a plurality of columns of the two rows of buttons such that the plurality of octaves become gradually higher from a top side of the electronic accordion 2000 to a bottom side of the electronic accordion 2000. The plurality of octaves each has twelve pitches. The twelve pitches are assigned in the same manner as the first, second, third, fourth, fifth, and sixth continuous two pitches. However, the twelve pitches have different octave from the first, second, third, fourth, fifth, and sixth continuous two pitches.

The Speaker 2400 is a device to show a sound that transferred from the CPU (controller) 2200.

Figure 1:
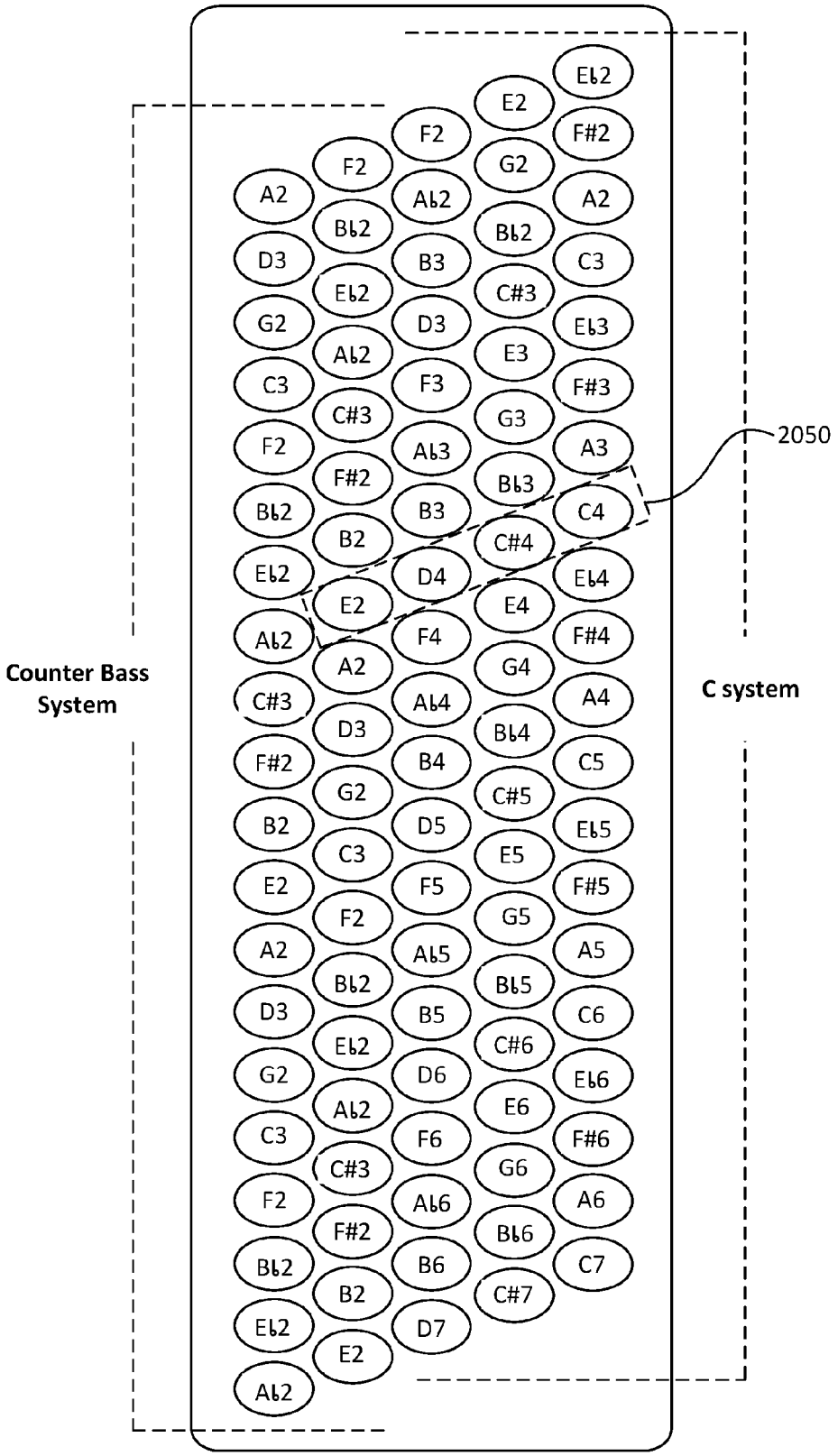
FIG. 1 is a diagram illustrating a prior art of a left hand key note.

When the CPU (controller) 2200 has already analyzed the data by the Software 2300, the CPU (controller) 2200 will select a sound from the Software 2300. If the accordionist would like to change the note sound, the accordionist can change the note sound by the CPU 2200. This is an example to change the note sound by CPU 2200. For example, assuming that the left hand note layout key 2100 is originally like FIG. 1, and the CPU 2200 executes assigning the note layout pattern of FIG. 6 to the left hand note layout key 2100. In this case, when the accordionist push E2, D4, C#4, C4 notes in a column 2050 of FIG. 1 in order, the data will be imported by the input to the CPU (controller) 2200 for analyzing by the Software 2300. When the Software 2300 transfer an analyzing data to the CPU (controller) 2200 again, the CPU (controller) 2200 will select a sound by using the analyzing data. As the note layout pattern is changed by the CPU 2200, and E2, D4, C#4, C4 notes in a column 2050 of FIG. 1 correspond to X, X+1, X+2, and X+3 of octave 3 of FIG. 6, X, X+1, X+2, and X+3 note sounds (for example C, C#, D, D#) of octave 3 are transferred to the speaker 2400 to shows the output. And X, X+1, X+2, and X+3 note sounds (for example C, C#, D, D#) of octave 3 will play by the speaker 2400 to accordionist.

The Note layout-T1, Note layout-T2, Note layout-T3, Note layout-T4, Note layout-A, Note layout-B, Note layout-C, Note layout-N and Note layout-T1+N according to the embodiment can adapt to use in the electronic accordion process without external device 2000.

Figure 16:
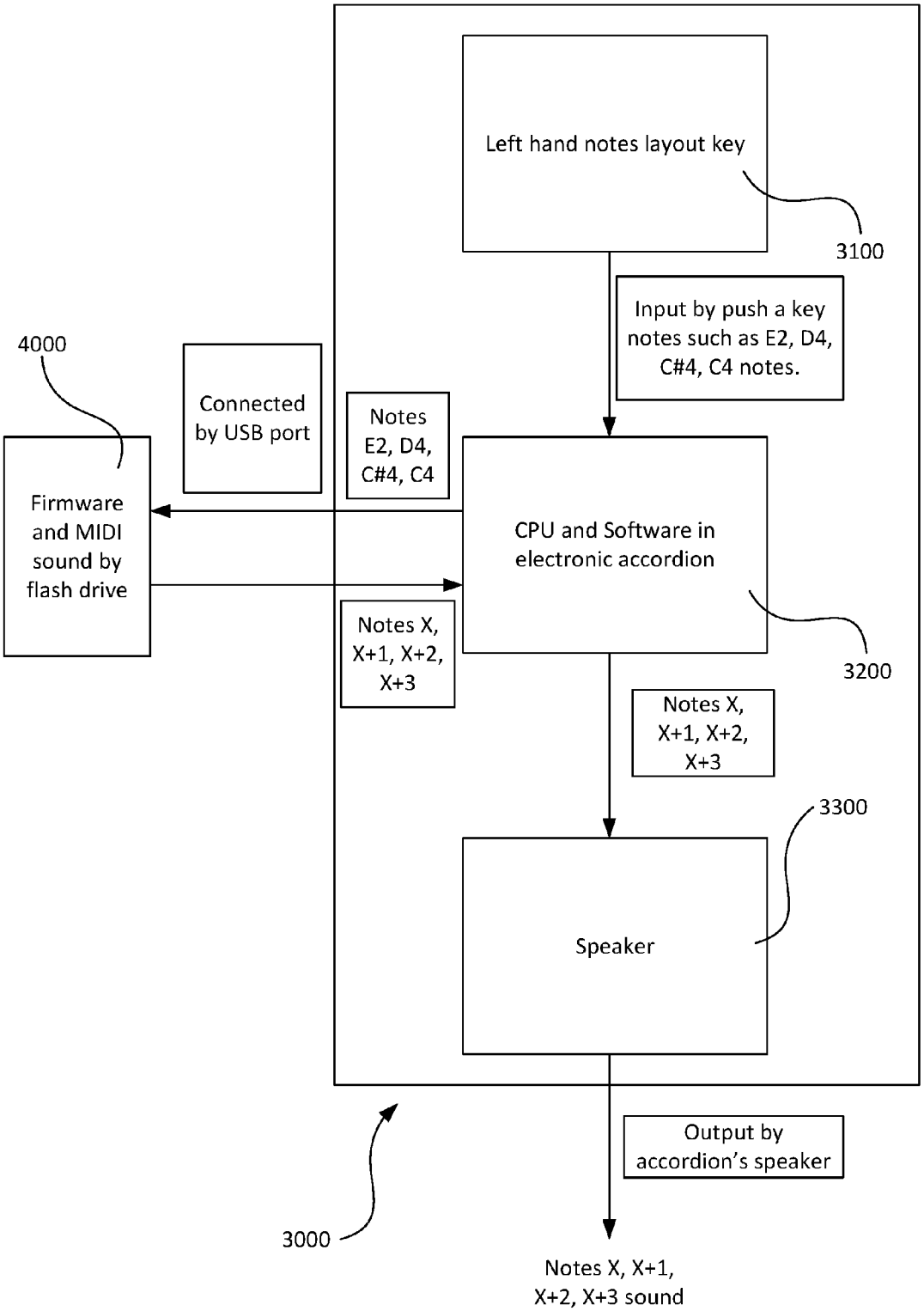
FIG. 16 is a diagram illustrating an example of an electronic accordion process within external device.

FIG. 16 illustrates a block diagram of an electronic accordion 3000 with external device 4000. As shown in the drawing, the electronic accordion 3000 according to the embodiment includes a left hand notes layout key 3100, a central processing unit (CPU) and a memory 3200 in which a Software is stored, and a speaker 3300.

The left hand notes layout key 3100 includes four to six rows of buttons and/or two rows of buttons. The input of the CPU and the memory 3200 is a channel to import a data from the left hand notes layout key 3100 by a wire or a cable or circuit on board (main board or mother board) to the central processing unit (CPU) and a memory 3200.

The CPU (controller) and Software 3200 is a core of the electronic accordion 3000 to process the data input from the left hand notes layout key 3100. The CPU (controller) 3200 will process the data by the Software 3200 to analyze the data from the left hand notes layout key 3100.

Flash drive 4000 is an external device that has a sound data to connect with the electronic accordion 3000 by USB port (Universal Serial Bus).

The Speaker 3300 is a device to show a sound that transferred from the CPU (controller) 3200.

When the CPU (controller) 3200 has already analyzed the data by the Software 3200, the CPU (controller) 3200 will select a sound from the Flash drive 4000. If the accordionist would like to change the note sound, the accordionist can change the note sound by the CPU 3200. This is an example to change the note (note value) by CPU 3200. For example, assuming that the left hand note layout key 3100 is originally like FIG. 1, and the CPU 3200 executes assigning the note layout pattern of FIG. 6 to the left hand note layout key 3100. In this case, when the accordionist push E2, D4, C#4, C4 notes in a column 2050 of FIG. 1 in order, the data will be imported by the input to the CPU (controller) 3200 for analyzing by the Software 3200 and transfer an analyzing data to the CPU (controller) 3200 again. Then the CPU (controller) 3200 will select a sound by using the analyzing data. As the note layout pattern is changed by the CPU 3200, and E2, D4, C#4, C4 notes in a column 2050 of FIG. 1 correspond to X, X+1, X+2, and X+3 of octave 3 of FIG. 6, X, X+1, X+2, and X+3 note sounds (for example, C, C#, D, D#) of octave 3 are transferred to the Flash drive 4000. The Flash drive 4000 changes tone color of X, X+1, X+2, and X+3 note sounds (for example C, C#, D, D#) of octave 3 and transfers to the CPU 3200. The CPU 3200 transfers tone color changed X, X+1, X+2, and X+3 note sounds (for example C, C#, D, D#) of octave 3 to the speaker 3300 to shows the output. Tone color changed X, X+1, X+2, and X+3 note sounds (for example C, C#, D, D#) of octave 3 will play by the speaker 3300 to accordionist.

The Note layout-T1, Note layout-T2, Note layout-T3, Note layout-T4, Note layout-A, Note layout-B, Note layout- C, Note layout-N and Note layout-T1+N according to the embodiment can adapt to use in the electronic accordion 3000 process within external divide 4000.

Figure 17:
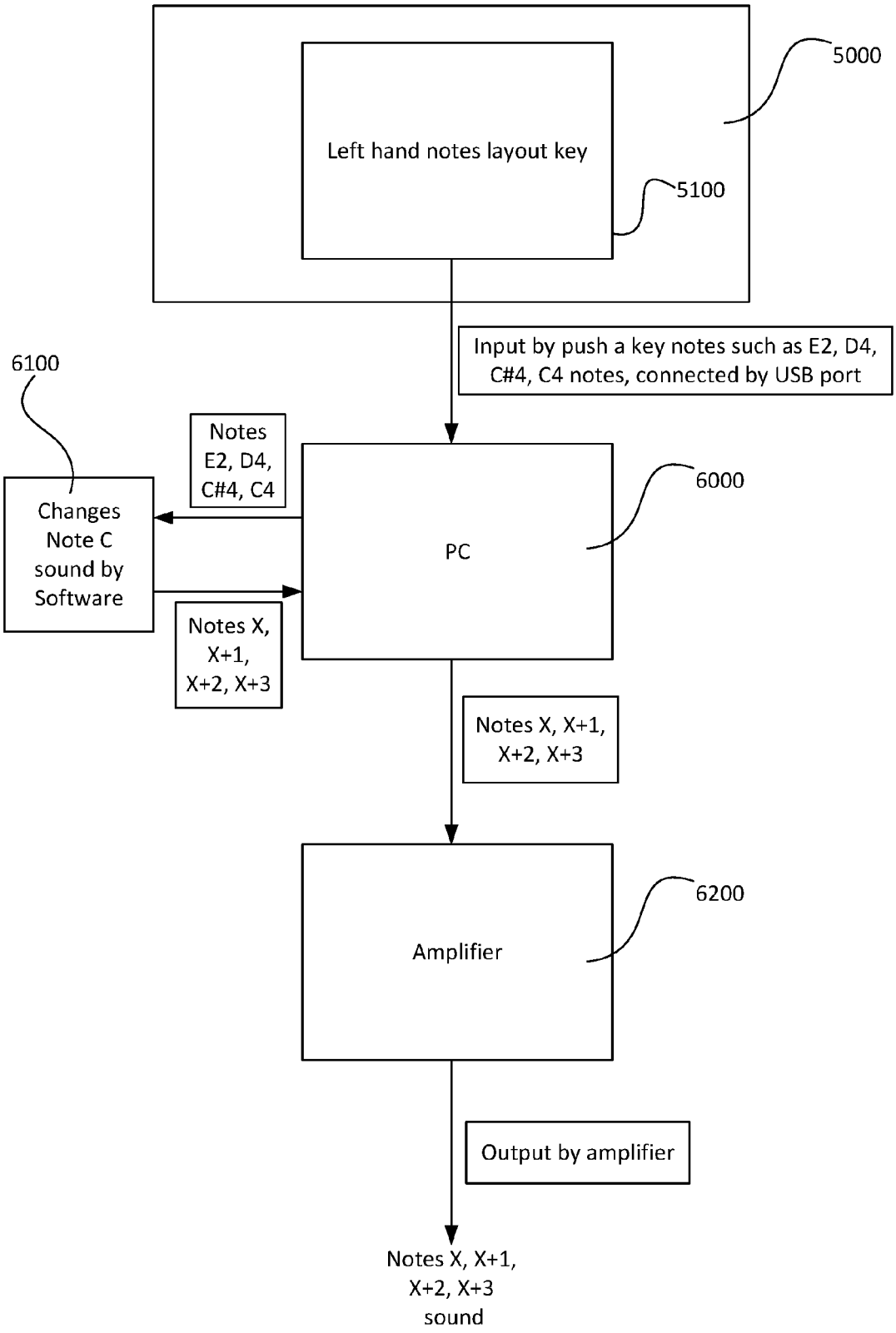
FIG. 17 is a diagram illustrating an example of an electronic accordion process is connected with a personal computer.

FIG. 17 illustrates a block diagram of an electronic accordion 5000 and personal computer (PC) 6000. As shown in the drawing, the electronic accordion 5000 is connected to a personal computer (PC) 6000. The electronic accordion 5000 includes a left hand notes layout key 5100. The personal computer (PC) 6000 includes Software 6100 installed in a persona computer (PC) 6000 and an amplifier 6200.

The input of the PC 6000 is a channel to import a data from the left hand notes layout key 5100 from the electronic accordion 5000 by a wire or a cable to the PC 6000 by USB port (Universal Serial Bus).

The PC 6000 is a general-purpose computer capability and makes it useful for individuals. The PC 6000 is intended to be operated directly by an end-user with no intervening computer operator. The Software 6100 (a computer program product) is a collection of instructions that enable the user to interact with a computer or have it perform specific tasks for the PC 6000 to process the data input from the left hand notes layout key 5100. The PC 6000 will process the data by the Software 6100 to analyze the data input from the left hand notes layout key 5100 of the electronic accordion 5000.

The Software 6100 (computer program) is configured to cause the PC 6000 (CPU) to execute assigning a plurality of pitches to the buttons of left hand play side of the electronic accordion 5000 such that the note layout pattern becomes as FIG. 6 to FIG. 14. That is, the software is configured to cause the PC to execute assigning a plurality of pitches to the buttons of left hand play side as well as an assigning process executed by the CPU 2200, 3200 of FIG. 15 and FIG. 16.

The Amplifier 6200 is an electronic device that increases the voltage, current, or power of a signal such as a sound that transferred from the PC 6000.

When the PC 6000 has already analyzed the data by the Software 6100, the PC 6000 will select a sound from the Software 6100. If the accordionist would like to change the note sound, the accordionist can change the note sound by the PC 6000. This is an example to change the note sound by PC 6000. For example, assuming that the left hand note layout key 5100 is originally like FIG. 1, and the PC 6000 executes assigning the note layout pattern of FIG. 6 to the left hand note layout key 5100. In this case, when the accordionist pushes E2, D4, C#4, C4 notes in a column 2050 of FIG. 1 in order, the data will be imported to the input of the PC 6000 for analyzing by the Software 6100. The software 6100 transfers an analyzing data to the PC 6000 again. The PC 6000 will select a sound by using the analyzing data. As the note layout pattern is changed by the PC 6000, and E2, D4, C#4, C4 notes in a column 2050 of FIG. 1 correspond to X, X+1, X+2, and X+3 of octave 3 of FIG. 6, X, X+1, X+2, and X+3 note sounds (for example C, C#, D, D#) of octave 3 are transferred to the amplifier 6200 to shows the output. And X, X+1, X+2, and X+3 note sounds (for example C, C#, D, D#) of octave 3 will play by the amplifier 6200 to accordionist.

The Note layout-T1, Note layout-T2, Note layout-T3, Note layout-T4, Note layout-A, Note layout-B, Note layout-C, Note layout-N and Note layout-T1+N according to the embodiment can adapt to use in the electronic accordion 5000 connected with a personal computer 6000.

Figure 18:
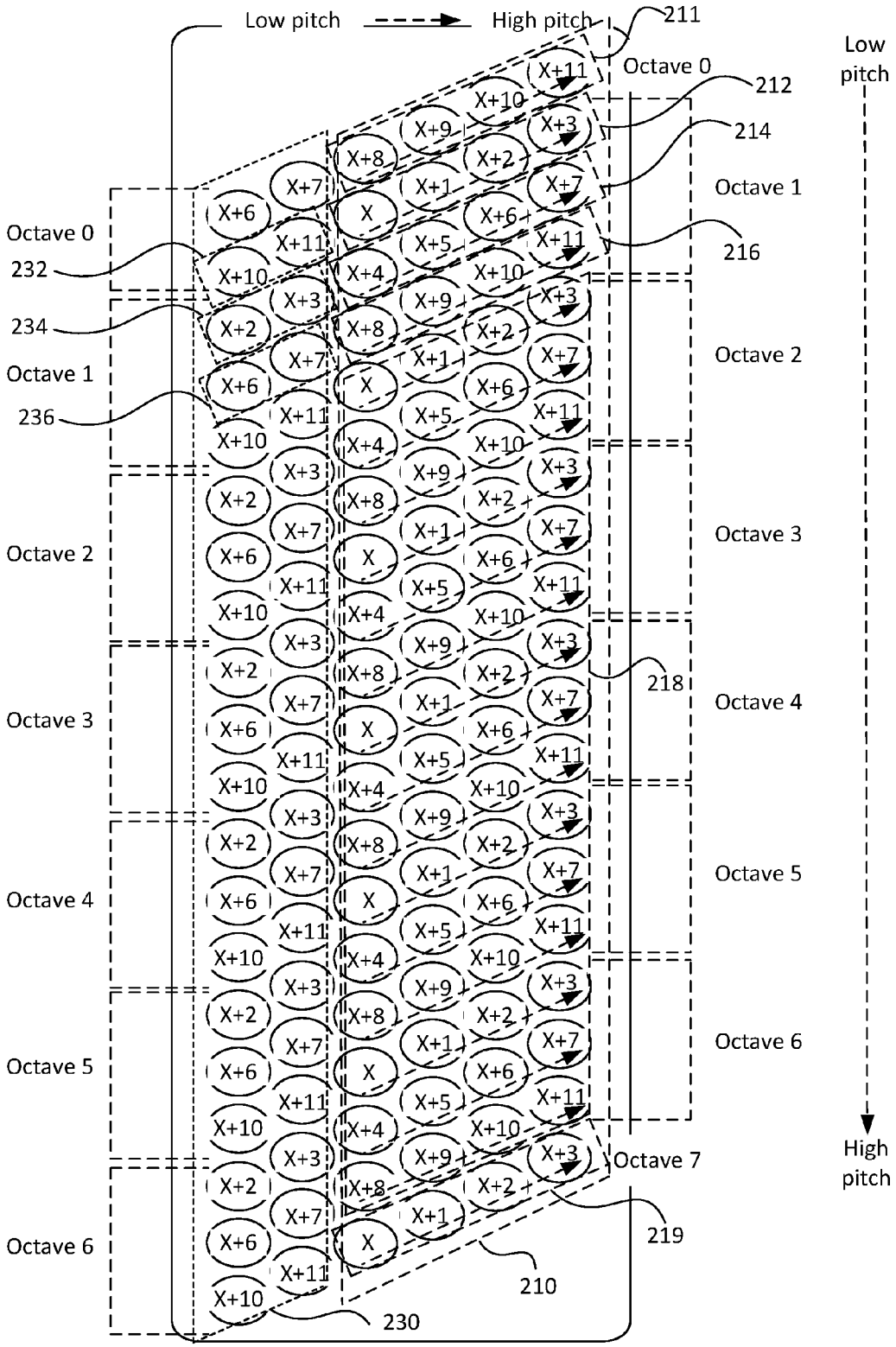
FIG. 18 is a diagram illustrating an example of left hand key note pattern of the present invention.

FIG. 18 illustrates an exploded perspective view of a Note layout. As shown in the drawing, the Note layout according to the embodiment includes four rows of buttons 210 provided on the left hand plays side 200. The four rows of buttons 210 are similar to the four rows of buttons 210 as shown in FIG. 6.

The Note layout according to the embodiment includes two rows of buttons 230. The two rows of buttons 230 are provided adjacent to the bellow side of the four rows of buttons 210. The two rows of buttons 230 include a first column 232, a second column 234, and a third column 236. The first column 232 is provided adjacent to the first column 212 of the four rows of buttons 210. First continuous two pitches X+10, X+11 are assigned to the first column 232. The first continuous two pitches X+10, X+11 are continuous to the first continuous four pitches X, X+1, X+2 and X+3. The second column 234 is provided adjacent to the second column 214 of the four rows of buttons 210. Second continuous two pitches X+2, X+3 are assigned to the second column 234. The second continuous two pitches X+2, X+3 are continuous to the second continuous four pitches X+4, X+5, X+6 and X+7. A third column 236 is provided adjacent to the third column 216 of the four rows of buttons 210. Third continuous two pitches X+6, X+7 are assigned to the third column 236. The third continuous two pitches X+6, X+7 are continuous to the third continuous four pitches X+8, X+9, X+10 and X+11.

The first continuous four pitches X, X+1, X+2 and X+3 and the first continuous two pitches X+10, X+11 are assigned such that the first continuous four pitches X, X+1, X+2 and X+3 and the first continuous two pitches X+10, X+11 become higher in order in a direction away from the bellow 300. The second continuous four pitches X+4, X+5, X+6 and X+7 and the second continuous two pitches X+2, X+3 are assigned such that the second continuous four pitches X+4, X+5, X+6 and X+7 and the second continuous two pitches X+2, X+3 become higher in order in a direction away from the bellow 300. The third continuous four pitches X+8, X+9, X+10 and X+11 and the third continuous two pitches X+6, X+7 are assigned such that the second continuous four pitches X+8, X+9, X+10 and X+11 and the third continuous two pitches X+6, X+7 become higher in order in a direction away from the bellow 300.

The Note layout according to the embodiment can be adapted to a mechanical accordion and an electronic accordion. According to this embodiment, if the accordionist wants to play chord (for example, X, X+4, and X+7), the accordionist can play the chord very fast and easily because the notes belonging to the chord are provided adjacent and close to each other.

Figure 19:
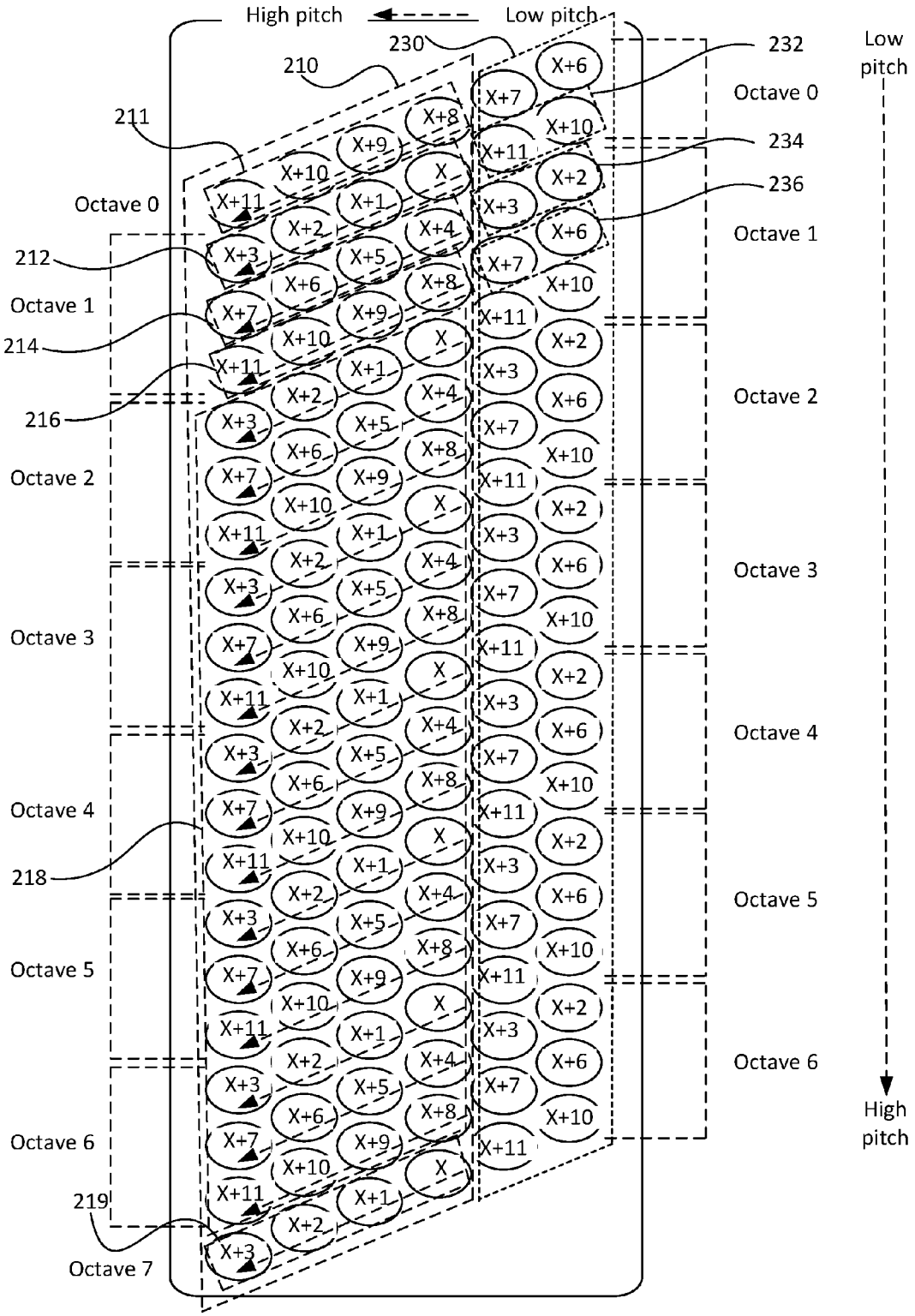
FIG. 19 is a diagram illustrating an example of left hand key note pattern of the present invention.

FIG. 19 illustrates an exploded perspective view of a Note layout. As shown in the drawing, the Note layout according to the embodiment includes four rows of buttons 210 provided on the left hand plays side 200. The four rows of buttons 210 are similar to the four rows of buttons 210 as shown in FIG. 7.

The Note layout according to the embodiment includes two rows of buttons 230. The two rows of buttons 230 are provided adjacent to the opposite bellow side of the four rows of buttons 210. The two rows of buttons 230 include a first column 232, a second column 234, and a third column 236. The first column 232 is provided adjacent to the first column 212 of the four rows of buttons 210. First continuous two pitches X+10, X+11 are assigned to the first column 232. The first continuous two pitches X+10, X+11 are continuous to the first continuous four pitches X, X+1, X+2 and X+3. The second column 234 is provided adjacent to the second column 214 of the four rows of buttons 210. Second continuous two pitches X+2, X+3 are assigned to the second column 234. The second continuous two pitches X+2, X+3 are continuous to the second continuous four pitches X+4, X+5, X+6 and X+7. A third column 236 is provided adjacent to the third column 216 of the four rows of buttons 210. Third continuous two pitches X+6, X+7 are assigned to the third column 236. The third continuous two pitches X+6, X+7 are continuous to the third continuous four pitches X+8, X+9, X+10 and X+11.

The first continuous four pitches X, X+1, X+2 and X+3 and the first continuous two pitches X+10, X+11 are assigned such that the first continuous four pitches X, X+1, X+2 and X+3 and the first continuous two pitches X+10, X+11 become higher in order in a direction approaching to the bellow 300. The second continuous four pitches X+4, X+5, X+6 and X+7 and the second continuous two pitches X+2, X+3 are assigned such that the second continuous four pitches X+4, X+5, X+6 and X+7 and the second continuous two pitches X+2, X+3 become higher in order in a direction approaching to the bellow 300. The third continuous four pitches X+8, X+9, X+10 and X+11 and the third continuous two pitches X+6, X+7 are assigned such that the second continuous four pitches X+8, X+9, X+10 and X+11 and the third continuous two pitches X+6, X+7 become higher in order in a direction approaching to the bellow 300.

The Note layout according to the embodiment can be adapted to a mechanical accordion and an electronic accordion. According to this embodiment, if the accordionist wants to play chord (for example, X, X+4, and X+7), the accordionist can play the chord very fast and easily because the notes belonging to the chord are provided adjacent and close to each other.

Figure 20:
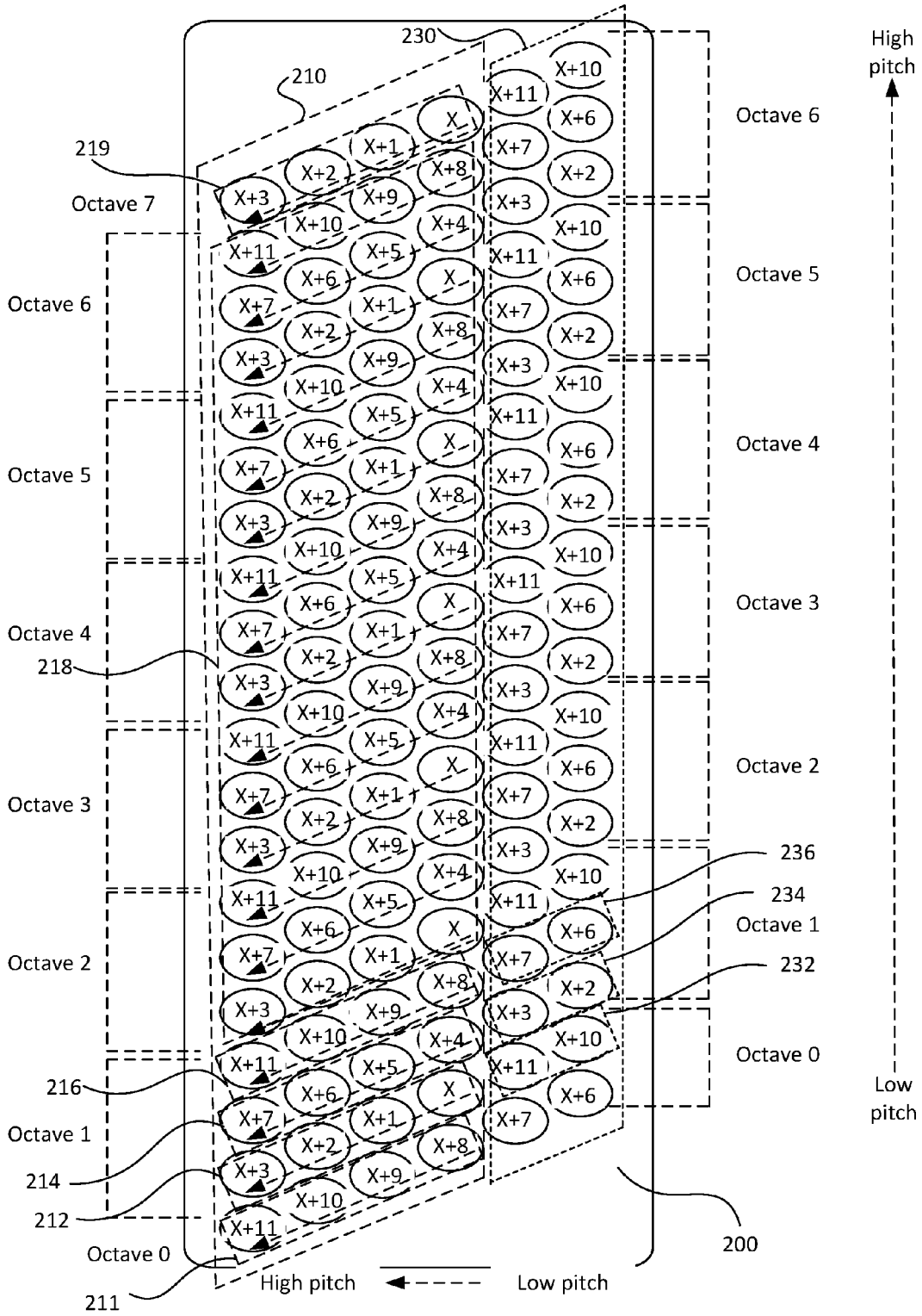
FIG. 20 is a diagram illustrating an example of left hand key note pattern of the present invention.

FIG. 20 illustrates an exploded perspective view of a Note layout. As shown in the drawing, the Note layout according to the embodiment includes four rows of buttons 210 provided on the left hand plays side 200. The four rows of buttons 210 are similar to the four rows of buttons 210 as shown in FIG. 8.

The Note layout according to the embodiment includes two rows of buttons 230. The two rows of buttons 230 are provided adjacent to the opposite bellow side of the four rows of buttons 210. The two rows of buttons 230 include a first column 232, a second column 234, and a third column 236. The first column 232 is provided adjacent to the first column 212 of the four rows of buttons 210. First continuous two pitches X+10, X+11 are assigned to the first column 232. The first continuous two pitches X+10, X+11 are continuous to the first continuous four pitches X, X+1, X+2 and X+3. The second column 234 is provided adjacent to the second column 214 of the four rows of buttons 210. Second continuous two pitches X+2, X+3 are assigned to the second column 234. The second continuous two pitches X+2, X+3 are continuous to the second continuous four pitches X+4, X+5, X+6 and X+7. A third column 236 is provided adjacent to the third column 216 of the four rows of buttons 210. Third continuous two pitches X+6, X+7 are assigned to the third column 236. The third continuous two pitches X+6, X+7 are continuous to the third continuous four pitches X+8, X+9, X+10 and X+11.

The first continuous four pitches X, X+1, X+2 and X+3 and the first continuous two pitches X+10, X+11 are assigned such that the first continuous four pitches X, X+1, X+2 and X+3 and the first continuous two pitches X+10, X+11 become higher in order in a direction approaching to the bellow 300. The second continuous four pitches X+4, X+5, X+6 and X+7 and the second continuous two pitches X+2, X+3 are assigned such that the second continuous four pitches X+4, X+5, X+6 and X+7 and the second continuous two pitches X+2, X+3 become higher in order in a direction approaching to the bellow 300. The third continuous four pitches X+8, X+9, X+10 and X+11 and the third continuous two pitches X+6, X+7 are assigned such that the second continuous four pitches X+8, X+9, X+10 and X+11 and the third continuous two pitches X+6, X+7 become higher in order in a direction approaching to the bellow 300.

The Note layout according to the embodiment can be adapted to a mechanical accordion and an electronic accordion. According to this embodiment, if the accordionist wants to play chord (for example, X, X+4, and X+7), the accordionist can play the chord very fast and easily because the notes belonging to the chord are provided adjacent and close to each other.

Figure 21:
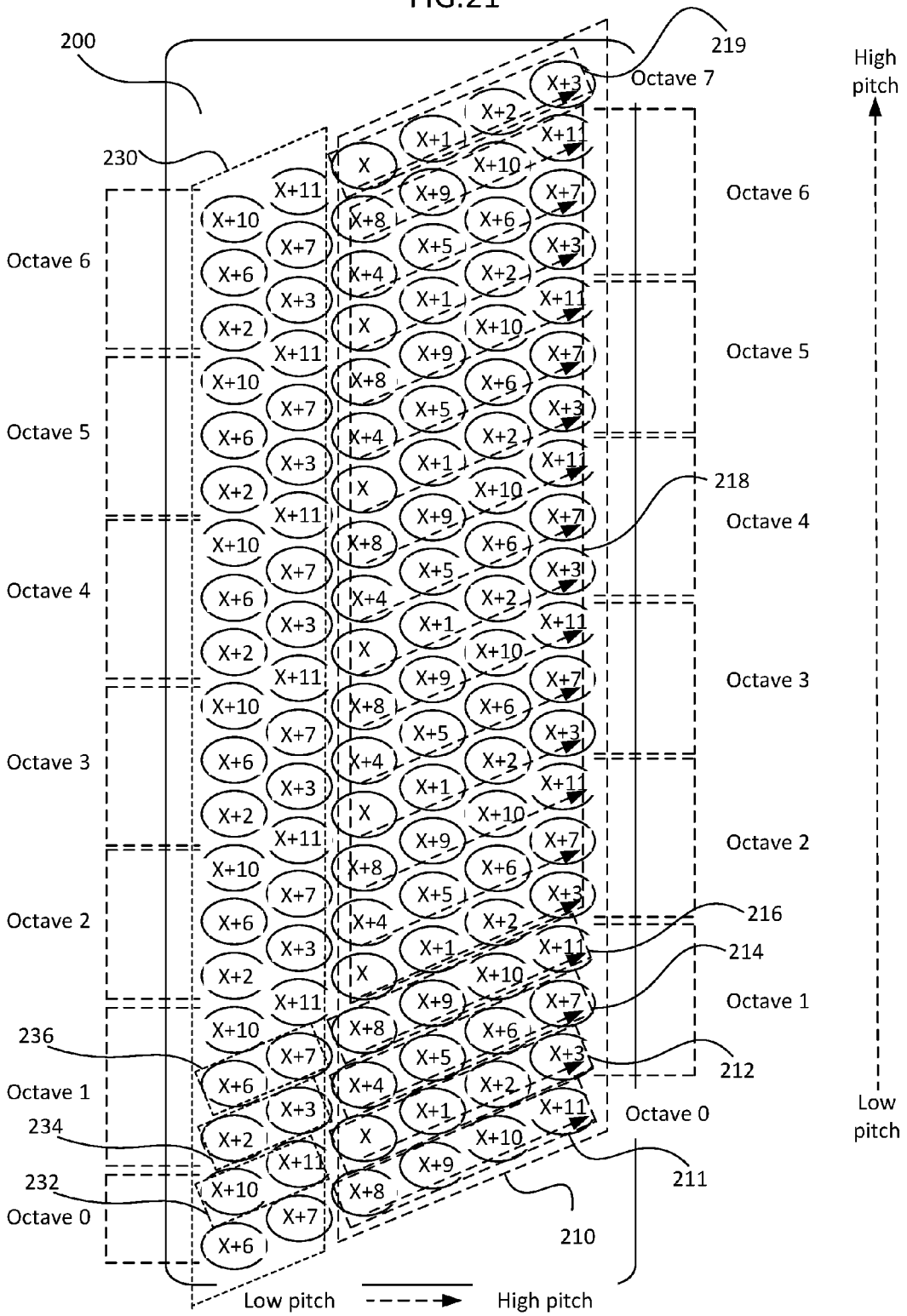
FIG. 21 is a diagram illustrating an example of left hand key note pattern of the present invention.

FIG. 21 illustrates an exploded perspective view of a Note layout. As shown in the drawing, the Note layout according to the embodiment includes four rows of buttons 210 provided on the left hand plays side 200. The four rows of buttons 210 are similar to the four rows of buttons 210 as shown in FIG. 9.

The Note layout according to the embodiment includes two rows of buttons 230. The two rows of buttons 230 are provided adjacent to the bellow side of the four rows of buttons 210. The two rows of buttons 230 include a first column 232, a second column 234, and a third column 236. The first column 232 is provided adjacent to the first column 212 of the four rows of buttons 210. First continuous two pitches X+10, X+11 are assigned to the first column 232. The first continuous two pitches X+10, X+11 are continuous to the first continuous four pitches X, X+1, X+2 and X+3. The second column 234 is provided adjacent to the second column 214 of the four rows of buttons 210. Second continuous two pitches X+2, X+3 are assigned to the second column 214. The second continuous two pitches X+2, X+3 are continuous to the second continuous four pitches X+4, X+5, X+6 and X+7. A third column 236 is provided adjacent to the third column 216 of the four rows of buttons 210. Third continuous two pitches X+6, X+7 are assigned to the third column 236. The third continuous two pitches X+6, X+7 are continuous to the third continuous four pitches X+8, X+9, X+10 and X+11.

The first continuous four pitches X, X+1, X+2 and X+3 and the first continuous two pitches X+10, X+11 are assigned such that the first continuous four pitches X, X+1, X+2 and X+3 and the first continuous two pitches X+10, X+11 become higher in order in a direction away from the bellow 300. The second continuous four pitches X+4, X+5, X+6 and X+7 and the second continuous two pitches X+2, X+3 are assigned such that the second continuous four pitches X+4, X+5, X+6 and X+7 and the second continuous two pitches X+2, X+3 become higher in order in a direction away from the bellow 300. The third continuous four pitches X+8, X+9, X+10 and X+11 and the third continuous two pitches X+6, X+7 are assigned such that the second continuous four pitches X+8, X+9, X+10 and X+11 and the third continuous two pitches X+6, X+7 become higher in order in a direction away from the bellow 300.

The Note layout according to the embodiment can be adapted to a mechanical accordion and an electronic accordion. According to this embodiment, if the accordionist wants to play chord (for example, X, X+4, and X+7), the accordionist can play the chord very fast and easily because the notes belonging to the chord are provided adjacent and close to each other.

Figure 22:
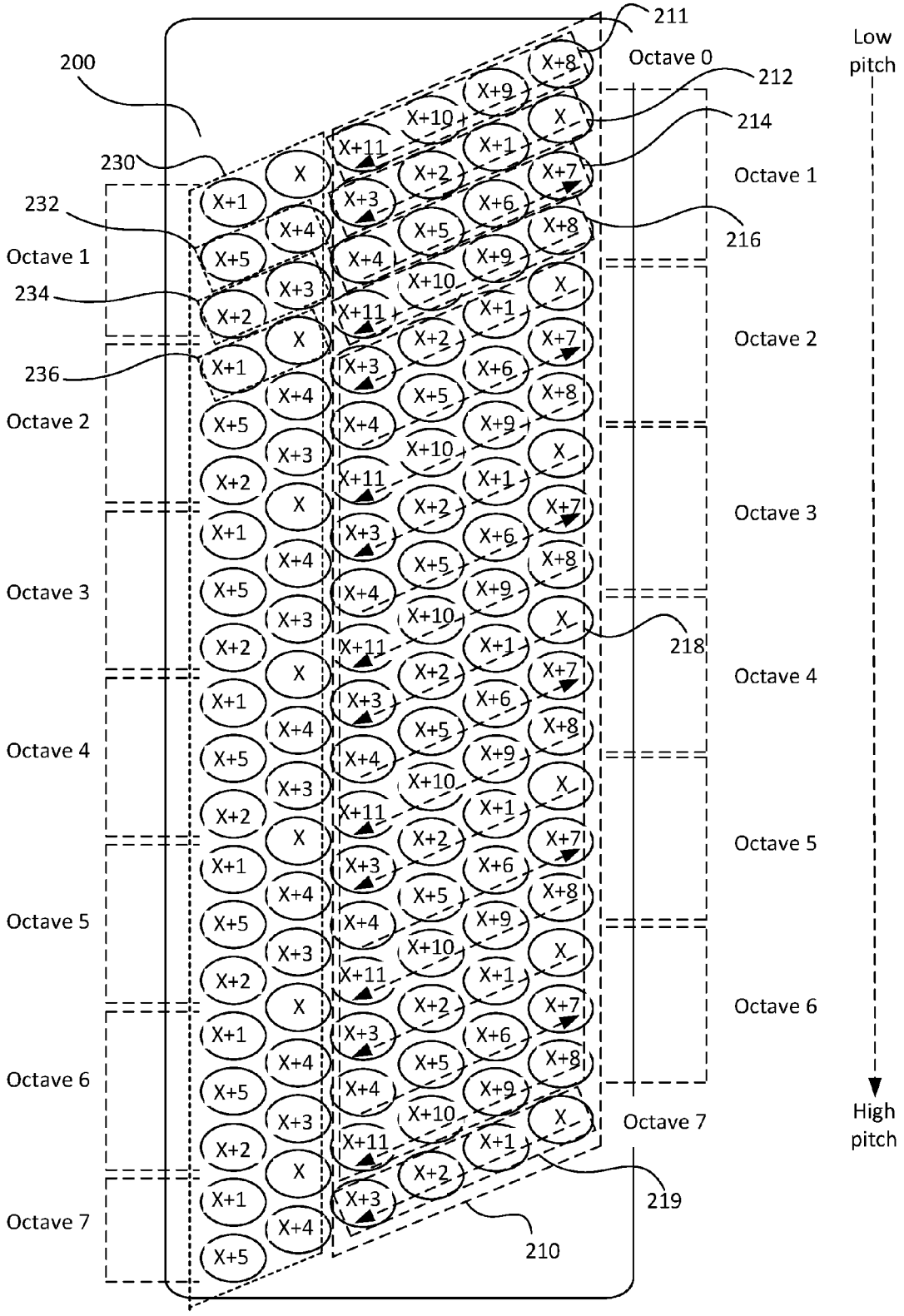
FIG. 22 is a diagram illustrating an example of left hand key note pattern of the present invention.

FIG. 22 illustrates an exploded perspective view of a Note layout. As shown in the drawing, the Note layout according to the embodiment includes four rows of buttons 210 provided on the left hand plays side 200. The four rows of buttons 210 are similar to the four rows of buttons 210 as shown in FIG. 10.

The Note layout according to the embodiment includes two rows of buttons 230. The two rows of buttons 230 are provided adjacent to the bellow side of the four rows of buttons 210. The two rows of buttons 230 include a first column 232, a second column 234, and a third column 236. The first column 232 is provided adjacent to the first column 212 of the four rows of buttons 210. First continuous two pitches X+4, X+5 are assigned to the first column 232. The first continuous two pitches X+4, X+5 are continuous from the first continuous four pitches X, X+1, X+2 and X+3. The second column 234 is provided adjacent to the second column 214 of the four rows of buttons 210. Second continuous two pitches X+2, X+3 are assigned to the second column 234. The second continuous two pitches X+2, X+3 are continuous to the second continuous four pitches X+4, X+5, X+6 and X+7. A third column 236 is provided adjacent to the third column 216 of the four rows of buttons 210. Third continuous two pitches X, X+1 are assigned to the third column 236. The third continuous two pitches X, X+1 are continuous from the third continuous four pitches X+8, X+9, X+10 and X+11.

The first continuous four pitches X, X+1, X+2 and X+3 and the first continuous two pitches X+4, X+5 are assigned such that the first continuous four pitches X, X+1, X+2 and X+3 and the first continuous two pitches X+4, X+5 become higher in order in a direction approaching to the bellow 300. The second continuous four pitches X+4, X+5, X+6 and X+7 and the second continuous two pitches X+2, X+3 are assigned such that the second continuous four pitches X+4, X+5, X+6 and X+7 and the second continuous two pitches X+2, X+3 become higher in order in a direction away from the bellow 300. The third continuous four pitches X+8, X+9, X+10 and X+11 and the third continuous two pitches X, X+1 are assigned such that the second continuous four pitches X+8, X+9, X+10 and X+11 and the third continuous two pitches X, X+1 become higher in order in a direction approaching to the bellow 300.

The Note layout according to the embodiment can be adapted to a mechanical accordion and an electronic accordion. According to this embodiment, if the accordionist wants to play chord, the accordionist can play the chord very fast and easily because the notes belonging to the chord are provided adjacent and close to each other.

Figure 23:
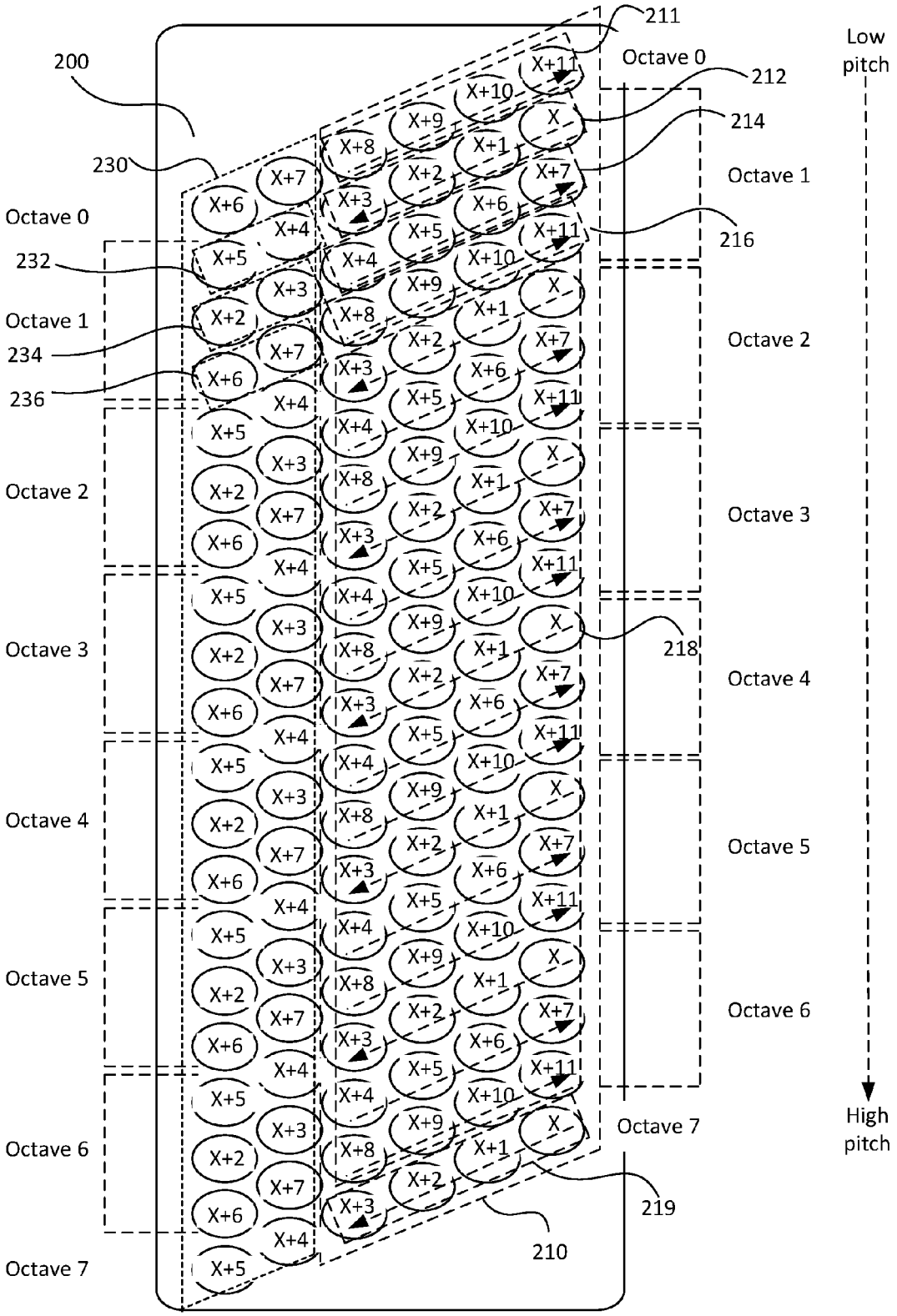
FIG. 23 is a diagram illustrating an example of left hand key note pattern of the present invention.

FIG. 23 illustrates an exploded perspective view of a Note layout. As shown in the drawing, the Note layout according to the embodiment includes four rows of buttons 210 provided on the left hand plays side 200. The four rows of buttons 210 are similar to the four rows of buttons 210 as shown in FIG. 11.

The Note layout according to the embodiment includes two rows of buttons 230. The two rows of buttons 230 are provided adjacent to the bellow side of the four rows of buttons 210. The two rows of buttons 230 include a first column 232, a second column 234, and a third column 236. The first column 232 is provided adjacent to the first column 212 of the four rows of buttons 210. First continuous two pitches X+4, X+5 are assigned to the first column 232. The first continuous two pitches X+4, X+5 are continuous from the first continuous four pitches X, X+1, X+2 and X+3. The second column 234 is provided adjacent to the second column 214 of the four rows of buttons 210. Second continuous two pitches X+2, X+3 are assigned to the second column 234. The second continuous two pitches X+2, X+3 are continuous to the second continuous four pitches X+4, X+5, X+6 and X+7. A third column 236 is provided adjacent to the third column 216 of the four rows of buttons 210. Third continuous two pitches X+6, X+7 are assigned to the third column 236. The third continuous two pitches X+6, X+7 are continuous to the third continuous four pitches X+8, X+9, X+10 and X+11.

The first continuous four pitches X, X+1, X+2 and X+3 and the first continuous two pitches X+4, X+5 are assigned such that the first continuous four pitches X, X+1, X+2 and X+3 and the first continuous two pitches X+4, X+5 become higher in order in a direction approaching to the bellow 300. The second continuous four pitches X+4, X+5, X+6 and X+7 and the second continuous two pitches X+2, X+3 are assigned such that the second continuous four pitches X+4, X+5, X+6 and X+7 and the second continuous two pitches X+2, X+3 become higher in order in a direction away from the bellow 300. The third continuous four pitches X+8, X+9, X+10 and X+11 and the third continuous two pitches X+6, X+7 are assigned such that the second continuous four pitches X+8, X+9, X+10 and X+11 and the third continuous two pitches X+6, X+7 become higher in order in a direction away from the bellow 300.

The Note layout according to the embodiment can be adapted to a mechanical accordion and an electronic accordion. According to this embodiment, if the accordionist wants to play chord, the accordionist can play the chord very fast and easily because the notes belonging to the chord are provided adjacent and close to each other.

Figure 24:
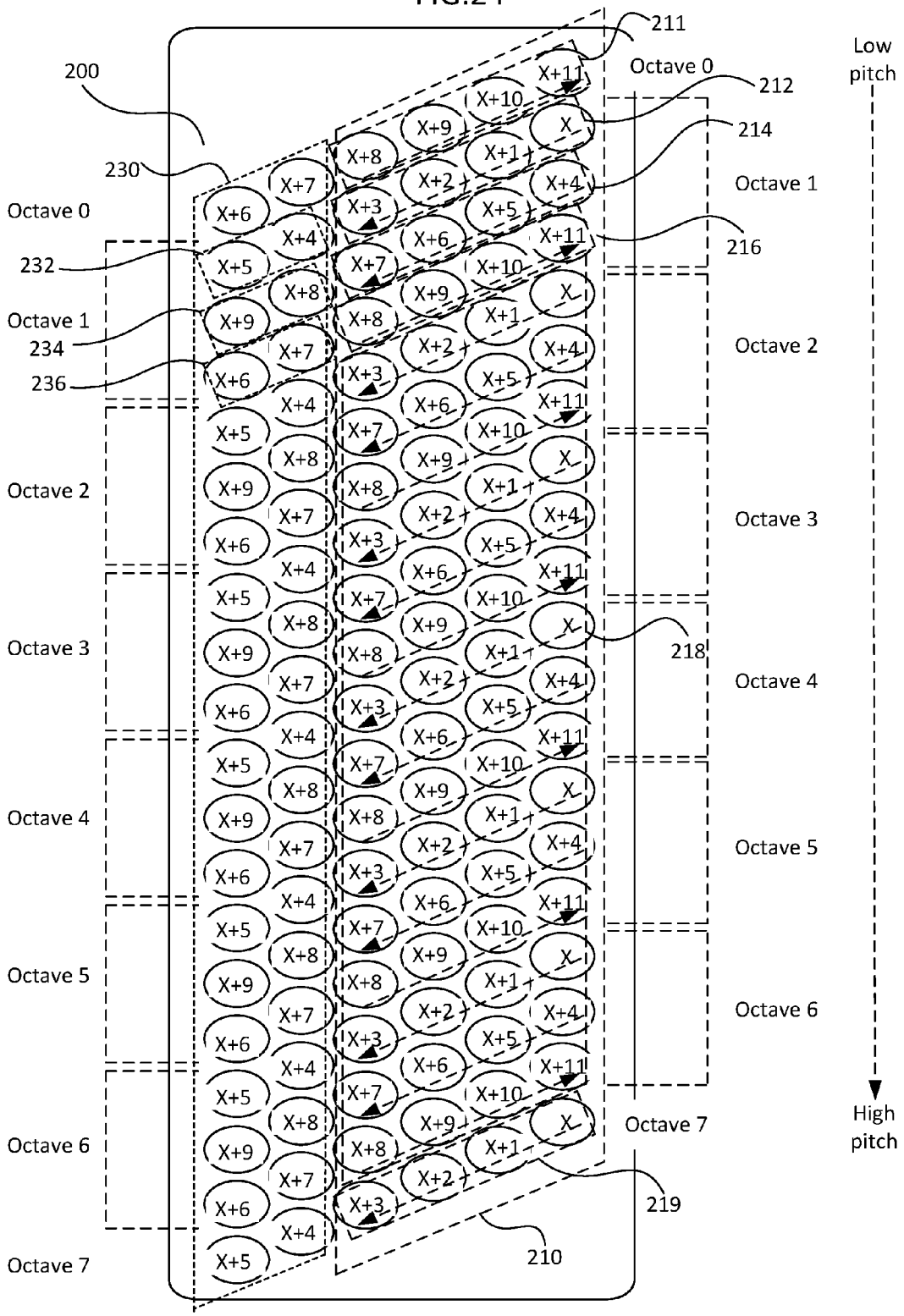
FIG. 24 is a diagram illustrating an example of left hand key note pattern of the present invention.

FIG. 24 illustrates an exploded perspective view of a Note layout. As shown in the drawing, the Note layout according to the embodiment includes four rows of buttons 210 provided on the left hand plays side 200. The four rows of buttons 210 are similar to the four rows of buttons 210 as shown in FIG. 12.

The Note layout according to the embodiment includes two rows of buttons 230. The two rows of buttons 230 are provided adjacent to the bellow side of the four rows of buttons 210. The two rows of buttons 230 include a first column 232, a second column 234, and a third column 236. The first column 232 is provided adjacent to the first column 212 of the four rows of buttons 210. First continuous two pitches X+4, X+5 are assigned to the first column 232. The first continuous two pitches X+4, X+5 are continuous from the first continuous four pitches X, X+1, X+2 and X+3. The second column 234 is provided adjacent to the second column 214 of the four rows of buttons 210. Second continuous two pitches X+8, X+9 are assigned to the second column 234. The second continuous two pitches X+8, X+9 are continuous from the second continuous four pitches X+4, X+5, X+6 and X+7. A third column 236 is provided adjacent to the third column 216 of the four rows of buttons 210. Third continuous two pitches X+6, X+7 are assigned to the third column 236. The third continuous two pitches X+6, X+7 are continuous to the third continuous four pitches X+8, X+9, X+10 and X+11.

The first continuous four pitches X, X+1, X+2 and X+3 and the first continuous two pitches X+4, X+5 are assigned such that the first continuous four pitches X, X+1, X+2 and X+3 and the first continuous two pitches X+4, X+5 become higher in order in a direction approaching to the bellow 300. The second continuous four pitches X+4, X+5, X+6 and X+7 and the second continuous two pitches X+8, X+9 are assigned such that the second continuous four pitches X+4, X+5, X+6 and X+7 and the second continuous two pitches X+8, X+9 become higher in order in a direction approaching to the bellow 300. The third continuous four pitches X+8, X+9, X+10 and X+11 and the third continuous two pitches X+6, X+7 are assigned such that the second continuous four pitches X+8, X+9, X+10 and X+11 and the third continuous two pitches X+6, X+7 become higher in order in a direction away from the bellow 300.

The Note layout according to the embodiment can be adapted to a mechanical accordion and an electronic accordion. According to this embodiment, if the accordionist wants to play chord, the accordionist can play the chord very fast and easily because the notes belonging to the chord are provided adjacent and close to each other.

Figure 25:
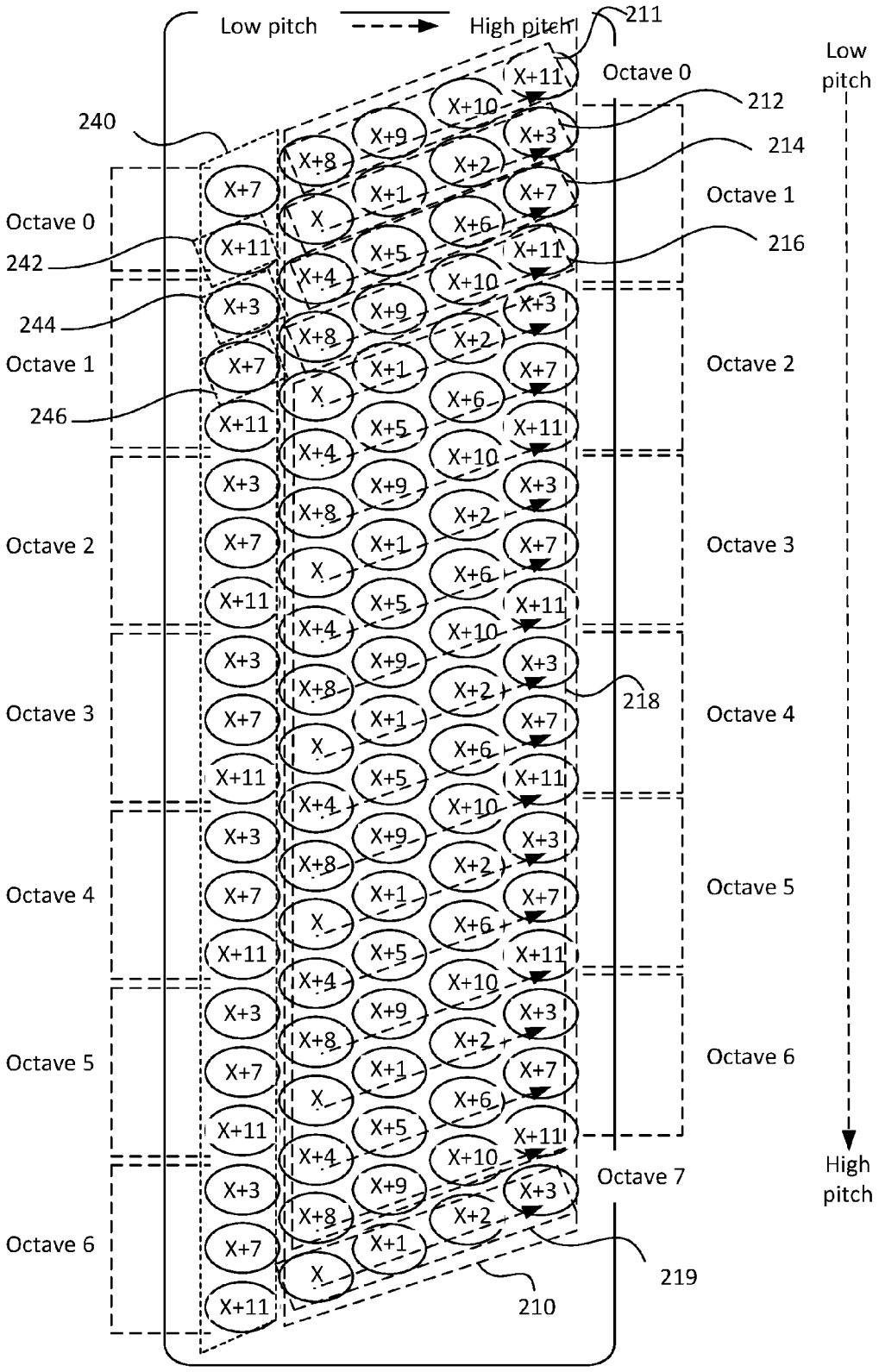
FIG. 25 is a diagram illustrating an example of left hand key note pattern of the present invention.

FIG. 25 illustrates an exploded perspective view of a Note layout. As shown in the drawing, the Note layout according to the embodiment includes four rows of buttons 210 provided on the left hand plays side 200. The four rows of buttons 210 are similar to the four rows of buttons 210 as shown in FIG. 6.

The Note layout according to the embodiment includes one row of buttons 240. The one row of buttons 240 is provided adjacent to the bellow side of the four rows of buttons 210. The one row of buttons 240 includes a first column 242, a second column 244, and a third column 246. The first column 242 is provided adjacent to the first column 212 of the four rows of buttons 210. First pitch X+11 is assigned to the first column 242. The first pitch X+11 is continuous to the first continuous four pitches X, X+1, X+2 and X+3. The second column 244 is provided adjacent to the second column 214 of the four rows of buttons 210. Second pitch X+3 is assigned to the second column 242. The second pitch X+3 is continuous to the second continuous four pitches X+4, X+5, X+6 and X+7. A third column 246 is provided adjacent to the third column 216 of the four rows of buttons 210. Third pitch X+7 is assigned to the third column. The third pitch X+7 is continuous to the third continuous four pitches X+8, X+9, X+10 and X+11.

The first continuous four pitches X, X+1, X+2 and X+3 and the first pitch X+11 are assigned such that the first continuous four pitches X, X+1, X+2 and X+3 and the first pitch X+11 become higher in order in a direction away from the bellow 300. The second continuous four pitches X+4, X+5, X+6 and X+7 and the second pitch X+3 are assigned such that the second continuous four pitches X+4, X+5, X+6 and X+7 and the second pitch X+3 become higher in order in a direction away from the bellow 300. The third continuous four pitches X+8, X+9, X+10 and X+11 and the third pitch X+7 are assigned such that the second continuous four pitches X+8, X+9, X+10 and X+11 and the third pitch X+7 become higher in order in a direction away from the bellow 300.

The Note layout according to the embodiment can be adapted to a mechanical accordion and an electronic accordion. According to this embodiment, if the accordionist wants to play chord (for example, X, X+4, and X+7), the accordionist can play the chord very fast and easily because the notes belonging to the chord are provided adjacent and close to each other.

Figure 26:
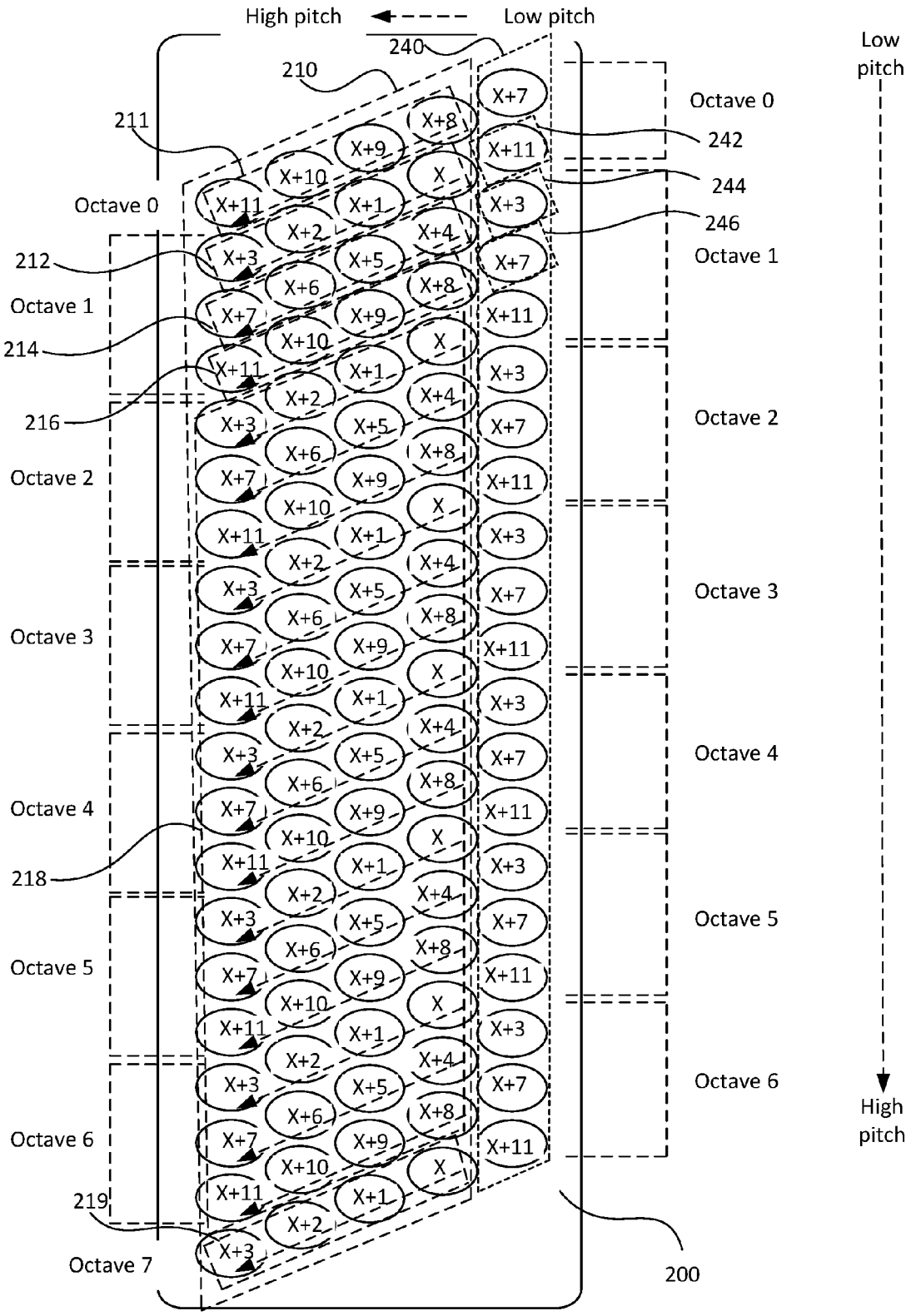
FIG. 26 is a diagram illustrating an example of left hand key note pattern of the present invention.

FIG. 26 illustrates an exploded perspective view of a Note layout. As shown in the drawing, the Note layout according to the embodiment includes four rows of buttons 210 provided on the left hand plays side 200. The four rows of buttons 210 are similar to the four rows of buttons 210 as shown in FIG. 7.

The Note layout according to the embodiment includes one row of buttons 240. The one row of buttons 240 is provided adjacent to the opposite bellow side of the four rows of buttons 210. The one row of buttons 240 includes a first column 242, a second column 244, and a third column 246. The first column 242 is provided adjacent to the first column 212 of the four rows of buttons 210. First pitch X+11 is assigned to the first column 242. The first pitch X+11 is continuous to the first continuous four pitches X, X+1, X+2 and X+3. The second column 244 is provided adjacent to the second column 214 of the four rows of buttons 210. Second pitch X+3 is assigned to the second column 244. The second pitch X+3 is continuous to the second continuous four pitches X+4, X+5, X+6 and X+7. A third column 246 is provided adjacent to the third column 216 of the four rows of buttons 210. Third pitch X+7 is assigned to the third column 246. The third pitch X+7 is continuous to the third continuous four pitches X+8, X+9, X+10 and X+11.

The first continuous four pitches X, X+1, X+2 and X+3 and the first pitch X+11 are assigned such that the first continuous four pitches X, X+1, X+2 and X+3 and the first pitch X+11 become higher in order in a direction approaching to the bellow 300. The second continuous four pitches X+4, X+5, X+6 and X+7 and the second pitch X+3 are assigned such that the second continuous four pitches X+4, X+5, X+6 and X+7 and the second pitch X+3 become higher in order in a direction approaching to the bellow 300. The third continuous four pitches X+8, X+9, X+10 and X+11 and the third pitch X+7 are assigned such that the second continuous four pitches X+8, X+9, X+10 and X+11 and the third pitch X+7 become higher in order in a direction approaching to the bellow 300.

The Note layout according to the embodiment can be adapted to a mechanical accordion and an electronic accordion. According to this embodiment, if the accordionist wants to play chord (for example, X, X+4, and X+7), the accordionist can play the chord very fast and easily because the notes belonging to the chord are provided adjacent and close to each other.

Figure 27:
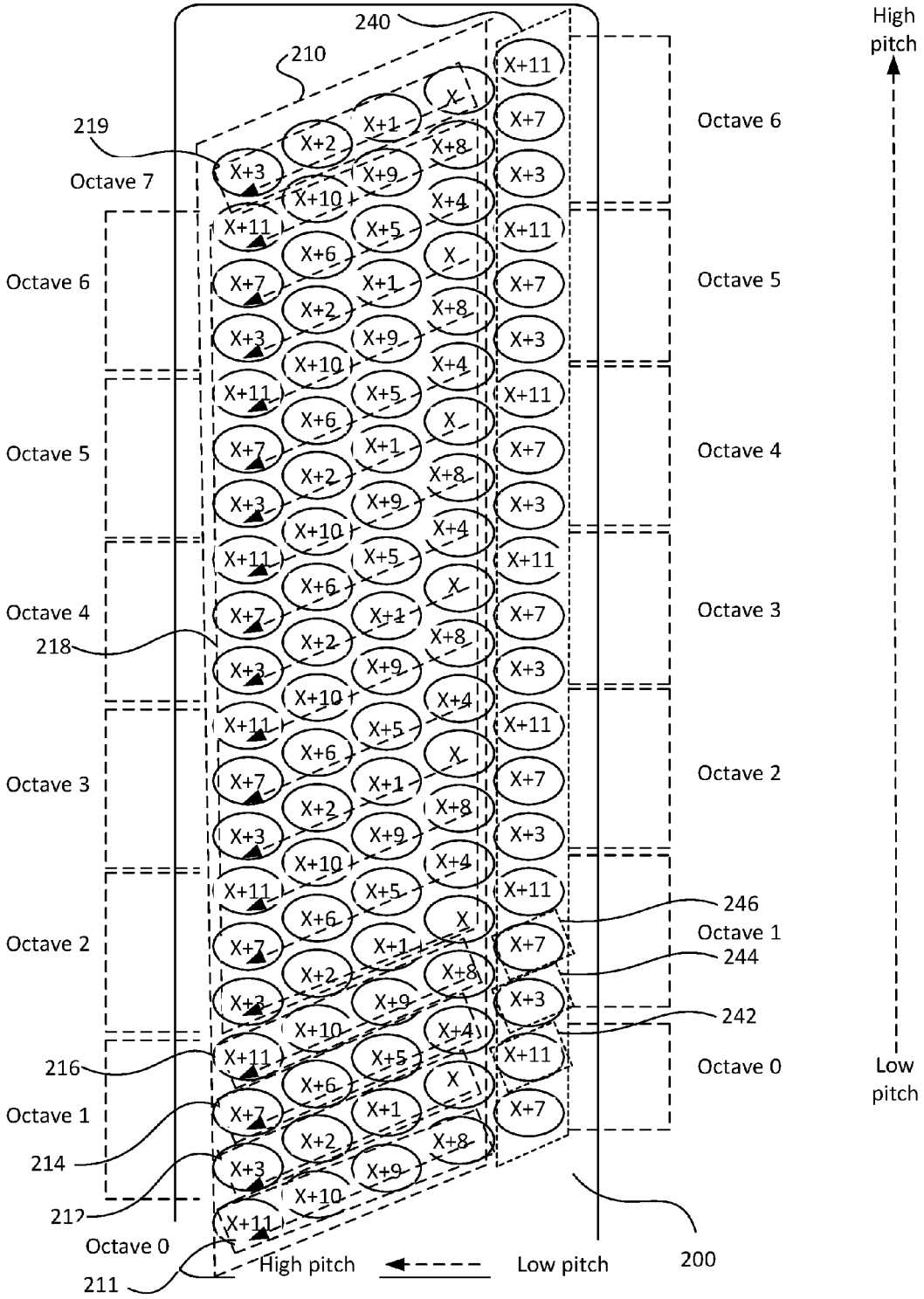
FIG. 27 is a diagram illustrating an example of left hand key note pattern of the present invention.

FIG. 27 illustrates an exploded perspective view of a Note layout. As shown in the drawing, the Note layout according to the embodiment includes four rows of buttons 210 provided on the left hand plays side 200. The four rows of buttons 210 are similar to the four rows of buttons 210 as shown in FIG. 8.

The Note layout according to the embodiment includes one row of buttons 240. The one row of buttons 240 is provided adjacent to the opposite bellow side of the four rows of buttons 210. The one row of buttons 240 includes a first column 242, a second column 244, and a third column 246. The first column 242 is provided adjacent to the first column 212 of the four rows of buttons 210. First pitch X+11 is assigned to the first column 242. The first pitch X+11 is continuous to the first continuous four pitches X, X+1, X+2 and X+3. The second column 244 is provided adjacent to the second column 214 of the four rows of buttons 210. Second pitch X+3 is assigned to the second column 246. The second pitch X+3 is continuous to the second continuous four pitches X+4, X+5, X+6 and X+7. A third column 246 is provided adjacent to the third column 216 of the four rows of buttons 210. Third pitch X+7 is assigned to the third column 246. The third pitch X+7 is continuous to the third continuous four pitches X+8, X+9, X+10 and X+11.

The first continuous four pitches X, X+1, X+2 and X+3 and the first pitch X+11 are assigned such that the first continuous four pitches X, X+1, X+2 and X+3 and the first pitch X+11 become higher in order in a direction approaching to the bellow 300. The second continuous four pitches X+4, X+5, X+6 and X+7 and the second pitch X+3 are assigned such that the second continuous four pitches X+4, X+5, X+6 and X+7 and the second pitch X+3 become higher in order in a direction approaching to the bellow 300. The third continuous four pitches X+8, X+9, X+10 and X+11 and the third pitch X+7 are assigned such that the second continuous four pitches X+8, X+9, X+10 and X+11 and the third pitch X+7 become higher in order in a direction approaching to the bellow 300.

The Note layout according to the embodiment can be adapted to a mechanical accordion and an electronic accordion. According to this embodiment, if the accordionist wants to play chord (for example, X, X+4, and X+7), the accordionist can play the chord very fast and easily because the notes belonging to the chord are provided adjacent and close to each other.

Figure 28:
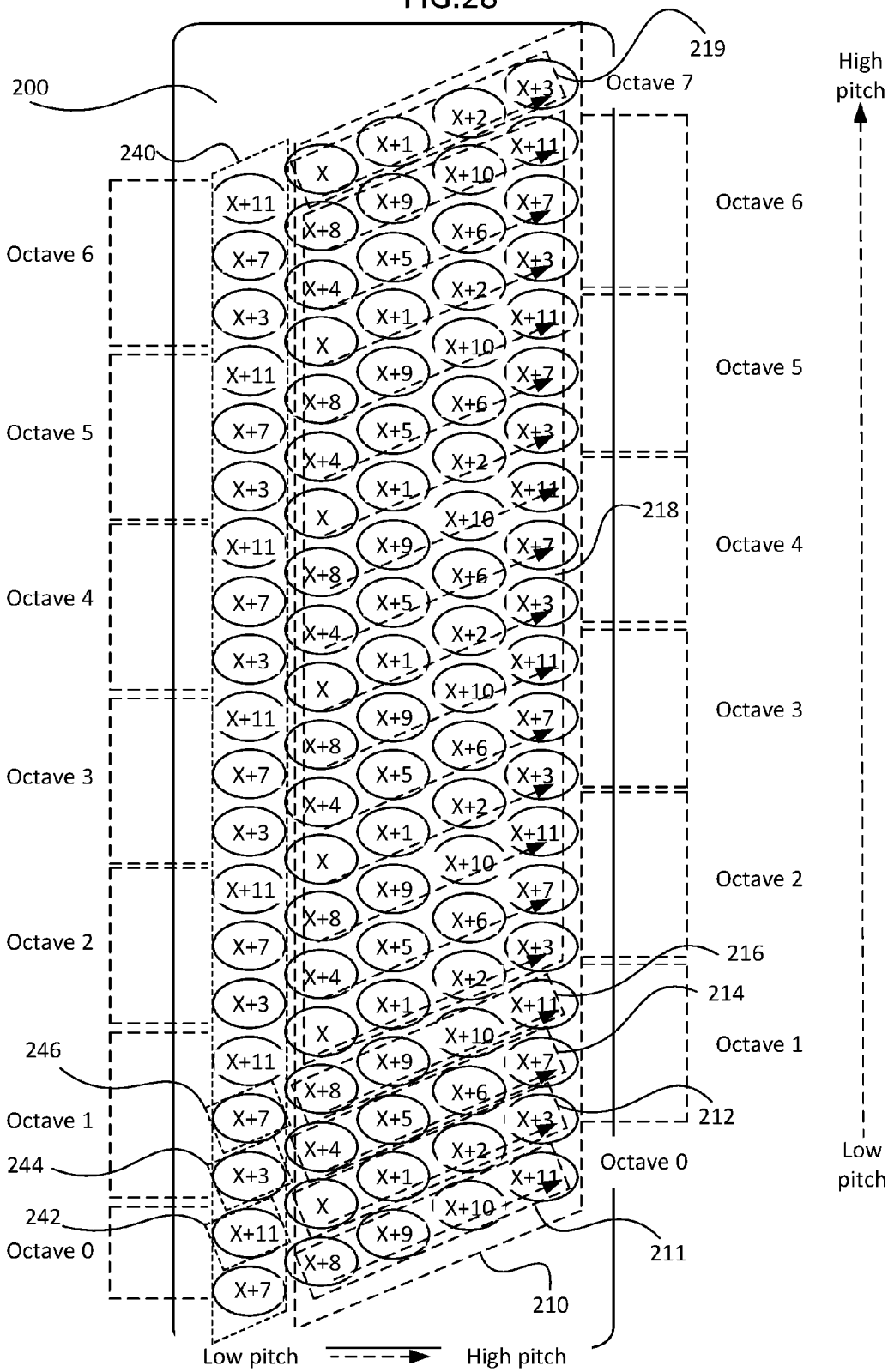
FIG. 28 is a diagram illustrating an example of left hand key note pattern of the present invention.

FIG. 28 illustrates an exploded perspective view of a Note layout. As shown in the drawing, the Note layout according to the embodiment includes four rows of buttons 210 provided on the left hand plays side 200. The four rows of buttons 210 are similar to the four rows of buttons 210 as shown in FIG. 9.

The Note layout according to the embodiment includes one row of buttons 240. The one row of buttons 240 is provided adjacent to the bellow side of the four rows of buttons 210. The one row of buttons 240 includes a first column 242, a second column 244, and a third column 246. The first column 242 is provided adjacent to the first column 212 of the four rows of buttons 210. First pitch X+11 is assigned to the first column 242. The first pitch X+11 is continuous to the first continuous four pitches X, X+1, X+2 and X+3. The second column 244 is provided adjacent to the second column 214 of the four rows of buttons 210. Second pitch X+3 is assigned to the second column 244. The second pitch X+3 is continuous to the second continuous four pitches X+4, X+5, X+6 and X+7. A third column 246 is provided adjacent to the third column 216 of the four rows of buttons 210. Third pitch X+7 is assigned to the third column 246. The third pitch X+7 is continuous to the third continuous four pitches X+8, X+9, X+10 and X+11.

The first continuous four pitches X, X+1, X+2 and X+3 and the first pitch X+11 are assigned such that the first continuous four pitches X, X+1, X+2 and X+3 and the first pitch X+11 become higher in order in a direction away from the bellow 300. The second continuous four pitches X+4, X+5, X+6 and X+7 and the second pitch X+3 are assigned such that the second continuous four pitches X+4, X+5, X+6 and X+7 and the second pitch X+3 become higher in order in a direction away from the bellow 300. The third continuous four pitches X+8, X+9, X+10 and X+11 and the third pitch X+7 are assigned such that the second continuous four pitches X+8, X+9, X+10 and X+11 and the third pitch X+7 become higher in order in a direction away from the bellow 300.

The Note layout according to the embodiment can be adapted to a mechanical accordion and an electronic accordion. According to this embodiment, if the accordionist wants to play chord (for example, X, X+4, and X+7), the accordionist can play the chord very fast and easily because the notes belonging to the chord are provided adjacent and close to each other.

Figure 29:
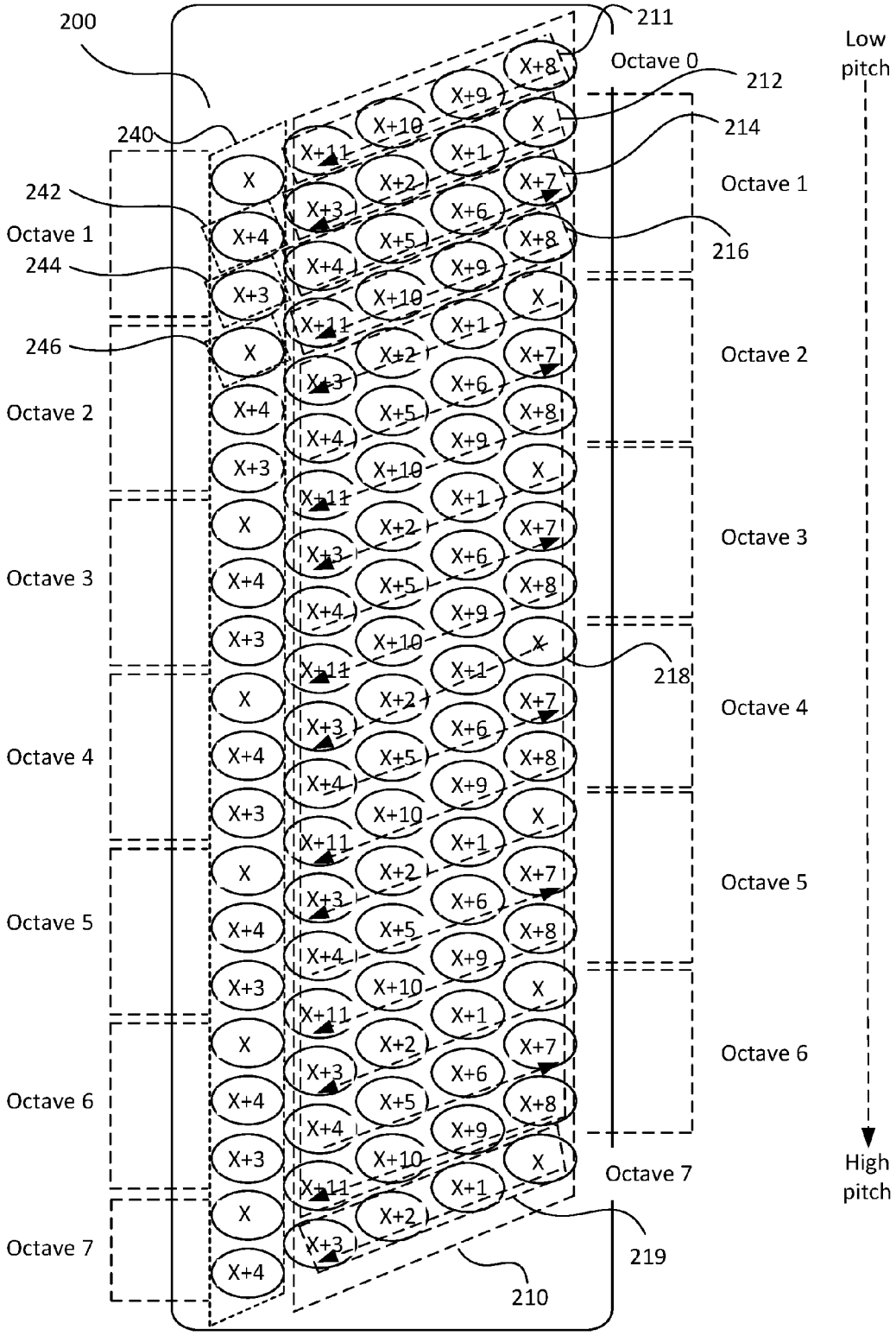
FIG. 29 is a diagram illustrating an example of left hand key note pattern of the present invention.

FIG. 29 illustrates an exploded perspective view of a Note layout. As shown in the drawing, the Note layout according to the embodiment includes four rows of buttons 210 provided on the left hand plays side 200. The four rows of buttons 210 are similar to the four rows of buttons 210 as shown in FIG. 10.

The Note layout according to the embodiment includes one row of buttons 240. The one row of buttons 240 is provided adjacent to the bellow side of the four rows of buttons 210. The one row of buttons 240 includes a first column 242, a second column 244, and a third column 246. The first column 242 is provided adjacent to the first column 212 of the four rows of buttons 210. First pitch X+4 is assigned to the first column 242. The first pitch X+4 is continuous from the first continuous four pitches X, X+1, X+2 and X+3. The second column 244 is provided adjacent to the second column 214 of the four rows of buttons 210. Second pitch X+3 is assigned to the second column 244. The second pitch X+3 is continuous to the second continuous four pitches X+4, X+5, X+6 and X+7. A third column 246 is provided adjacent to the third column 216 of the four rows of buttons 210. Third pitch X is assigned to the third column 246. The third pitch X is continuous from the third continuous four pitches X+8, X+9, X+10 and X+11.

The first continuous four pitches X, X+1, X+2 and X+3 and the first pitch X+4 are assigned such that the first continuous four pitches X, X+1, X+2 and X+3 and the first pitch X+4 become higher in order in a direction approaching to the bellow 300. The second continuous four pitches X+4, X+5, X+6 and X+7 and the second pitch X+3 are assigned such that the second continuous four pitches X+4, X+5, X+6 and X+7 and the second pitch X+3 become higher in order in a direction away from the bellow 300. The third continuous four pitches X+8, X+9, X+10 and X+11 and the third pitch X are assigned such that the second continuous four pitches X+8, X+9, X+10 and X+11 and the third pitch X become higher in order in a direction approaching to the bellow 300.

The Note layout according to the embodiment can be adapted to a mechanical accordion and an electronic accordion. According to this embodiment, if the accordionist wants to play chord, the accordionist can play the chord very fast and easily because the notes belonging to the chord are provided adjacent and close to each other.

Figure 30:
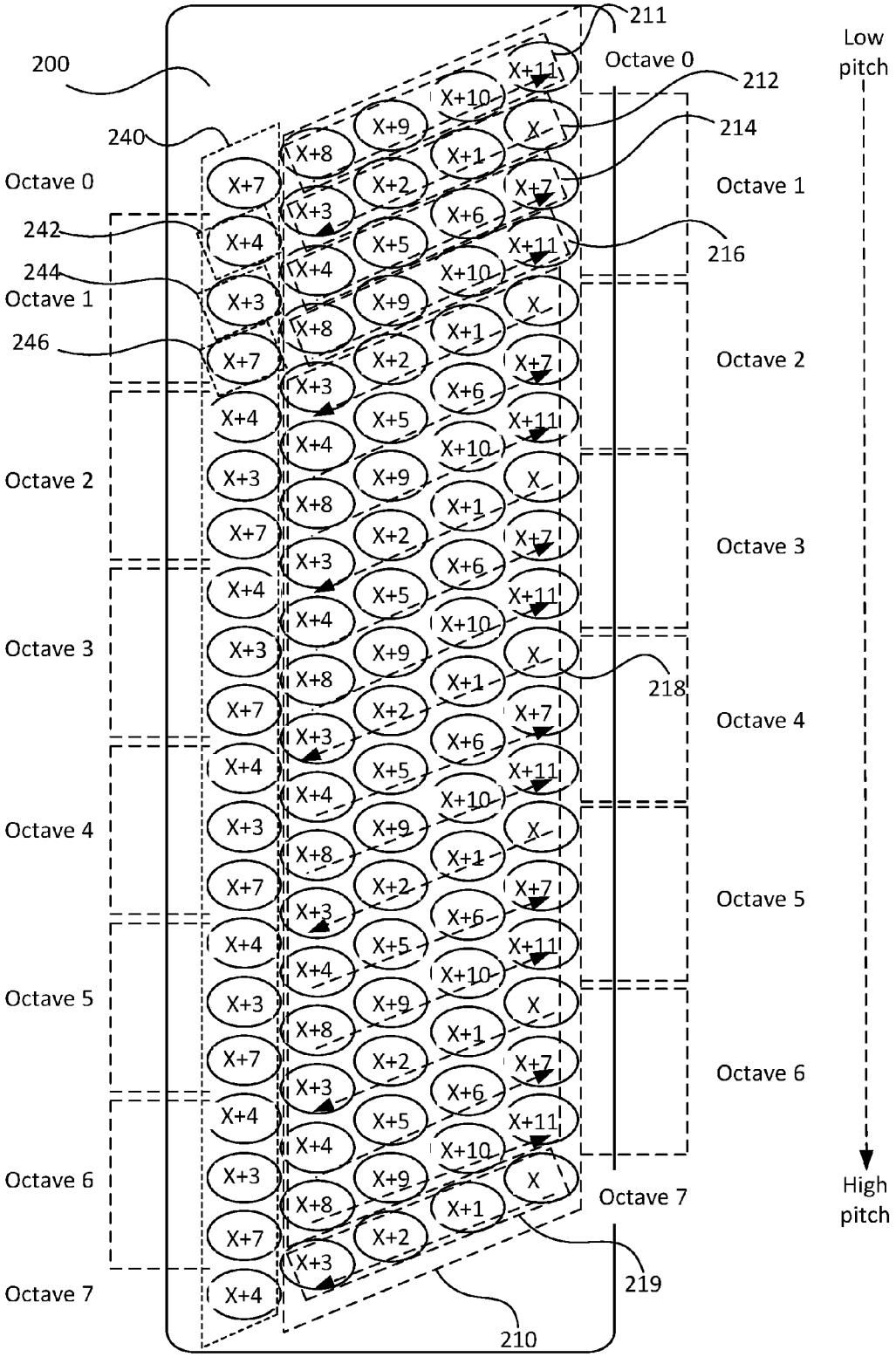
FIG. 30 is a diagram illustrating an example of left hand key note pattern of the present invention.

FIG. 30 illustrates an exploded perspective view of a Note layout. As shown in the drawing, the Note layout according to the embodiment includes four rows of buttons 210 provided on the left hand plays side 200. The four rows of buttons 210 are similar to the four rows of buttons 210 as shown in FIG. 11.

The Note layout according to the embodiment includes one row of buttons 240. The one row of buttons 240 is provided adjacent to the bellow side of the four rows of buttons 210. The one row of buttons 240 includes a first column 242, a second column 244, and a third column 246. The first column 242 is provided adjacent to the first column 212 of the four rows of buttons 210. First pitch X+4 is assigned to the first column 242. The first pitch X+4 is continuous from the first continuous four pitches X, X+1, X+2 and X+3. The second column 244 is provided adjacent to the second column 214 of the four rows of buttons 210. Second pitch X+3 is assigned to the second column. The second pitch X+3 is continuous to the second continuous four pitches X+4, X+5, X+6 and X+7. A third column 246 is provided adjacent to the third column 216 of the four rows of buttons 210. Third pitch X+7 is assigned to the third column 246. The third pitch X+7 is continuous to the third continuous four pitches X+8, X+9, X+10 and X+11.

The first continuous four pitches X, X+1, X+2 and X+3 and the first pitch X+4 are assigned such that the first continuous four pitches X, X+1, X+2 and X+3 and the first pitch X+4 become higher in order in a direction approaching to the bellow 300. The second continuous four pitches X+4, X+5, X+6 and X+7 and the second pitch X+3 are assigned such that the second continuous four pitches X+4, X+5, X+6 and X+7 and the second pitch X+3 become higher in order in a direction away from the bellow 300. The third continuous four pitches X+8, X+9, X+10 and X+11 and the third pitch X+7 are assigned such that the second continuous four pitches X+8, X+9, X+10 and X+11 and the third pitch X+7 become higher in order in a direction away from the bellow 300.

The Note layout according to the embodiment can be adapted to a mechanical accordion and an electronic accordion. According to this embodiment, if the accordionist wants to play chord, the accordionist can play the chord very fast and easily because the notes belonging to the chord are provided adjacent and close to each other.

Figure 31:
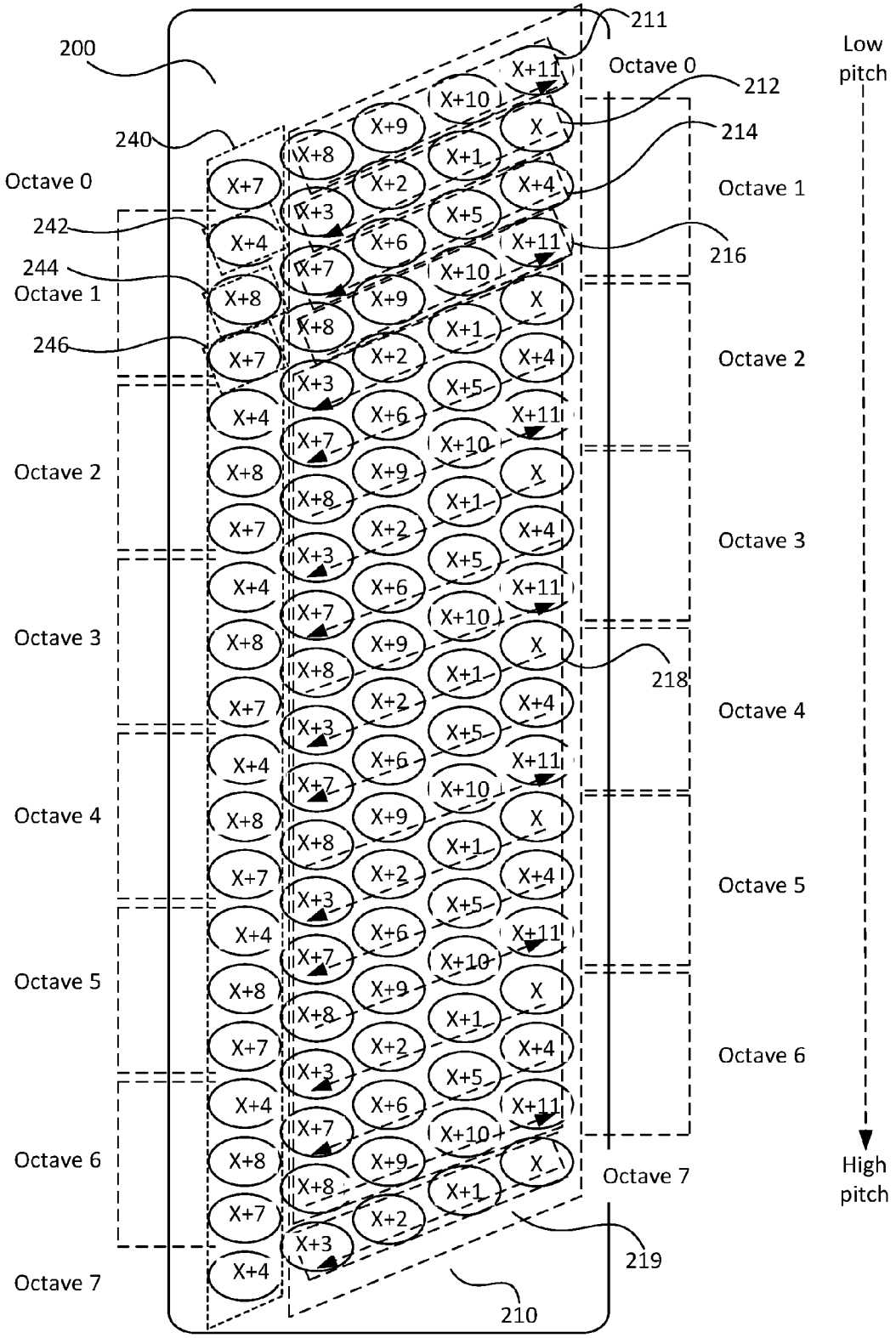
FIG. 31 is a diagram illustrating an example of left hand key note pattern of the present invention.

FIG. 31 illustrates an exploded perspective view of a Note layout. As shown in the drawing, the Note layout according to the embodiment includes four rows of buttons 210 provided on the left hand plays side 200. The four rows of buttons 210 are similar to the four rows of buttons 210 as shown in FIG. 12.

The Note layout according to the embodiment includes one row of buttons 240. The one row of buttons 240 is provided adjacent to the bellow side of the four rows of buttons 210. The one row of buttons 240 includes a first column 242, a second column 244, and a third column 246. The first column 242 is provided adjacent to the first column 212 of the four rows of buttons 210. First pitch X+4 is assigned to the first column 242. The first pitch X+4 is continuous from the first continuous four pitches X, X+1, X+2 and X+3. The second column 244 is provided adjacent to the second column 214 of the four rows of buttons 210. Second pitch X+8 is assigned to the second column 244. The second pitch X+8 is continuous from the second continuous four pitches X+4, X+5, X+6 and X+7. A third column 246 is provided adjacent to the third column 216 of the four rows of buttons 210. Third pitch X+7 is assigned to the third column 246. The third pitch X+7 is continuous to the third continuous four pitches X+8, X+9, X+10 and X+11.

The first continuous four pitches X, X+1, X+2 and X+3 and the first pitch X+4 are assigned such that the first continuous four pitches X, X+1, X+2 and X+3 and the first pitch X+4 become higher in order in a direction approaching to the bellow 300. The second continuous four pitches X+4, X+5, X+6 and X+7 and the second pitch X+8 are assigned such that the second continuous four pitches X+4, X+5, X+6 and X+7 and the second pitch X+8 become higher in order in a direction approaching to the bellow 300. The third continuous four pitches X+8, X+9, X+10 and X+11 and the third pitch X+7 are assigned such that the second continuous four pitches X+8, X+9, X+10 and X+11 and the third pitch X+7 become higher in order in a direction away from the bellow 300.

The Note layout according to the embodiment can be adapted to a mechanical accordion and an electronic accordion. According to this embodiment, if the accordionist wants to play chord, the accordionist can play the chord very fast and easily because the notes belonging to the chord are provided adjacent and close to each other.

An electronic accordion according to the embodiment is similar to the electronic accordion 2000 as shown in FIG. 15 or the electronic accordion 3000 as shown in FIG. 16. The Note layouts according to FIGS. 18 to 31 can be adapted to the electronic accordion 2000 or the electronic accordion 3000.

For example, the CPU (controller) 2200 or 3200 is configured to execute assigning a plurality of pitches to the buttons of left hand play side such that a note layout pattern of the electronic accordion 2000 or the electronic accordion 3000 becomes as the note layout pattern of FIG. 18 to FIG. 24. More specifically, the CPU (controller) 2200 or 3200 is configured to execute assigning first continuous four pitches (for example X, X+1, X+2, X+3) to a first column 212 of the four rows of buttons 210. The CPU (controller) 2200 or 3200 is configured to further execute assigning second continuous four pitches (for example X+4, X+5, X+6, X+7) to a second column 214 of the four rows of buttons 210. The CPU (controller) 2200 or 3200 is configured to further execute assigning third continuous four pitches (for example X+8, X+9, X+10, X+11) to a third column 216 of the four rows of buttons 210. The CPU (controller) 2200 or 3200 is configured to further execute assigning first continuous two pitches to a first column 232 of the two rows of buttons 230. The CPU (controller) 2200 or 3200 is configured to further execute assigning second continuous two pitches to a second column 234 of the two rows of buttons 230. The CPU (controller) 2200 or 3200 is configured to further execute assigning third continuous two pitches to a third column 236 of the two rows of buttons 230.

In addition, the CPU (controller) 2200 or 3200 is configured to execute assigning a plurality of pitches to the buttons of left hand play side such that a note layout pattern of the electronic accordion 2000 or the electronic accordion 3000 becomes as the note layout pattern of FIG. 25 to FIG. 31. The details of assigning first continuous four pitches (for example X, X+1, X+2, X+3) to a first column 212 of the four rows of buttons 210, second continuous four pitches (for example X+4, X+5, X+6, X+7) to a second column 214 of the four rows of buttons 210, and assigning third continuous four pitches (for example X+8, X+9, X+10, X+11) to a third column 216 of the four rows of buttons 210 are same as described above. In addition, the CPU (controller) 2200 or 3200 is configured to further execute assigning first pitch to a first column 242 of the one row of buttons 240. The CPU (controller) 2200 or 3200 is configured to further execute assigning second pitch to a second column 244 of the one row of buttons 240. The CPU (controller) 2200 or 3200 is configured to further execute assigning third pitch to a third column 246 of the one row of buttons 240.

In addition, the Software 2300, 3200, or 6100 (a computer program product) is configured to cause the CPU (controller) 2200, 3200, or the PC 6000 (CPU) to execute assigning a plurality of pitches to the buttons of left hand play side such that a note layout pattern of the electronic accordion 2000, 3000, or 5000 becomes as the note layout pattern of FIG. 18 to FIG. 24. The details of assigning a plurality of pitches to the buttons of left hand play side by the Software 2300, 3200, or 6100 is similar as the one performed by the CPU (controller) 2200 or 3200 as described above.

When a button of the electronic accordion 2000, 3000, or 5000 is pushed by the accordionist, the CPU 2200, 3200, or the PC 6000 (the Software 2300, 3200, or 6100) determines which button is pushed, and determines a pitch corresponding to the pushed button according to a sound table. The sound table is stored in a memory of the electronic accordion 2000, 3000, or the PC 6000. The sound table specifies a relationship between a location of each button of the electronic accordion 2000, 3000, or 5000 and each pitch. The relationship between the location of each button of the electronic accordion 2000, 3000, or 5000 and each pitch is as shown in FIGS. 18 to 31. The CPU 2200, 3200, or the PC 6000 (the Software 2300, 3200, or 6100) reads out a sound signal corresponding to the pitch determined by the CPU 2200, 3200, or the PC 6000 (the Software 2300, 3200, or 6100) from a sound source (for example, MIDI). Then the CPU 2200, 3200, or the PC 6000 (the Software 2300, 3200, or 6100) outputs the sound signal read from the sound source to the speaker 2400, 3300, or the amplifier 6200. As a result a sound corresponding to the sound signal is played through the speaker 2400, 3300, or the amplifier 6200.

What is claimed is:

1. An accordion comprising:

a right hand play side;

a left hand play side;

a bellow provided between the right hand play side and the left hand play side;

four rows of buttons provided on at least one of the right hand play side and the left hand play side; and two rows of buttons provided adjacent to the bellow side of the four rows of buttons or opposite bellow side of the four rows of buttons, wherein the four rows of buttons include:

a first column to which first continuous four pitches are assigned;

a second column, provided adjacent to the first column, to which second continuous four pitches are assigned, the second continuous four pitches being adjacent to the first continuous four pitches; and a third column, provided adjacent to the second column, to which third continuous four pitches are assigned, the third continuous four pitches being adjacent to the second continuous four pitches;

the two rows of buttons include:

a first column, provided adjacent to the first column of the four rows of buttons, to which first continuous two pitches are assigned, the first continuous two pitches being continuous from or to the first continuous four pitches;

a second column, provided adjacent to the second column of the four rows of buttons, to which second continuous two pitches are assigned, the second continuous two pitches being continuous from or to the second continuous four pitches; and a third column, provided adjacent to the third column of the four rows of buttons, to which third continuous two pitches are assigned, the third continuous two pitches being continuous from or to the third continuous four pitches.

2. The accordion according to claim 1, wherein the four rows of buttons and the two rows of buttons are arranged in lines in a direction substantially orthogonal to an expansion and contraction direction of the bellow, the first continuous four pitches and the first continuous two pitches are assigned such that the first continuous four pitches and the first continuous two pitches become higher in order in a direction approaching to the bellow or away from the bellow, the second continuous four pitches and the second continuous two pitches are assigned such that the second continuous four pitches and the second continuous two pitches become higher in order in a direction approaching to the bellow or away from the bellow, and the third continuous four pitches and the third continuous two pitches are assigned such that the third continuous four pitches and the third continuous two pitches become higher in order in a direction approaching to the bellow or away from the bellow.

3. The accordion according to claim 1, wherein the four rows of buttons further include:

a plurality of columns to which a plurality of octaves are assigned such that the plurality of octaves become gradually higher from a top side of the accordion to a bottom side of the accordion, the plurality of octaves each having twelve pitches which are assigned in the same manner as the first, second, and third continuous four pitches, and have different octave from the first, second, and third continuous four pitches.

4. The accordion according to claim 1, wherein the four rows of buttons further include:

a plurality of columns to which a plurality of octaves are assigned such that the plurality of octaves become gradually higher from a bottom side of the accordion to a top side of the accordion, the plurality of octaves each having twelve pitches which are assigned in the same manner as the first, second, and third continuous four pitches, and have different octave from the first, second, and third continuous four pitches.

5. An accordion comprising:

a right hand play side;

a left hand play side;

a bellow provided between the right hand play side and the left hand play side;

four rows of buttons provided on at least one of the right hand play side and the left hand play side; and one row of buttons provided adjacent to the bellow side of the four rows of buttons or opposite bellow side of the four rows of buttons, wherein the four rows of buttons include:

a first column to which first continuous four pitches are assigned;

a second column, provided adjacent to the first column, to which second continuous four pitches are assigned, the second continuous four pitches being adjacent to the first continuous four pitches; and a third column, provided adjacent to the second column, to which third continuous four pitches are assigned, the third continuous four pitches being adjacent to the second continuous four pitches;

the one row of buttons include:

a first column, provided adjacent to the first column of the four rows of buttons, to which first pitch is assigned, the first pitch being continuous from or to the first continuous four pitches;

a second column, provided adjacent to the second column of the four rows of buttons, to which second pitch is assigned, the second pitch being continuous from or to the second continuous four pitches; and a third column, provided adjacent to the third column of the four rows of buttons, to which third pitch is assigned, the third pitch being continuous from or to the third continuous four pitches.

6. An electronic accordion comprising:

a right hand play side;

a left hand play side;

a bellow provided between the right hand play side and the left hand play side;

four rows of buttons provided on at least one of the right hand play side and the left hand play side;

two rows of buttons provided adjacent to the bellow side of the four rows of buttons or opposite bellow side of the four rows of buttons; and a controller configured to execute:

assigning first continuous four pitches to a first column of the four rows of buttons;

assigning second continuous four pitches to a second column of the four rows of buttons, the second continuous four pitches being adjacent to the first continuous four pitches, and the second column of the four rows of buttons being provided adjacent to the first column of the four rows of buttons;

assigning third continuous four pitches to a third column of the four rows of buttons, third continuous four pitches being adjacent to the second continuous four pitches, and the third column of the four rows of buttons being provided adjacent to the second column of the four rows of buttons;

assigning first continuous two pitches to a first column of the two rows of buttons, the first continuous two pitches being continuous from or to the first continuous four pitches, and the first column of the two rows of buttons being provided adjacent to the first column of the four rows of buttons;

assigning second continuous two pitches to a second column of the two rows of buttons, the second continuous two pitches being continuous from or to the second continuous four pitches, and the second column of the two rows of buttons being provided adjacent to the second column of the four rows of buttons; and assigning third continuous two pitches to a third column of the two rows of buttons, the third continuous two pitches being continuous from or to the third continuous four pitches, and the third column of the two rows of buttons being provided adjacent to the third column of the four rows of buttons.

7. The electronic accordion according to claim 6, wherein the four rows of buttons and the two rows of buttons are arranged in lines in a direction substantially orthogonal to an expansion and contraction direction of the bellow, and the controller is configured to execute:

assigning the first continuous four pitches and the first continuous two pitches such that the first continuous four pitches and the first continuous two pitches become higher in order in a direction approaching to the bellow or away from the bellow, assigning the second continuous four pitches and the second continuous two pitches such that the second continuous four pitches and the second continuous two pitches become higher in order in a direction approaching to the bellow or away from the bellow, and assigning the third continuous four pitches and the third continuous two pitches such that the third continuous four pitches and the third continuous two pitches become higher in order in a direction approaching to the bellow or away from the bellow.

8. The electronic accordion according to claim 6, wherein the controller is further configured to execute:

assigning a plurality of octaves to a plurality of columns of the four rows of buttons such that the plurality of octaves become gradually higher from a top side of the electronic accordion to a bottom side of the electronic accordion, the plurality of octaves each having twelve pitches which are assigned in the same manner as the first, second, and third continuous four pitches, and have different octave from the first, second, and third continuous four pitches.

9. The electronic accordion according to claim 6, wherein the controller is further configured to execute:

assigning a plurality of octaves to a plurality of columns of the four rows of buttons such that the plurality of octaves become gradually higher from a bottom side of the electronic accordion to a top side of the electronic accordion, the plurality of octaves each having twelve pitches which are assigned in the same manner as the first, second, and third continuous four pitches, and have different octave from the first, second, and third continuous four pitches.

* * * * *